US007511568B2

(12) United States Patent
Kimura

(10) Patent No.: US 7,511,568 B2
(45) Date of Patent: Mar. 31, 2009

(54) REFERENCE VOLTAGE CIRCUIT

(75) Inventor: Katsuji Kimura, Kanagawa (JP)

(73) Assignee: NEC Electronics Corporation, Kawasaki, Kanagawa (JP)

( * ) Notice: Subject to any disclaimer, the term of this patent is extended or adjusted under 35 U.S.C. 154(b) by 81 days.

(21) Appl. No.: 11/337,678

(22) Filed: Jan. 24, 2006

(65) Prior Publication Data

US 2006/0164158 A1 Jul. 27, 2006

(30) Foreign Application Priority Data

Jan. 25, 2005 (JP) ..... 2005-016902

(51) Int. Cl.
*G05F 1/10* (2006.01)

(52) U.S. Cl. ..... 327/539; 327/538

(58) Field of Classification Search ..... 327/539; 323/313

See application file for complete search history.

(56) References Cited

U.S. PATENT DOCUMENTS

| | | | | |
|---|---|---|---|---|
| 5,818,081 | A * | 10/1998 | Ohmi et al. | 257/319 |
| 6,847,240 | B1 * | 1/2005 | Zhou | 327/143 |
| 7,005,839 | B2 * | 2/2006 | Wada | 323/316 |
| 7,199,646 | B1 * | 4/2007 | Zupcau et al. | 327/539 |
| 2005/0110476 | A1 * | 5/2005 | Mukherjee et al. | 323/313 |
| 2006/0043957 | A1 * | 3/2006 | Carvalho | 323/313 |

FOREIGN PATENT DOCUMENTS

| | | |
|---|---|---|
| JP | 11-045125 | 2/1999 |
| JP | 2003-173212 | 6/2003 |
| JP | 2003-173213 | 6/2003 |

* cited by examiner

*Primary Examiner*—Quan Tra
*Assistant Examiner*—Khareem E Almo
(74) *Attorney, Agent, or Firm*—McGinn IP Law Group PLLC

(57) ABSTRACT

Disclosed is a reference voltage circuit including control means for performing control so that the voltage of a first current-to-voltage conversion circuit becomes equal to the voltage of a second current-to-voltage conversion circuit; a first current mirror circuit for outputting a current proportionate to the value of a current supplied to the first current-to-voltage conversion circuit or the second current-to-voltage conversion circuit; and a third current-to-voltage conversion circuit for converting the output current from the first current mirror circuit to a voltage, wherein each of the first to third current-to-voltage conversion circuits is configured as follows: a first diode (or a diode-connected first bipolar transistor) is connected in series with a first resistor, and a second resistor is further connected in parallel with the first diode and the first resistor. Alternatively, the first diode (or a diode-connected second bipolar transistor) is connected in parallel with the first resistor, and the second resistor is connected in series with the first diode and the first resistor. Alternatively, the third current-to-voltage conversion circuit is constituted from a resistor.

22 Claims, 46 Drawing Sheets

REFERENCE VOLTAGE CIRCUIT

FIELD OF THE INVENTION

The present invention relates to a reference voltage circuit. More specifically, the invention relates to a reference voltage circuit having a small chip area and a small temperature characteristic, which is operated at a low voltage and is suitable for being formed on a CMOS semiconductor integrated circuit.

BACKGROUND OF THE INVENTION

A conventional CMOS reference voltage circuit is described in detail in Patent Document 1 (JP Patent Kokai Publication No. JP-A-11-45125). This reference voltage circuit obtains a reference voltage through current-to-voltage conversion. This is of course the same as with a reference voltage circuit of this type devised before by which the temperature characteristic of the reference voltage is compensated. In the reference voltage circuit of this type devised before, by which the temperature characteristic is compensated, a reference voltage having a positive temperature characteristic is converted to a voltage by an output circuit constituted from a resistor and a diode (or a diode-connected transistor). A voltage component representative of a voltage drop across the resistor having a positive temperature characteristic and a voltage component representative of a forward voltage of the diode (or the diode-connected transistor) having a negative temperature characteristic were obtained. Then, by adding both of the voltage components, the reference voltage of approximately 1.2 V with temperature characteristic thereof compensated is obtained.

On the other hand, in the reference voltage circuit described in Patent Document 1 (Japanese Patent Kokai Publication No. JP-A-11-45125), which was devised by Mr. Bamba, a reference current having little temperature characteristic is obtained, and the reference current is converted to a voltage by an output circuit constituted from a resistor alone. The reference voltage having an arbitrary voltage value is thereby obtained.

The voltage of 1.2 V with the temperature characteristics thereof compensated, defined as the output voltage of the conventional reference voltage circuit of this type, is obtained through conversion to current value within the circuit. Thus, the reference voltage circuit can be operated at a supply voltage of 1.2V or less.

Non-patent Document 1 ("Analog Circuit Design Technique for CMOS Implementation of A Portable Radio Terminal", by Triceps Co., Ltd., 1999), which is a text written by the inventor of the present invention, immediately introduced this circuit as a "current-mode reference voltage circuit" before the end of the year when the circuit was disclosed, and published a detailed circuit analysis thereof.

In the conventional reference voltage circuit, in particular, the forward voltage of the diode (or diode-connected transistor) is used as the voltage component having the negative temperature characteristic. Accordingly, a deviation from the temperature characteristic of the forward voltage of the diode (or diode-connected transistor) noticeably appears in the output voltage.

That is, the forward voltage of the diode (or the diode-connected transistor) has the negative temperature characteristic, and as the temperature is reduced, the gradient of the negative temperature characteristic becomes gentle.

On the other hand, the voltage having the positive temperature characteristic is implemented by obtaining a current that flows through the resistor using a difference voltage between the forward voltages of two diodes (or diode-connected transistors) having different current densities, and further converting the current into the voltage by the resistor.

It should be noted herein that, since the gradient of the negative temperature characteristic of the forward voltage of the diode (or diode-connected transistor) becomes gentle as the temperature is lowered, linearity of the forward voltage of the diode with respect to the temperature characteristic is poor, but linearity of the difference voltage between the forward voltages of the two diodes (or diode-connected transistors) (having the different current densities) with respect to the temperature characteristic is very good. This is not described in the above-mentioned text.

As described above, even if devices each having poor linearity with respect to the temperature characteristic are used, by changing the circuit configuration of the reference voltage circuit to the current-mode reference voltage circuit and by using the difference voltage between the devices, the linearity with respect to the temperature characteristic is greatly improved.

An operation of the reference voltage circuit will be described according to contents described in Patent Document 1 (Japanese Patent Kokai Publication No. JP-A-11-45125). Referring to FIG. 1, by an OP amp DA1, a common gate voltage of transistors P1 and P2 is so controlled that a voltage VA equals to a voltage VB.

Accordingly, the following equation holds:

$$VA=VB \tag{1}$$

Further, the following equation holds:

$$I1=I2 \tag{2}$$

The output current I1 of the p-channel transistor P1 is branched into a current I1A that flows through a diode D1 and a current I1B that flows through a resistor R4. Likewise, the output current I2 of the p-channel transistor P2 is branched into a current I2A that flows in common through a resistor R1 and diodes D2 and a current I2B that flows through a resistor R2. The resistor R1 is connected in series with the p-channel transistor P2, and the diodes D2 are constituted from N diodes connected in parallel to one another.

When $$R2=R4 \tag{3}$$

then $$I1A=I2A \tag{4}$$

$$I1B=I2B \tag{5}$$

hold.

When the forward voltages of the diodes D1 and D2 are represented by VF1 and VF2, respectively, the following equations are derived.

$$VA=VF1 \tag{6}$$

$$VB=VF2+\Delta VF \tag{7}$$

Then, the following equation holds:

$$\Delta VF=VF1-VF2 \tag{8}$$

The ΔVF indicates a voltage drop across the resistor R1. Thus, the following equations hold:

$$I2A=\Delta VF/R1 \tag{9}$$

$$I1B=I2B=VF1/R2 \tag{10}$$

Here, the following equation holds:

$$\Delta VF = V_T \ln(N) \tag{11}$$

in which $V_T$ indicates a thermal voltage, and is expressed as follows:

$$V_T = kT/q \tag{12}$$

where T is absolute temperature in degrees Kelvin [K], k is Boltzmann's constant, and q is the charge of an electron.

Accordingly, a current I3 (=I2) is converted to a voltage by a resistor R3, and a voltage Vref is expressed as follows:

$$\begin{aligned} Vref &= R3 \times I3 \\ &= R3\{VF1/R2 + (V_T \ln(N)/R1) \\ &= (R3/R2)\{VF1 + (R2/R1)(V_T \ln(N))\} \end{aligned} \tag{13}$$

In which a voltage (VF1+(R2/R1)($V_T$ ln(N)) has the value of approximately 1.2 V with the temperature characteristic compensated. Specifically, the voltage VF1 has a negative temperature coefficient (temperature characteristic) of approximately −1.9 mV/° C., while the voltage VT has a positive temperature coefficient of 0.0853 mV/° C. Accordingly, in order to compensate the temperature characteristics, the value of (R2/R1)ln(N) becomes 22.3.

Since the thermal voltage $V_T$ is 26 mV at an ambient temperature (300K), a voltage (R2/R1)($V_T$ ln(N)) becomes approximately 580 mV at the ambient temperature.

Accordingly, when the voltage VF1 is set to 620 mV at the ambient temperature, the voltage {VF1+(R2/R1)(VT ln(N))} becomes approximately 1.2 V.

The temperature characteristic will be rigidly discussed. Since the resistor R4 is connected in parallel with the diode D1, the value of a current that flows through the resistor R4 tends to decrease due to non-linearity with respect of the temperature characteristic of the diode.

On the other hand, the resistor R1 is connected in series with the diode D2. Thus, when a current that flows through the diode D2 has a positive temperature characteristic, a voltage between the diode D2 and the resistor R1 will be lower than the voltage of the diode D1.

Since the voltages of both of the diodes are controlled to be equal, an increase in the currents is performed at a low temperature, thereby operating so that voltages at both of the diodes to be equal. Conversely, at a high temperature, an inverse operation is performed.

That is, each of the currents that flow through the diodes D1 and D2, respectively, in this circuit are set to have a temperature characteristic smaller than the temperature characteristic defined by ($V_T$ ln(N))/R1. Currents (VF1/R2, VF1/R4) that flow through the resistors R2 and R4, respectively, also increase at the low temperature to a certain degree.

Drive currents supplied from the transistors P1, P2, and P3 function to cancel non-linearities with respect to the temperature characteristics of the forward voltages of the diodes. Thus, the temperature characteristic of the reference voltage obtained can also be set to the characteristic which is very close to a straight line having less variations with respect to the temperature.

Since a resistor ratio (R3/R2) has zero temperature coefficient, the reference voltage Vref to be output becomes the voltage in which the temperature characteristics thereof are compensated.

The resistor ratio (R3/R2) can be arbitrarily set. When the ratio (R3/R2) is larger than 1, the voltage Vref becomes the voltage higher than 1.2 V. When the ratio (R3/R2) is smaller than 1, the Vref becomes the voltage lower than 1.2 V.

In Patent Document 1 (Japanese Patent Kokai Publication No. JP-A-11-45125), the value of 10 is described as the specific value of N. However, when the circuit was actually implemented, N was set to 100 (according to an IEEE Symposium on VLSI Circuits 1998 (May)).

The miniaturization in CMOS process has advanced, and the size of MOS transistors has become smaller. On contrast therewith, the size of a diode that employs a parasitic bipolar device is enormously larger than that the MOS transistor.

The ratio N between the diode D1 and the diode D2 is increased substantially from a single-digit number to a double-digit number, the areas of the diode D1 and the diode D2 on a chip have become large.

Meanwhile, each of Patent Documents 2 and 3 discloses a CMOS reference voltage generating circuit including a first voltage generating circuit, a second voltage generating circuit, an output resistor element, an operational amplifier OP, transistors PT1, PT2, and PT3, and current sources IS1, IS2, and IS3. The first voltage generating circuit includes a diode D1 and generates a voltage VN1 for the diode D1. The second voltage generating circuit includes a diode D2 and generates a voltage VN2 for the diode D2. The operational amplifier OP performs feedback control so that the voltage VN1 is generally equal to the voltage VN2. Gate electrodes of the transistors PT1, PT2, and PT3 are controlled by the operational amplifier OP, thereby controlling currents to be supplied to the first voltage generating circuit, second voltage generating circuit, and output resistor element. The current sources IS1, IS2, and IS3 supply currents for activating the CMOS reference voltage generating circuit to the first voltage generating circuit, second voltage generating circuit, and output resistor element, respectively.

[Patent Document 1]

Japanese Patent Kokai Publication No. JP-A-11-45125

[Patent Document 2]

Japanese Patent Kokai Publication No. JP-P2003-173212A

[Patent Document 3]

Japanese Patent Kokai Publication No. JP-P2003-173213A

[Non-Patent Document 1]

"Current-mode Reference Voltage Circuit" by Kimura, "Analog Circuit Design Technique for CMOS Implementation of A Portable Radio Terminal", by Triceps Co., Ltd., 1999

SUMMARY OF THE DISCLOSURE

The conventional circuit has problems which will be described below.

A first one of the problems is that the circuit has greater variations.

The reason for this is that control is so performed that the voltage of a circuit having the resistor connected in series with the diode becomes equal to the voltage of a circuit having the diode but not having such a resistor.

A second one of the problems is that the diode ratio of substantially a double-digit number to a three-digit number needs to be set.

The reason for this is that, since the circuits to be compared with each other and controlled are the circuit having the resistor connected in series with the diode and the circuit having the diode but not having such a resistor, the resistor connected in series with the diode needs to be correspondingly larger, and in order to increase a voltage difference between both of the diodes of the circuits, the diode ratio of substantially a double-figure number to a three-figure number needs to be set.

Accordingly, the present invention has been devised in to solve the problems described above.

The invention to be disclosed is generally configured as follows.

A reference voltage circuit according to the present invention comprises control means for performing control so that the voltage of a first current-to-voltage conversion circuit becomes equal to the voltage of a second current-to-voltage conversion circuit, and a first current mirror circuit for outputting a current proportionate to the value of the current supplied to the first current-to-voltage conversion circuit or the second current-to-voltage conversion circuit, for converting the output current from the first current mirror circuit to a voltage through a third current-to-voltage conversion circuit for supply, each of the first, second, and third current-to-voltage conversion circuits includes:

a circuit with a first diode (or a diode-connected first bipolar transistor) and a first resistor connected in series with each other, and a second resistor connected in parallel with the circuit; or a circuit with the first diode (a diode-connected second transistor) and the first resistor connected in parallel with each other, and the second resistor connected in series with the circuit.

Preferably, in the present invention, the third current-to-voltage conversion circuit is constituted from a resistor.

Preferably, in the present invention, a third diode (or a diode-connected bipolar transistor) is connected in parallel with the first current-to-voltage conversion circuit, and a fourth diode (or a diode-connected bipolar transistor) is connected in parallel with the second current-to-voltage conversion circuit.

Preferably, in the present invention, the control means is constituted from a differential amplifier (or an OP amp).

Preferably, in the present invention, in each of the first and second current-to-voltage conversion circuit, the first diode (or the diode-connected first bipolar transistor) and the first resistor are connected in series with each other, and the second resistor connected in parallel with the first diode (or the diode-connected first bipolar transistor) and the first resistor, and an intermediate potential of the second resistor is supplied to the input terminal of the differential amplifier (or the OP amp).

Preferably, in the present invention, the control means is constituted from a second current mirror circuit self-biased by a current mirror circuit including the first current mirror circuit.

Preferably, in the present invention, the control means compares the current supplied to the first current-to-voltage conversion circuit with the current supplied to the second current-to-voltage conversion circuit by a second current mirror circuit, and by biasing a third current mirror circuit by the output of said second current mirror circuit, the control means performs control so that the voltage of the first current-to-voltage conversion circuit becomes equal to the voltage of the second current-to-voltage conversion circuit.

Preferably, in the present invention, the control means is constituted from a second current mirror circuit self-biased by a current mirror circuit including the first current mirror circuit.

A reference voltage circuit according to the present invention, including control means for performing control so that the voltage of a first current-to-voltage conversion circuit becomes equal to the voltage of a second current-to-voltage conversion circuit, and a first current mirror circuit for outputting a current proportionate to the value of the current supplied to the first current-to-voltage conversion circuit or the second current-to-voltage conversion circuit, for converting the output current from the first current mirror circuit to a voltage through a third current-to-voltage conversion circuit for supply, in the first and third current-to-voltage conversion circuits, a diode-connected first bipolar transistor is grounded through a first emitter resistor, and the base of the first bipolar transistor is directly grounded with a second resistor connected in parallel with the first bipolar transistor, or is grounded through the first emitter resistor. In the second current-to-voltage conversion circuit, the second bipolar transistor is grounded through a second emitter resistor, the base of the second bipolar transistor is connected to the output terminal of the first current-to-voltage conversion circuit, and the collector of the second bipolar transistor is connected to the base of the third bipolar transistor and is directly grounded with a fourth resistor connected in parallel with the second bipolar transistor or is grounded through the second emitter resistor. The collector of the third bipolar transistor drives the first current mirror circuit.

Preferably, a reference voltage circuit according to the present invention, includes:

a first current-to-voltage conversion circuit with a diode-connected first bipolar transistor thereof grounded through a first emitter resistor, the base of the bipolar transistor being directly grounded with a second resistor connected in parallel therewith; and a second current-to-voltage conversion circuit with a second bipolar transistor thereof grounded through a second emitter resistor, the base of the second bipolar transistor being connected to the output terminal of the first current-to-voltage conversion circuit, the collector of the second bipolar transistor having bases of third and fourth bipolar transistors connected thereto and being directly grounded with a fourth resistor connected in parallel therewith. In this circuit, transistor sizes of the third and fourth bipolar transistors are the same as transistor sizes of the first and second bipolar transistors, respectively. Third and fourth emitter resistors are equal to the first and second emitter resistors, respectively. The third and fourth bipolar transistors are grounded through the third and fourth emitter resistors, respectively. One terminal of a seventh resistor is grounded to bias a fifth bipolar transistor. The seventh resistor is equal to each of the second and fourth resistors. The fifth bipolar transistor is grounded through a fifth emitter resistor. The fifth bipolar transistor is equal to the third or fourth bipolar transistor. The reference voltage circuit further includes:

means for causing a current flowing through the fifth bipolar transistor to be equal to a current flowing though the third or fourth bipolar transistor; and means for causing the sum of currents flowing through the third and fourth bipolar transistors and a current flowing through the seventh resistor to drive the first current-to-voltage conversion circuit, the second bipolar transistor, and the fourth resistor. A current proportionate to the sum of a current flowing through the first or second bipolar transistor and a current flowing through the second or forth resistor drives the third current-to-voltage conversion circuit.

Preferably, in the present invention, the third current-to-voltage conversion circuit is constituted from a resistor.

By connecting the diode (or the diode-connected bipolar transistor) to the resistor in series and further connecting the resistor in parallel, a reference current with temperature characteristics thereof compensated can be obtained with a low voltage of approximately 0.7 V. Further, constituting reference voltages for the OP amp by using two or three diodes (or diode-connected transistors), a smaller chip area can be implemented.

The meritorious effects of the present invention are summarized as follows.

According to the present invention, the chip area can be reduced. The reason for this is that the circuit can be implemented even if only three or four diodes are used.

According to the present invention, the reference voltage circuit can be operated at a low voltage.

The reason for this is that the output voltage can be set to an arbitrary voltage value of 1.2 V or less (specifically 1.0 V or less).

According to the present invention, an influence caused by variations can be reduced.

The reason for this is that the circuit topologies of the two current-to-voltage conversion circuits to be compared with each other can be made to be the same as the circuit topology of the output circuit.

Still other objects and advantages of the present invention will become readily apparent to those skilled in this art from the following detailed description in conjunction with the accompanying drawings wherein only the preferred embodiments of the invention are shown and described, simply by way of illustration of the best mode contemplated of carrying out this invention. As will be realized, the invention is capable of other and different embodiments, and its several details are capable of modifications in various obvious respects, all without departing from the invention. Accordingly, the drawing and description are to be regarded as illustrative in nature, and not as restrictive.

PREFERRED EMBODIMENTS OF THE INVENTION

A embodiment mode of practicing the present invention will be described in detail with reference to drawings.

Figure 1:
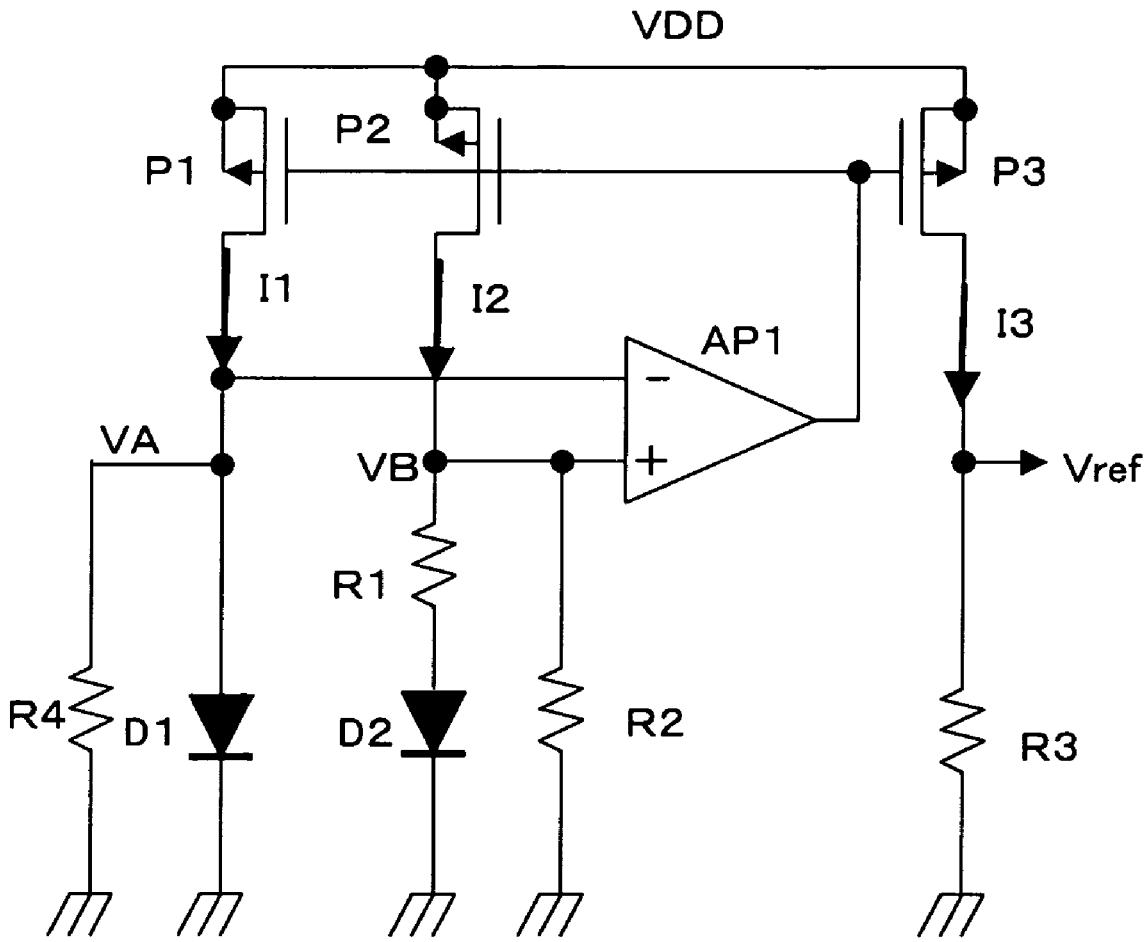
PRIOR ART FIG. 1
FIG. 1 is a diagram showing a configuration of a conventional reference current circuit.
Figure 2C:
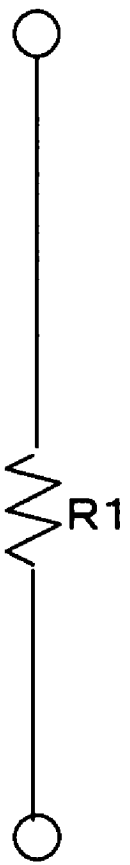
FIGS. 2A, 2B and 2C include diagrams showing configurations of current-to-voltage conversion circuits to be applied to (claims 1 through 8 of) the present invention.
Figure 2B:
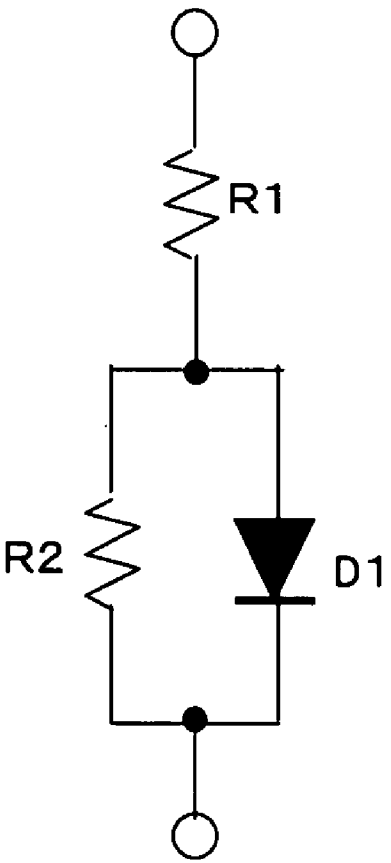
Figure 2A:
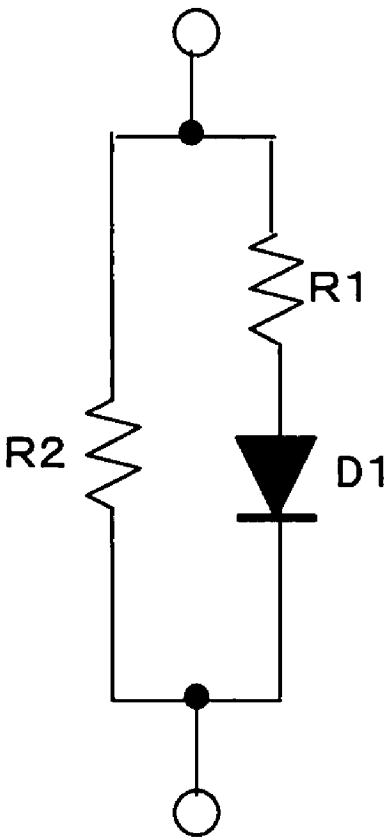

FIGS. 2A and 2B show a first current-to-voltage conversion circuit and a second current-to-voltage conversion circuit which are employed in a CMOS reference voltage circuit in the embodiment mode of the present invention, respectively. FIG. 2C shows a third current-to-voltage conversion circuit which is employed in the reference voltage circuit of the present invention. Referring to FIG. 2A, in the first current-to-voltage conversion circuit, a resistor R2 is connected in parallel with a series circuit of a resistor R1 and a diode D1. Referring to FIG. 2B, in the second current-to-voltage conversion circuit, the resistor R1 is connected in series with a parallel circuit of the diode D1 and the resistor R2. Referring to FIG. 2C, the third current-to-voltage conversion circuit is constituted from the resistor R1 alone.

Figure 3:
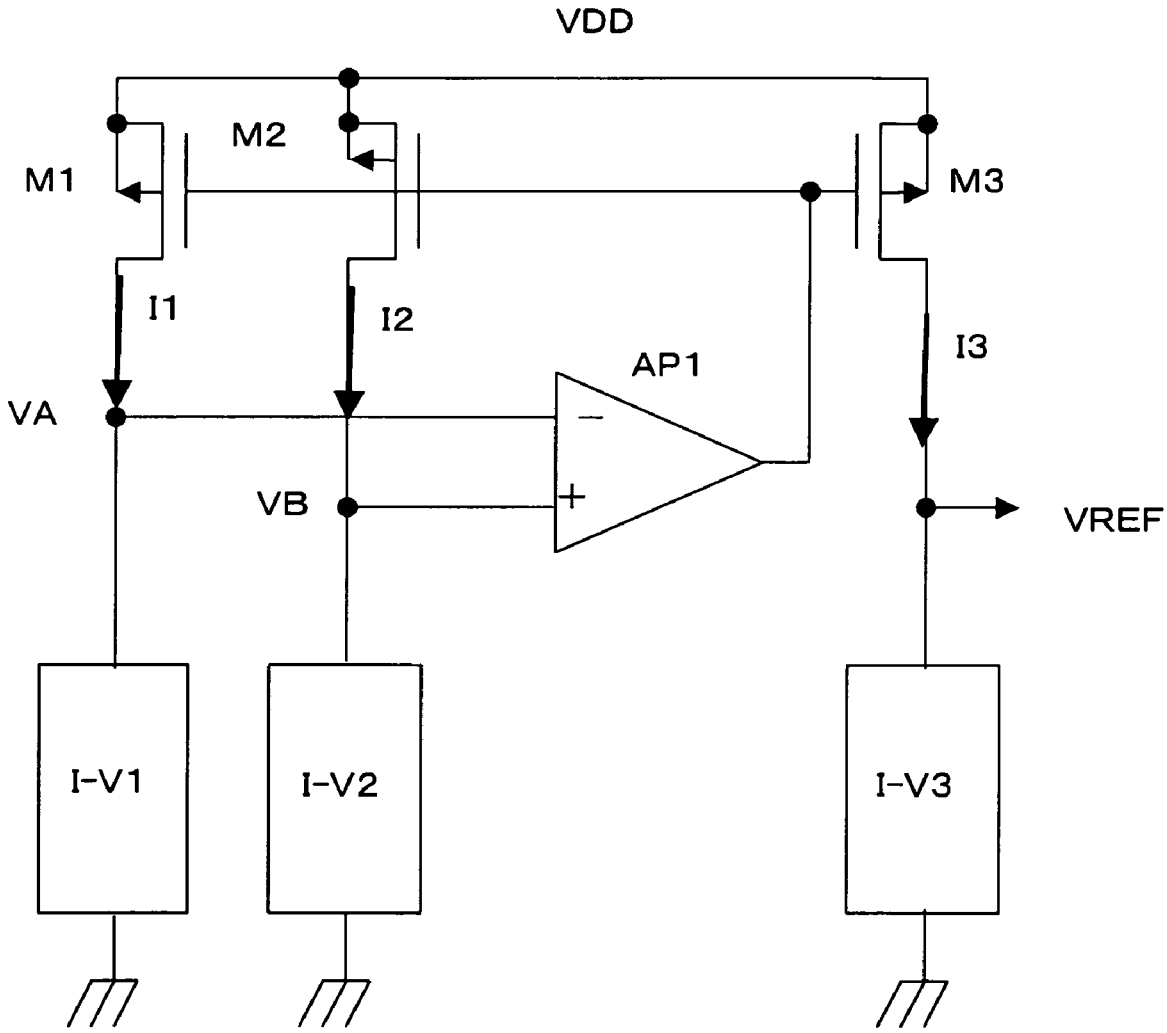
FIG. 3 is a diagram showing a circuit configuration of an embodiment of (claim 1, 2, or 4 of) the present invention.

FIG. 3 is a diagram showing a circuit configuration of a CMOS reference voltage circuit set forth in the present invention (in claim 1). A description will be directed to a case where the circuit shown in FIG. 2A is applied to both of the first current-to-voltage conversion circuit and the second current-to-voltage conversion circuit. However, when the first current-to-voltage conversion circuit is set to have completely the same circuit configuration as that of the second current-to-voltage conversion circuit, operating points will become indefinite, so that the operating point of the circuit is not determined. Accordingly, the number of diodes is set to be different between the first current-to-voltage conversion circuit and the second current-to-voltage conversion circuit. Specifically, it is conceived that one diode is used in the first current-to-voltage conversion circuit, while two or three diodes are connected in parallel in the second current-to-voltage conversion circuit.

Embodiment 1

Figure 4:
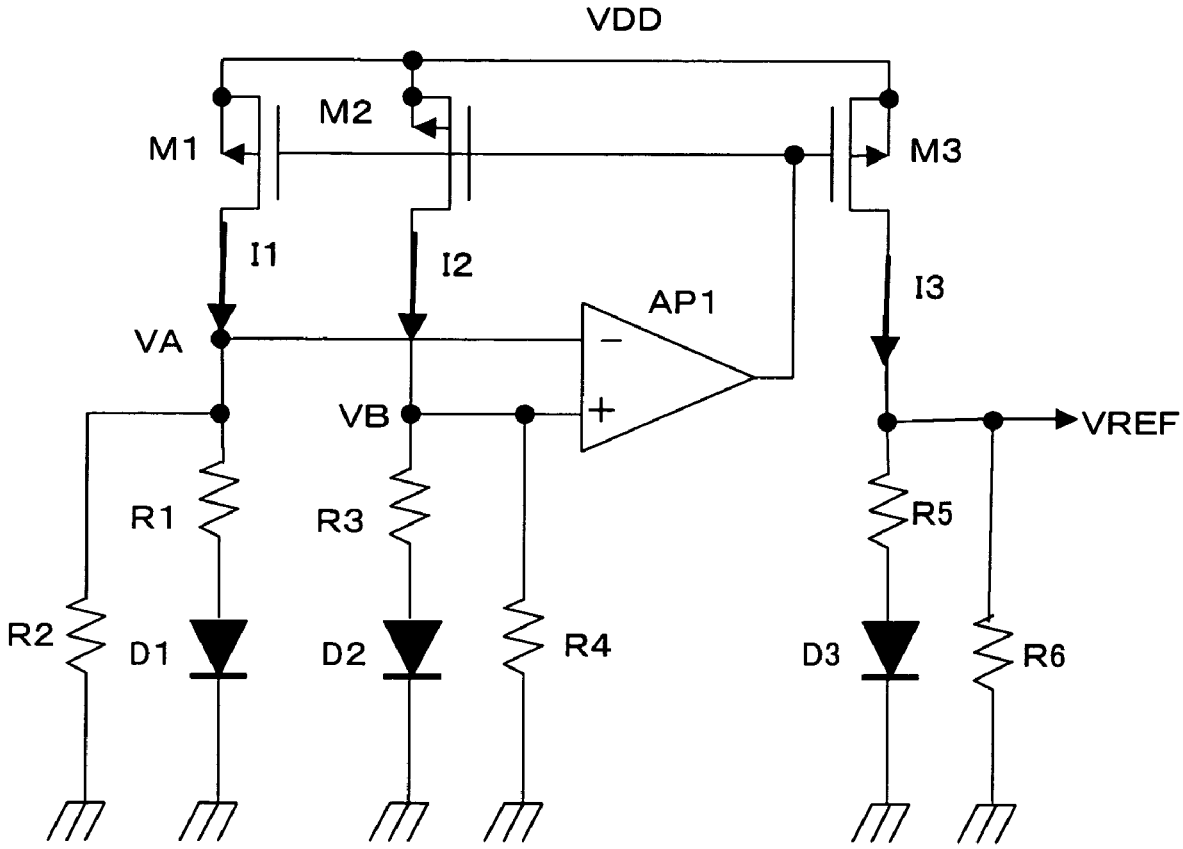
FIG. 4 is a diagram showing a circuit configuration of a first embodiment of (claim 1, 2, or 4 of) the present invention.

Referring to FIG. 4, MOS transistors M1 and M2 (and M3) constitute a current mirror circuit, and their common gate voltage is controlled so that two input terminal voltages at an inverting input terminal (−) of an OP amp (AP1) and at a non-inverting input terminal (+) of the OP amp (AP1) become equal by the OP amp (AP1). A current that will flow through the current mirror circuit is thereby determined.

The current-to-voltage conversion circuit (I-V conversion circuit) shown in FIG. 2A is used for a first current-to-voltage conversion circuit (I-V1) and a second current-to-voltage conversion circuit (I-V2) to be compared with each other, and a third current-to-voltage conversion circuit (I-V3) that constitutes an output circuit, thereby making the circuit topologies of the first and second current-to-voltage conversion circuits and the third current-to-voltage circuit to be the same. In the first current-to-voltage conversion circuit (I-V1) and the second current-to-voltage conversion circuit (I-V2) to be compared with each other in this case, the number of diodes (or diode-connected bipolar transistors) connected in parallel is set to N.

By using the same circuit topology for the first to third current-to-voltage conversion circuits (I-V conversion circuits), operations of the circuits will become the same. Thus, even if the variations in fabrication process occur, the variations can be expected to change in the same manner, and that the variations in voltage characteristic of an output voltage are expected to be reduced more greatly than fabrication variations.

An operation in the present embodiment will be described. Referring to FIG. 4, when a forward voltage of a diode (or diode-connected bipolar transistor) D1 is represented by VF1 and a forward voltage of a diode (or diode-connected bipolar transistor) D2 is represented by VF2, the OP amp (AP1) performs control so that the two input terminal voltages thereof become equal (VA=VB) to each other.

When the resistor value of a resistor R2 connected in parallel with the first current-to-voltage conversion circuit (I-V1) is set to be equal to the resistor value of a resistor R4 connected in parallel with the second current-to-voltage conversion circuit (I-V2), $$\mathrm{IAP}=\mathrm{IBP} \tag{14}$$

where $$IAP=VA/R2 \tag{15}$$

$$IBP=VB/R4. \tag{16}$$

When currents for the MOS transistors M1 and M2 are set to be the same, the following equation is derived:

$$\mathrm{I1}=\mathrm{I2} \tag{17}$$

where $$I1=IAP+IAS \tag{18}$$

$$I2=IBP+IBS. \tag{19}$$

Accordingly, the following equation holds:

$$\mathrm{IAS}=\mathrm{IBS}\ (20)$$

Then, the following expressions are obtained:

$$VA=R1IAS+V_T\ln(IAS/IS) \tag{21}$$

$$VB=R3IBS+V_T\ln\{IAS/(NIS)\} \tag{22}$$

where IS is the saturation current for a graded-base transistor or a diode, and VA=VB and IAS=IBS. Thus, using Expressions (21) and (22), the following equations are derived $$IAS=IBS=\{VT\ln(N)\}/(R3-R1)=\Delta VF/(R3-R1) \tag{23}$$

Accordingly, the following equations are obtained:

$$VA=VF1+R1\Delta VF/(R3-R1) \tag{24}$$

$$VB=VF2+R3\Delta VF/(R3-R1) \tag{25}$$

That is, $$I1=VA/R2+IAS=(1/R2)[VF1+\{(R1+R2)/(R3-R1)\}\Delta VF] \tag{26}$$

$$I2=VB/R4+IBS=(1/R2)[VF2+\{(R3+R2)/(R3-R1)\}\Delta VF] \tag{27}$$

When the current for the MOS transistor M2 is equal to a current for the MOS transistor M3 (I2=I3), the following expression is obtained in the output circuit:

$$I3=(VREF-VF3)/R5+VREF/R6 \tag{28}$$

Accordingly, the following expression is obtained:

$$VREF=\{R6/(R5+R6)\}\{(VF3+R5\times I3\} \tag{29}$$

in which the term of {R6/(R5+R6)} for {VF3+R5×I3} indicates a resistor division ratio between resistors R5 and R6, and indicates that a voltage {VF3+R5×I3} is voltage-divided to a lower voltage by a voltage ratio between the resistors R5 and R6. In other words, the reference voltage circuit may be the circuit with a low output voltage.

Further, a voltage VF3 has a temperature coefficient of approximately −1.9 mV/° C. Accordingly, in order to make the voltage {VF3+R5×I3} to have zero temperature coefficient, it is necessary that a voltage R5×I3 has a positive temperature characteristic. That is, when the temperature characteristic of a resistor R5 is neglected, a current I3 needs to have a positive temperature characteristic.

Now, I1=I2=I3 hold. In Equation (26), for example, the voltage VF1 has a temperature coefficient of approximately −1.9 mV/° C., and a voltage ΔVF (=VTln(N)) has a positive temperature characteristic. Thus, by setting a resistor ratio {(R1+R2)/(R3−R1)} to a large value, the current I1(=I3) can be made to have an arbitrary positive temperature characteristic.

Alternatively, in Equation (27) likewise, the voltage VF2 has a temperature coefficient of approximately −1.9 mV/° C., and the voltage ΔVF (=VTln(N)) has the positive temperature characteristic. Thus, by setting a resistor ratio {(R3+R2)/(R3−R1)} to a large value, the current I2(=I3) can be made to have an arbitrary positive temperature characteristic.

The resistor division ratio {R6/(R5+R6)} has zero temperature coefficient. Accordingly, by making the voltage R5×I3 to have the positive temperature characteristic, the temperature characteristics of an output voltage VREF can be compensated.

That is, by substituting Equation (26) or (27) into Equation (29), the output voltage VREF becomes as follows:

$$VREF=\{R6/(R5+R6)\}(R5/R2)[VF1+(R2/R5)VF3+\{(R1+R2)/(R3-R1)\}]\Delta VF]=\{R6/(R5+R6)\}(R5/R2)[VF2+(R2/R5)VF3+\{(R3+R2)/(R3-R1)\}]\Delta VF] \quad (30)$$

in which the each voltage of VF1, VF2, and VF3 has a temperature coefficient of approximately −1.9 mV/C Further, as is well known, the voltage ΔVF has the positive temperature characteristic that is proportionate to a thermal voltage $V_T$ (with the temperature characteristic thereof being 0.0853 mV/° C.) in this circuit as well.

That is, the temperature characteristic of the term of [VF1+(R2/R5)VF3+{(R1+R2)/(R3−R1)}ΔVF] in Equation (30) can be compensated by setting the resistor ratio {(R1+R2)/(R3−R1)} and performing weighted addition of a voltage [VF1+(R2/R5)VF3] having a negative temperature characteristic and the voltage ΔVF which has the positive temperature characteristic and is weighted with {(R1+R2)/(R3−R1)}.

Alternatively, the temperature characteristics of the term [VF2+(R2/R5)VF3+{(R3+R2)/R3−R1}ΔVF] in Equation (30) can be compensated by setting the resistor ratio {(R3+R2)/(R3−R1)} and performing weighted addition of a voltage [VF2+(R2/R5)VF3] having a negative temperature characteristic and the voltage ΔVF which has the positive temperature characteristic and is weighted with {(R3+R2)/R3−R1}.

Assume that the voltage VF1 becomes approximately 710 mV at ambient temperature, for example. Then, the voltage VF3 becomes 710 mV at the ambient temperature. Assume that the voltage {VF1+(R2/R5)VF3} becomes approximately 1430 mV at the ambient temperature. Then, a voltage {(R1+R2)/(R3−R1)}ΔVF becomes approximately 1340 mV at the ambient temperature. The voltage [VF1+(R2/R5)VF3+{(R1+R2)/(R3−R1)}ΔVF] becomes approximately 2770 mV at the ambient temperature.

In this case, the resistor division ratio {R6/(R5+R6)} is set to 0.35, a ratio (R5/R2) is set to 0.93, and the resistor ratio {(R1+R2)/(R3−R1)} is approximately 74.4 when N is set to 2.

The voltage VREF that will be obtained is approximately 900 mV.

Alternatively, assume that the voltage VF2 becomes approximately 690 mV at the ambient temperature. Then, the voltage VF3 becomes 710 mV at the ambient temperature. Assume that the voltage {VF2+(R2/R5)VF3} becomes approximately 1410 mV at the ambient temperature. Then, a voltage {(R3+R2)/(R3−R1)}ΔVF becomes approximately 1360 mV at the ambient temperature. The voltage [VF2+(R2/R5)VF3+{(R3+R2)/(R3−R1)}ΔVF] becomes approximately 2770 mV at the ambient temperature.

In this case, the resistor division ratio {R6/(R5+R6)} is set to 0.35, the ratio (R5/R2) is set to 0.93, and the resistor ratio {(R3+R2)/(R3−R1)} is approximately 75.4 when N is set to 2. The voltage VREF that will be obtained is approximately 900 mV.

It can be seen that the voltage [VF1+(R2/R5)VF3+{(R1+R2)/(R3−R1)}ΔVF] (or the voltage [VF2+(R2/R5)VF3+{(R3+R2)/R3−R1)}ΔVF]) becomes substantially 2.77 V, which is twice as large as the voltage described in a prior art.

Since the resistor ratios {R6/(R5+R6)} and (R5/R2) have zero temperature coefficients (zero temperature coefficient), the output reference voltage VREF also becomes the voltage in which the temperature characteristics thereof have been compensated.

A resistor ratio {R6/(R5+R6)}(R5/R2) can be arbitrarily set in this case, and when the resistor ratio {R6/(R5+R6)}(R5/R2) is set to be larger than ½, the voltage VREF will become the voltage higher than 1.2 V.

On the other hand, if the resistor ratio {R6/(R5+R6)}(R5/R2) is set to be smaller than ½, the voltage VREF will become the voltage lower than 1.2 V.

Especially when the resistor ratio {R6/(R5+R6)}(R5/R2) is set to be smaller than 2 that makes the voltage VREF to be lower than 1.2 V, a supply voltage can be reduced. When the voltage VREF is set to 0.9 V, for example, as described above, the reference voltage circuit can be operated at the supply voltage of approximately 1.1 V or higher.

Meanwhile, the voltages {VF1+(R2/R5)VF3}, {(R1+R2)/(R3−R1)}ΔVF, and [VF1+(R2/R5)VF3+{(R1+R2)/(R3−R1)}ΔVF] are the values exceeding 1.2 V as the values (voltage values). These voltage values, however, are not generated within the circuit. The voltage VREF shown in the Equation (30) is only generated at an output terminal.

When this voltage VREF is set to 1.0 V or lower, all of the voltages VA, VB, and VREF within the circuit become 1.1 V or less, in view of temperature variations of 27° C.±73° C.

Embodiment 2

Figure 5:
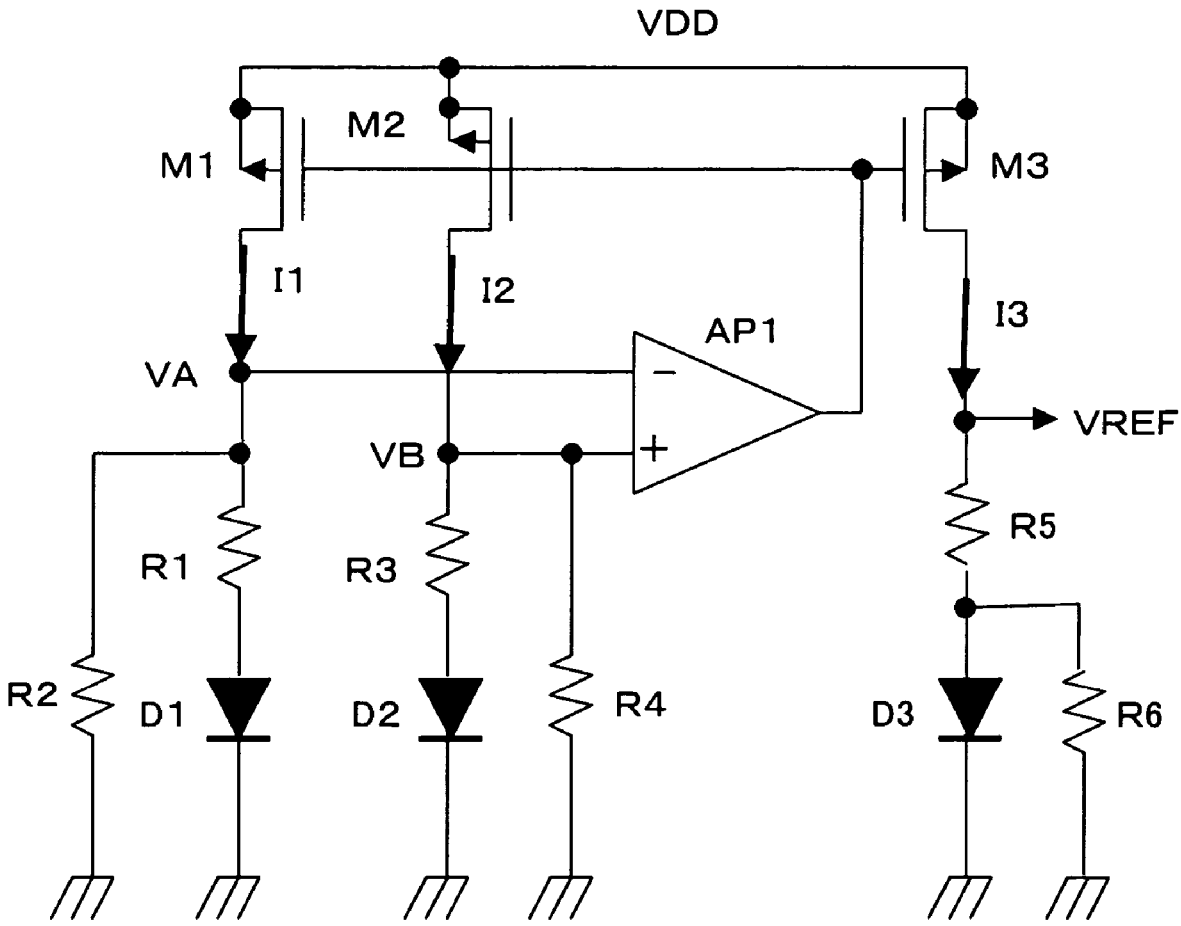
FIG. 5 is a diagram showing a circuit configuration of a second embodiment of (claim 1, 2, or 4 of) the present invention.

The third current-to-voltage conversion circuit (I-V3) in the output circuit in FIG. 3 may be changed to the circuit in FIG. 2(*b*), as in FIG. 5. Referring to FIG. 5, MOS transistors M1 and M2 (and M3) constitute the current mirror circuit, and their common gate voltage is controlled so that two input terminal voltages at the OP amp (AP1) become equal by the OP amp (AP1). A current that will flow through the current mirror circuit is thereby determined.

Then, the current-to-voltage conversion circuit (I-V conversion circuit) shown in FIG. 2A is used for the first current-to-voltage conversion circuit (I-V1) and the second current-to-voltage conversion circuit (I-V2) to be compared with each other, thereby making the circuit topology of the first current-to-voltage conversion circuit to be the same as the circuit topology of the second current-to-voltage conversion circuit. In the first current-to-voltage conversion circuit (I-V1) and the second current-to-voltage conversion circuit (I-V2) to be compared with each other in this case, the number of diodes (or diode-connected bipolar transistors) connected in parallel is set to N.

Further, the current-to-voltage conversion circuit (I-V conversion circuit) shown in FIG. 2C is used for the third current-to-voltage conversion circuit (I-V3) of the output circuit. Simplification of the output circuit can be thereby achieved.

The current-to-voltage conversion circuit in FIG. 2B is substantially similar to the current-to-voltage conversion circuit in FIG. 2A.

That is, referring to FIG. 5, the following equation holds:

$$I3=(VREF-VF3)/R5 \tag{31}$$

From Equation (31), the following equation is obtained:

$$VREF=VF3+R5\times I3 \tag{32}$$

When Equation (32) is compared with Equation (29), it can be seen that there is no term of the resistor division ratio of {R6/(R5+R6)} in Equation (32). However, a resistor R6 is connected in parallel with a diode D3. The resistor R6 is less presented in Equation (32).

When a current that flows through the diode D3 is represented by IF3, the following expression is obtained.

$$I3=IF3+VF3/R6 \tag{33}$$

where, $$VF3=V_T In\{IF3/IS\} \tag{34}$$

$$IF3=IS\exp(VF3/V_T). \tag{35}$$

When Equation (33) is substituted into Equation (32), the following expression is obtained:

$$VREF=(1-R5/R6)VF3+R5\times IF3 \tag{36}$$

That is, the expression shows that the voltage VREF is obtained by compressing the forward voltage VF3 of the diode by a factor of (1−R5/R6) (being smaller than 1) under a condition that the value of a resistor R5 is smaller than the value of the resistor R6 and adding to the compressed voltage (1−R5/R6)VF3 the product of the current IF3 that flows through the diode and the resistor R5.

In this case, the voltage VF3 has a temperature characteristic in the vicinity of approximately −1.9 mV° C., and is compressed by the factor of (1−R5/R6) (being smaller than 1). Accordingly, in order to compensate the temperature characteristic of the reference voltage VREF to be output, a small negative temperature characteristic obtained by compressing the negative temperature characteristic in the vicinity of approximately −1.9 mV ° C. by the factor of (1−R5/R6) (being smaller than 1) should be added to a corresponding small positive temperature characteristic. This is the same as in the foregoing description.

That is, by making the current I3 to have a positive temperature characteristic, the temperature characteristic of the current IF3 that flows through the diode also maintains a positive value. Then, by generating a voltage R5×IF3 having the positive temperature characteristic corresponding to the negative temperature characteristic of a voltage (1−R5/R6) VF3, the reference voltage VREF having zero temperature coefficient can be obtained.

It can be seen that even in the current-to-voltage conversion circuit shown in FIG. 2B, the output voltage VREF is able to be set to a voltage value lower than 1.2V, as in the above-mentioned description. In other words, even in the configuration diagram of the current-to-voltage conversion circuit shown in FIG. 2B, the characteristic similar to that of the current-to-voltage conversion circuit shown in FIG. 2A is able to be realized.

Embodiment 3

Figure 6:
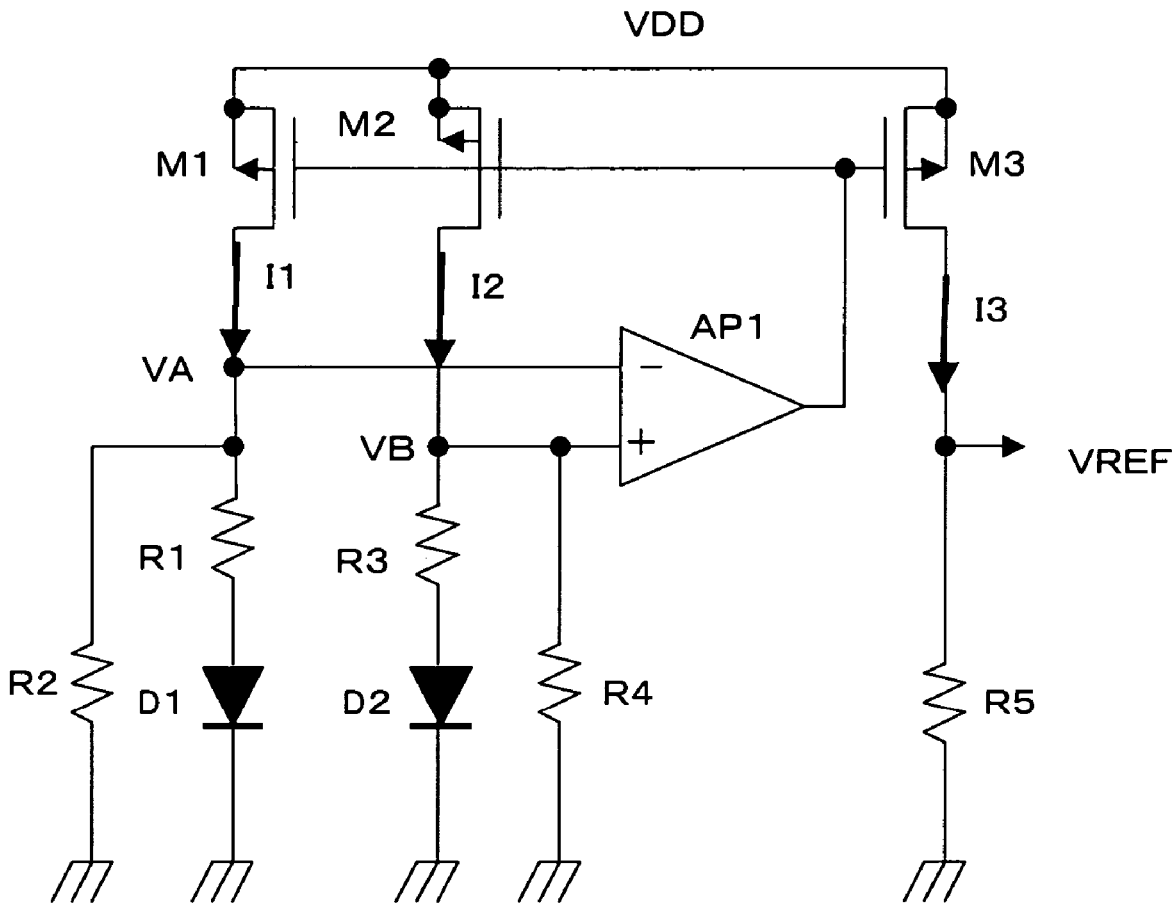
FIG. 6 is a diagram showing a circuit configuration of a third embodiment of (claim 1, 2, or 4 of) the present invention.

Referring to FIG. 6, MOS transistors M1 and M2 (and M3) constitute a current mirror circuit, and currents that flow through the current mirror circuit are controlled through their common gate voltage so that two input terminal voltages at the two inverting input terminals of the OP amp (AP1) become equal by the OP amp (AP1). The number of diodes (or diode-connected bipolar transistors) connected in parallel is set to N.

Referring to FIG. 6, when the forward voltage of a diode (or diode-connected bipolar transistor) D1 is set to VF1 and the forward voltage of a diode (or diode-connected bipolar transistor) D2 is set to VF2, the OP amp (AP1) performs control so that the two input terminal voltages thereof become equal (VA=VB) to each other.

When the resistor value of a resistor R2 connected in parallel with the first current-to-voltage conversion circuit (I-V1) is set to be equal to the resistor value of a resistor R4 connected in parallel with the second current-to-voltage conversion circuit (I-V2), the following equation holds:

$$IAP=IBP \tag{37}$$

where $$IAP=VA/R2 \tag{38-1}$$

$$IBP=VB/R4. \tag{38-2}$$

When currents for the MOS transistors M1 and M2 are set to be the same, the following equation holds:

$$I1=I2 \tag{39}$$

In this case, $$I1=IAP+IAS \tag{40}$$

$$I2=IBP+IBS. \tag{41}$$

Accordingly, the following equation holds:

$$IAS=IBS \tag{42}$$

Then, the following expressions can be obtained:

$$VA=R1IAS+V_T\ln(IAS/IS) \tag{43}$$

$$VB=R3IBS+V_T In\{IAS/(NIS)\} \tag{44}$$

in which IS indicates the saturation current, and VA=VB and IAS=IBS. Thus, using Expressions (43) and (44), the following equations are obtained:

$$IAS=IBS=\{VT\ln(N)\}/(R3-R1)=\Delta VF/(R3-R1) \tag{45}$$

Accordingly, the following equations hold:

$$VA=VF1+R1\Delta VF/(R3-R1) \tag{46}$$

$$VB=VF2+R3\Delta VF/(R3-R1) \tag{47}$$

That is, $$I1=VA/R2+IAS=(1/R2)[VF1+\{(R1+R2)/(R3-R1)\}\Delta VF] \tag{48}$$

$$I2=VB/R4+IBS=(1/R2)[VF2+\{(R3+R2)/(R3-R1)\}\Delta VF] \tag{49}$$

When the current for the MOS transistor M2 is equal to the current for the MOS transistor M3 (I2=I3), the following expressions are obtained:

$$VREF = R5I3 \tag{50}$$
$$= (R5/R2)[VF1 + \{(R1 + R2)/(R3 - R1)\}\Delta VF]$$
$$= (R5/R2)[VF2 + \{(R3 + R2)/(R3 - R1)\}\Delta VF]$$

In this case, the forward voltage VF1 has a temperature coefficient of approximately −1.9 mV/° C. The forward voltage VF2 also has a temperature coefficient of approximately −1.9 mV/° C. Further, as is well known, the voltage ΔVF has a positive temperature characteristic that is proportionate to the thermal voltage $V_T$ (with the temperature characteristic thereof being 0.0853 mV/° C.) in this circuit as well.

That is, the temperature characteristic of the term [VF1+{(R1+R2)/(R3−R1)}ΔVF] in Equation (50) can be compensated by setting the resistor ratio {(R1+R2)/(R3−R1)} and performing weighted addition of the voltage VF1 having the negative temperature characteristic and the voltage ΔVF which has the positive temperature characteristic and is weighted with {(R1+R2)/(R3−R1)}.

Alternatively, the temperature characteristics of the term [VF2+{(R3+R2)/(R3−R1)}ΔVF] in Equation (49) can be compensated by setting the resistor ratio {(R3+R2)/(R3−R1)} and performing weighted addition of the voltage VF2 having the negative temperature characteristic and the voltage ΔVF which has the positive temperature characteristic and is weighted with {(R3+R2)/(R3−R1)}.

Assume that the voltage VF1 becomes approximately 620 mV at ambient temperature in this case. Then, the voltage {(R1+R2)/(R3−R1)} ΔVF becomes approximately 580 mV at the ambient temperature. Alternatively, assume that the voltage VF2 becomes approximately 580 mV at the ambient temperature. Then, the voltage {(R3+R2)/(R3−R1)} ΔVF becomes approximately 620 mV at the ambient temperature. Then, it can be seen that the voltage [VF1+(R1+R2)/(R3−R1)}ΔVF] (or [VF2+{(R3+R2)/(R3−R1)}ΔVF]) becomes substantially 1.2 V, as in the description about the prior art.

Since the resistor ratio (R5/R2) has zero temperature coefficient, the reference voltage VREF to be output becomes the voltage in which the temperature characteristics thereof have been compensated. In this case, the resistor ratio (R5/R2) can be arbitrarily set. Then, when the resistor ratio (R5/R2) is set to be larger than 1, the voltage VREF will become the voltage higher than 1.2 V. When the resistor ratio (R5/R2) is set to be smaller than 1, the voltage VREF will become the voltage lower than 1.2 V, as in the case of the prior art.

Especially when the resistor ratio (R5/R2) is set to be smaller than 1 that makes the voltage VREF to be lower than 1.2 V, the supply voltage can be reduced. When the voltage VREF is set to 1.0 V, for example, the reference voltage circuit can be operated at the supply voltage of approximately 1.2 V or higher.

[Example of Simulation Values]

If R1=5.24 KΩ, R3=8 KΩ, R2=R4=100 kΩ (N=2), and R5=50 kΩ, as an example of a SPICE simulation, as the voltage VREF, 668.7 mV at −46° C., 671.1 mV at 27° C., and 668.8 mV at 100° C. are obtained. The temperature characteristic of the voltage VREF became −0.358% by a change of 146° C., and became the maximum voltage at the ambient temperature. The temperature characteristic of an upside-down bowl shape in which the voltage VREF is minutely reduced at low and high temperatures was obtained. Since the temperature characteristic is small, it is insignificant as a matter of practicality.

[Example of Another Simulation Values]

Alternatively, if R1=3.66 KΩ, R3=8 KΩ, R2=R4=100 kΩ, N=3, and R5=50 kΩ, as an example of other SPICE simulation, as the voltage VREF, 668.2 mV at −46° C., 670.4 mV at 27° C., and 668.0 mV at 100° are obtained. The temperature characteristic of the voltage VREF became −0.358% by a change of 146° C., and became the maximum voltage at the ambient temperature. The temperature characteristic of the upside-down bowl shape in which the voltage VREF is minutely reduced at low and high temperatures was obtained. Since the temperature characteristic is small, it is insignificant as a matter of practicality.

[Supplemental Remarks to Simulation Values]

The current ratio of the current mirror circuit constituted from the MOS transistors M1 and M2 needs not to be 1:1, and can also be changed from 1:1. It can be changed so as to correct non-linearity of the temperature characteristic of a forward voltage VF of the diode (or diode-connected bipolar transistor) or specifically, as is well known, to correct a phenomenon in which the temperature characteristic is affected by a reduction in the temperature, thereby implementing the characteristic of the somewhat upside-down bowl shape. In the temperature characteristic of the upside-down bowl shape, the temperature characteristic peaks at the ambient temperature, and is reduced to a certain degree at lower and higher temperatures.

Alternatively, in order to make the current densities of the diodes (or diode-connected bipolar transistors) D1 and D2 to be greatly different, the transistor size of the MOS transistor M1 is set to a larger value than the transistor size of the MOS transistor M2.

An approach in which N unit diodes D2 (or diode-connected bipolar unit transistors) are connected in parallel to make the current densities of the diodes D1 and D2 to be greatly different is of course effective, as described above. However, the value of this N does not need to be a large value such as 10 to 100 used in the prior art, and may be a small natural number such as two or three.

<Other Embodiment Mode of the Present Invention>

In the circuit shown in FIG. 4 as well, in order to reduce the supply voltage for the OP amp (AP1) as much as possible, resistors R2 and R4 connected in parallel can be equally divided into resistors R2A and R2B and resistors R4A and R4B, respectively. Then, the divided voltage of each of the resistors can be used for a differential input signal voltage for the OP amp (AP1). The voltages VA and VB are controlled to be equal. Since they are the voltages that flow through diodes, they will become approximately 1.1 V to 0.5 V when a temperature change from ambient temperature to approximately ±50° C. is assumed.

Accordingly, the OP amp (AP1) becomes an input differential pair made up of p-channel transistors, and can be operated at an input signal voltage of 0 V or higher. For this reason, the lower the input signal voltage is, the supply voltage for the OP amp (AP1) is more reduced. In other words, by dividing the resistors R2 and R4, the input signal voltage can be reduced. As a result, the supply voltage can also be reduced.

Embodiment 4

Figure 7:
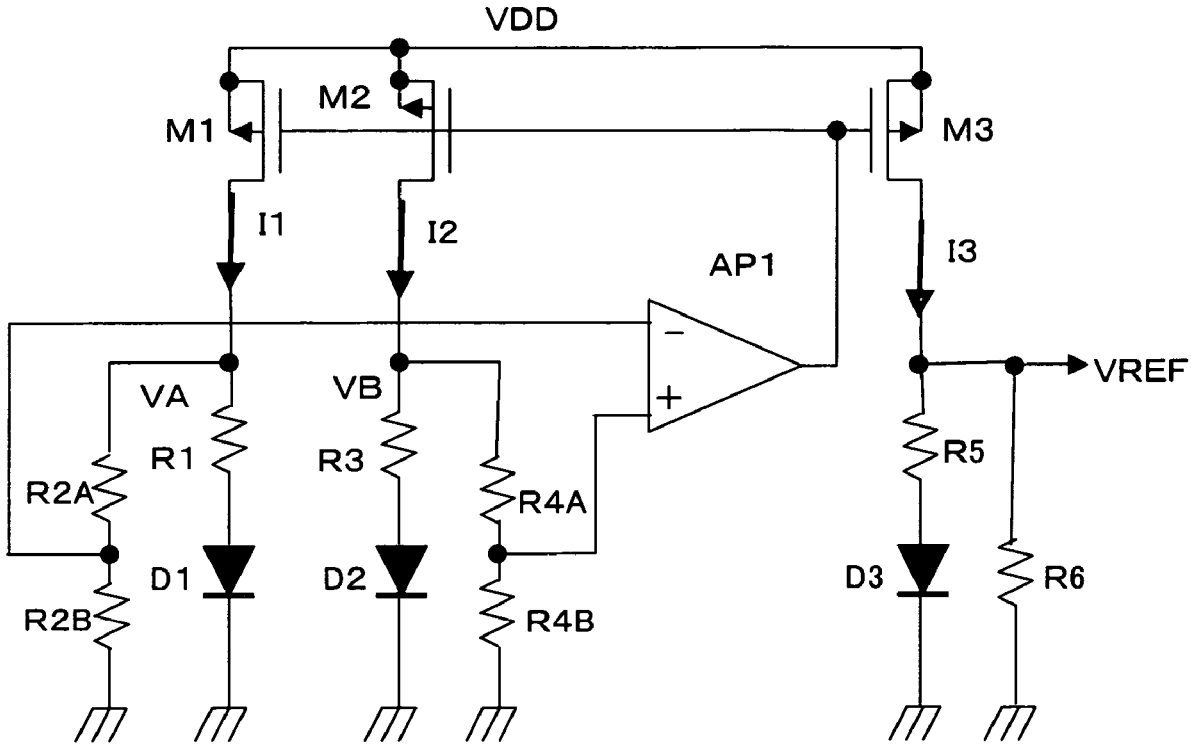
FIG. 7 is a diagram showing a circuit configuration of a first embodiment of (claim 5 of) the present invention.

Referring to FIG. 7, MOS transistors M1 and M2 (and M3) constitute the current mirror circuit, and their common gate voltage is controlled so that two input terminal voltages at the OP amp (AP1) become equal by the OP amp (AP1). A current that will flow through the current mirror circuit is thereby determined.

The current-to-voltage conversion circuit (I-V conversion circuit) shown in FIG. 2A is used for the first current-to-voltage conversion circuit (I-V1) and the second current-to-voltage conversion circuit (I-V2) to be compared with each other, and third current-to-voltage conversion circuit (I-V3) that constitutes the output circuit, thereby making the circuit topologies of the first to third current-to-voltage conversion circuits to be the same. In the first current-to-voltage conversion circuit (I-V1) and the second current-to-voltage conversion circuit (I-V2) to be compared with each other, however, the number of diodes (or diode-connected bipolar transistors) connected in parallel is set to N.

Further, in the first current-to-voltage conversion circuit (I-V1) and the second current-to-voltage conversion circuit (I-V2) to be compared with each other, the resistors R2 and R4 connected in parallel are equally divided into the resistors R2A and R2B and R4A and R4B, respectively. Then, the divided voltage of each of the resistors is used for the differential input signal voltage for the OP amp (AP1).

By using the same circuit topology for the first to third current-to-voltage conversion circuits (I-V conversion circuits), operations of the circuits will become the same. Thus, even if variations in fabrication process occur, the variations can be expected to change in the same manner, and hence the voltage characteristic of an output voltage is expected to be reduced more greatly than fabrication variations.

An operation of the present embodiment will be described. Referring to FIG. 4, when the OP amp is constituted from a differential pair with the p-channel transistors thereof used as an input pair, the circuit can be operated at the input voltage of approximately 0 V or higher. Accordingly, when the supply voltage is reduced to cause the reference voltage circuit to be operated at a lower voltage, the input voltage should be as low as possible so as to allow further reduction of the operating voltage of the OP amp.

FIG. 7 shows a case where the resistors R2 and R4 are equally divided into the resistors R2A and R2B and R4A and R4B, respectively, in FIG. 4.

Assume that the following equation is set:

$$R2A:R2B=R4A:R4B \tag{51}$$

Then, voltages that are proportionate to the voltages VA and VB are obtained from the midpoints of the resistors that have been voltage divided.

That is, the following equation holds:

$$VAR2B/(R2A+R2B)=VBR4B/(R4A+R4B) \tag{52}$$

That is, control is performed so that the voltage VA becomes equal to the voltage VB. Accordingly, the reference voltage circuit can be implemented, as in FIG. 4.

[Example of Simulation Values]

If R1=5.24 KΩ, R3=8 KΩ, R2=R4=170 kΩ, R2B=R4B=30 kΩ, R5=185.9 kΩ, R6=100 kΩ, D1:D2:D3=1:2:1 and N=2, as an example of the SPICE simulation, as the voltage VREF, 898.2 mV at −46° C., 903.1 mV at 27° C., and 898.2 mV at 100° C. are obtained. The temperature characteristic of the voltage VREF became −0.543% by a change of 146° C., and became the maximum voltage at the ambient temperature. The temperature characteristic of a minute upside-down bowl shape in which the voltage VREF is minutely reduced at low and high temperatures was obtained. Since the temperature characteristic is small, it is insignificant as a matter of practicality.

Embodiment 5

Figure 8:
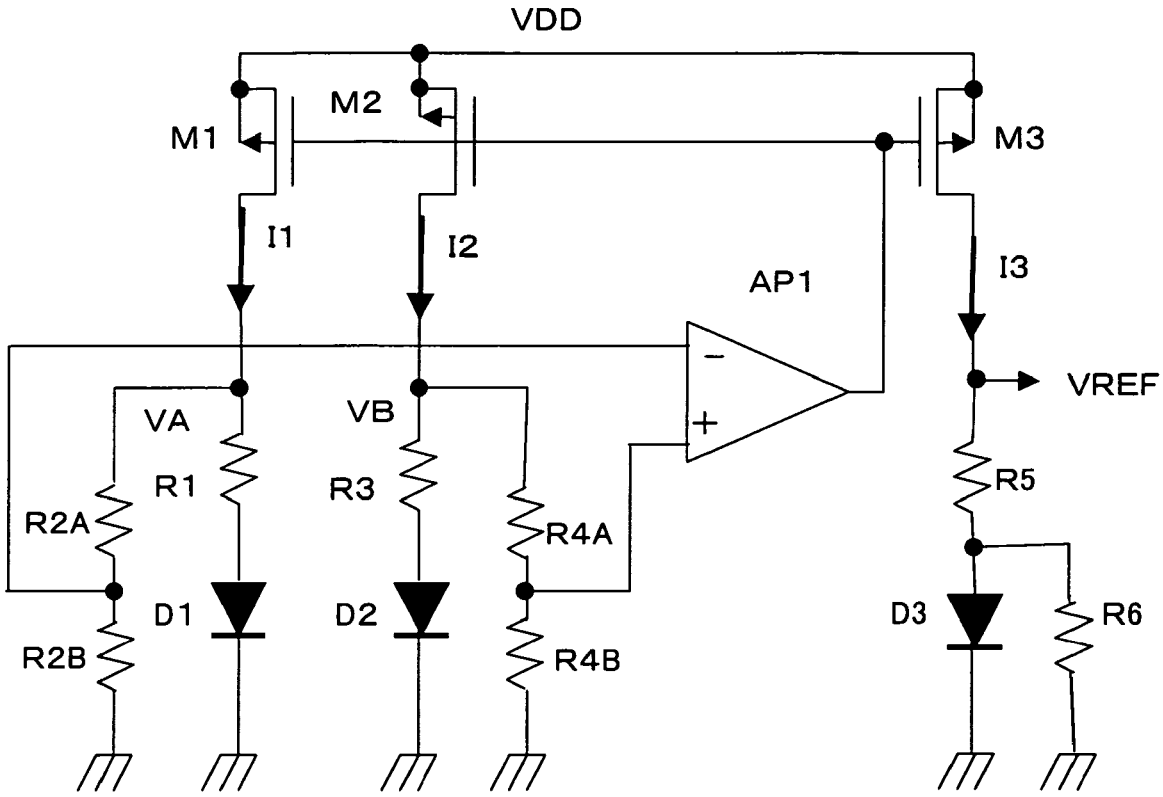
FIG. 8 is a diagram showing a circuit configuration of a second embodiment of (claim 5 of) the present invention.

Likewise, even in the circuit shown in FIG. 5 as well, resistors R2 and R4 were divided into resistors R2A and R2B and resistors R4A and R4B, respectively, as shown in FIG. 8.

This can reduce the input voltage of the OP amp. By reducing the operating voltage of the OP amp, the reference voltage circuit can be operated at a lower voltage.

Embodiment 6

Figure 9:
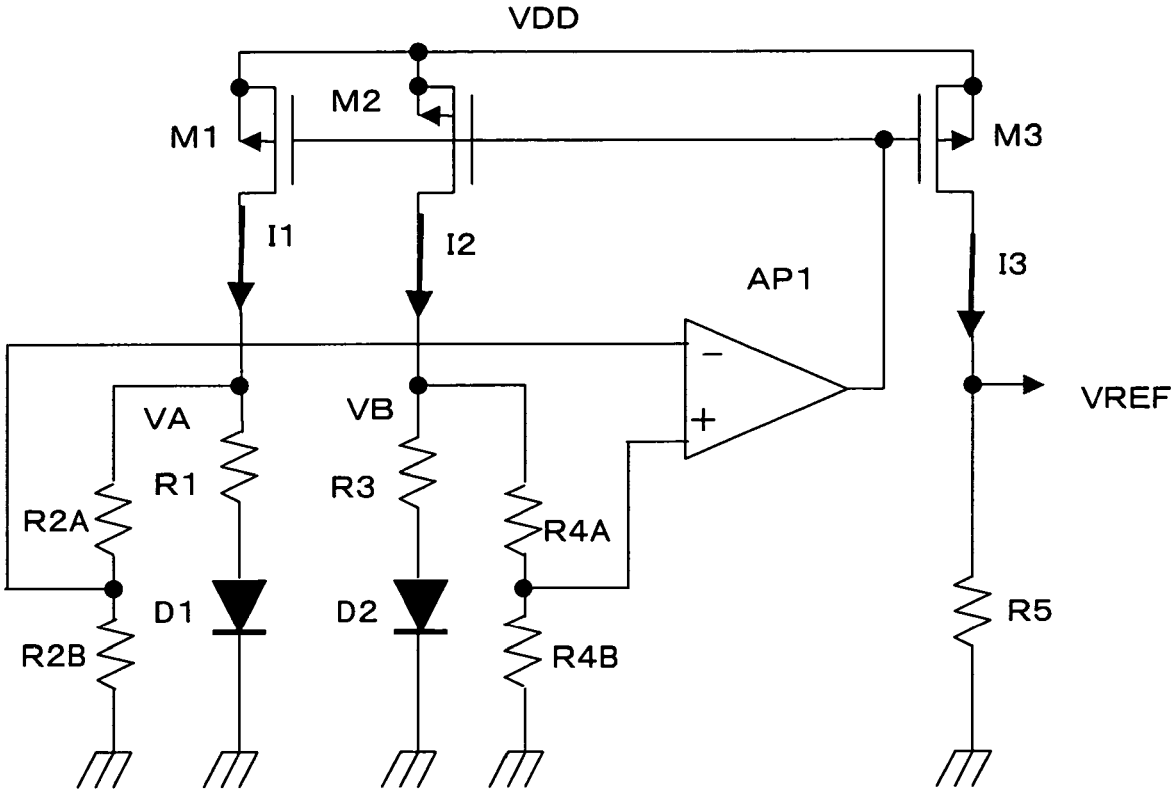
FIG. 9 is a diagram showing a circuit configuration of a third embodiment of (claim 5 of) the present invention.

Likewise, even in the circuit shown in FIG. 6 as well, resistors R2 and R4 were divided into resistors R2A and R2B and resistors R4A and R4B, respectively, as shown in FIG. 9.

This can reduce the input voltage of the OP amp. By reducing the operating voltage of the OP amp, the lower output voltage can be achieved.

<Other Embodiment Mode of the Present Invention>

In the reference voltage circuit shown in FIG. 3, for both of the two current-to-voltage conversion circuits I-V1 and I-V2 to be compared with each other, the current-to-voltage conversion circuit shown in FIG. 2B can be used.

Embodiment 7

Figure 10:
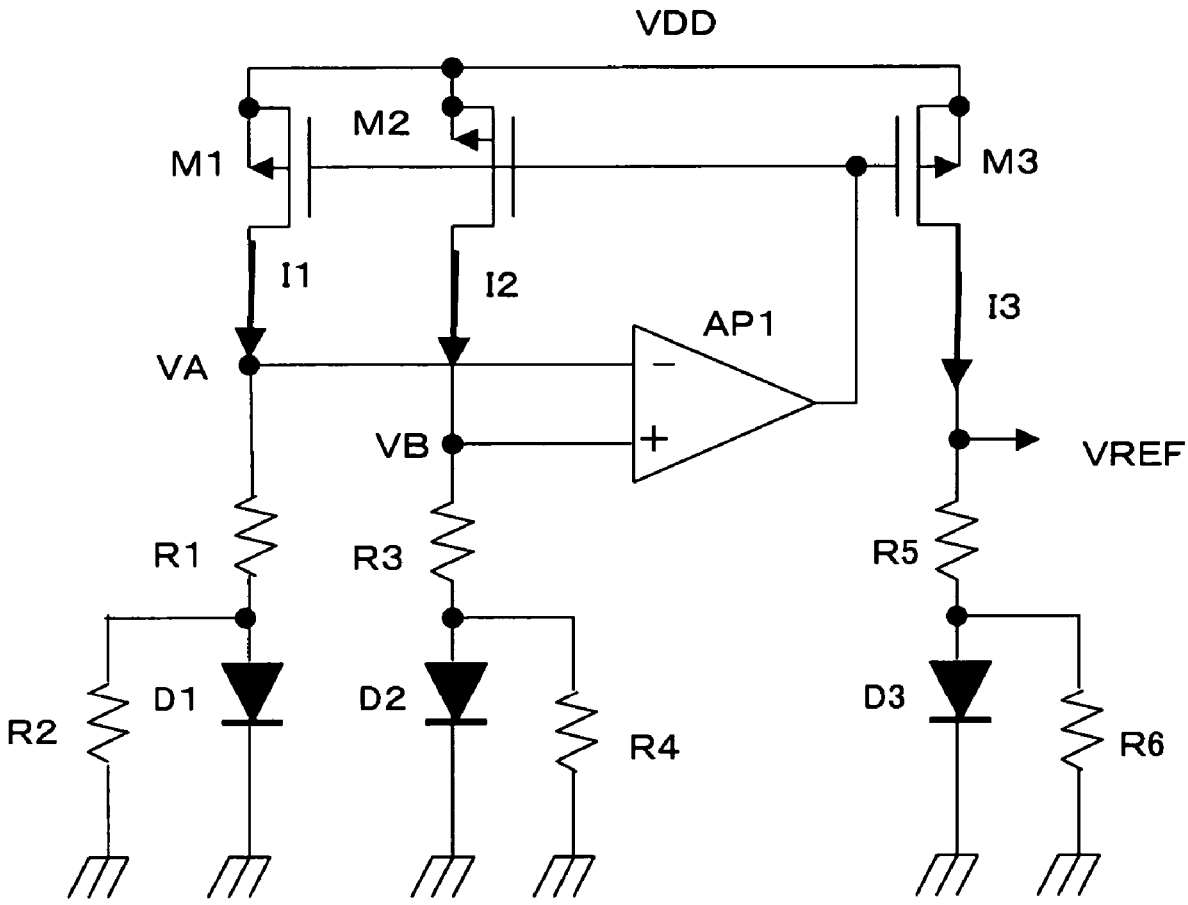
FIG. 10 is a diagram showing a circuit configuration of a second embodiment of (claims 1, 2, and 4 of) the present invention.

A reference voltage circuit shown in FIG. 10 shows an example in which the current-to-voltage conversion circuit illustrated in FIG. 2B has been employed for all of the three current-to-voltage conversion circuits I-V1, I-V2, and I-V3 in the circuit illustrated in FIG. 3.

An operation of the present embodiment will be described. When currents to MOS transistors M1 and M2 are equal in FIG. 10, the following equation holds:

$$I1=I2 \tag{53}$$

In this case, by a control circuit (OP amp), the following equation holds:

$$VA=VB \tag{54}$$

In this case, the following equations hold:

$$I1=(VA-VF1)/R1 \tag{55}$$

$$I2=(VB-VF2)/R3 \tag{56}$$

When Equations (55) and (56) are substituted into Equation (54) to obtain VA (=VB), $$VA=\{R1R3/(R3-R1)\}(VF1/R1-VF2/R3) \tag{57}$$

When substitution into the Equations (55) and (56) is performed, the following equations can be obtained:

$$I1=I2=(VF1-VF2)/(R3-R1)=\Delta VF/(R3-R1) \tag{58}$$

Accordingly, the voltages VA and VB can also be rewritten as follows:

$$VA=VF1+\{R1/(R3-R1)\}\Delta VF \tag{59}$$

$$VB=VF2+\{R3/(R3-R1)\}\Delta VF \tag{60}$$

It should be noted herein that in these circuit analysis equations, resistors R2 and R4 connected to diodes (or diode-connected bipolar transistors) in parallel do not make their presence. In the actual circuit, the resistors R2 and R4 connected to the diodes (or the diode-connected bipolar transistors) in parallel will change the currents that flow through the diodes (or the diode-connected bipolar transistors) and will influence the temperature characteristics in particular.

When the magnitudes of the resistors R2 and R3 are made to be extremely different, the currents that flow through the two diodes (or the diode-connected bipolar transistors) can be greatly changed, so that the values of the temperature characteristics of the (negative) forward voltages can be changed.

When the third current-to-voltage conversion circuit in the output circuit is set to be the circuit in FIG. 2B as shown in FIG. 10, the following equation holds:

$$I3=(VREF-VF3)/R5 \quad (61)$$

From Equation (61), the reference voltage VREF is obtained as follows:

$$VREF=VF3+R5\times I3 \quad (62)$$

In Equation (62), the term of the resistor division ratio {R6/(R5+R6)} is not used. However, on the circuit, a resistor R6 is connected to the diode D3 in parallel. The resistor R6 is less represented in Equation (62). Now, when the current that flows through a diode D3 is represented by IF3, the following expression is obtained:

$$I3=IF3+VF3/R6 \quad (63)$$

When Equation (63) is substituted into Equation (62), the following expression is obtained:

$$VREF=(1-R5/R6)VF3+R5\times IF3 \quad (64)$$

That is, the equation shows that, under a condition in which the value of a resistor R5 is smaller than the value of the resistor R6, a voltage obtained by compressing the forward voltage VF3 of the diode by the factor of (1−R5/R6) (being smaller than 1) and adding the product of the current IF3 that flows through the diode and the resistor R5 to the compressed voltage (1−R5/R6)VF3 has become the voltage VREF. In this case, the voltage VF3 has a temperature characteristic in the vicinity of approximately −1.9 mV/° C., which is compressed by the factor of (1−R5/R6) (being smaller than 1). Accordingly, in order to compensate the temperature characteristics of the reference voltage VREF to be output, the small negative temperature characteristic in the vicinity of approximately −1,9 mV/° C., compressed by the factor of (1−R5/R6) (being smaller than 1) should be added to a small corresponding positive temperature characteristic. This is the same as in the foregoing description.

More specifically, by making the current I3 to have a positive temperature characteristic, the temperature characteristic of the current IF3 that flows through the diode also maintains a positive temperature characteristic. By generating the voltage R5×IF3 having the positive temperature characteristic corresponding to the negative temperature characteristic of (1−R5/R6)VF3, the reference voltage VREF having zero temperature coefficient can be obtained.

It can be seen that even in the current-to-voltage conversion circuit shown in FIG. 2B, the output line voltage VREF can be set to an arbitrary voltage value lower than 1.2 V, as in the above description. That is, the current-to-voltage conversion circuit in FIG. 2B and the current-to-voltage conversion circuit in FIG. 2A are generally similar. Even in the current-to-voltage conversion circuit shown in FIG. 2B, characteristics similar to those in the current-to-voltage conversion circuit shown in FIG. 2A can be implemented.

Embodiment 8

Figure 11:
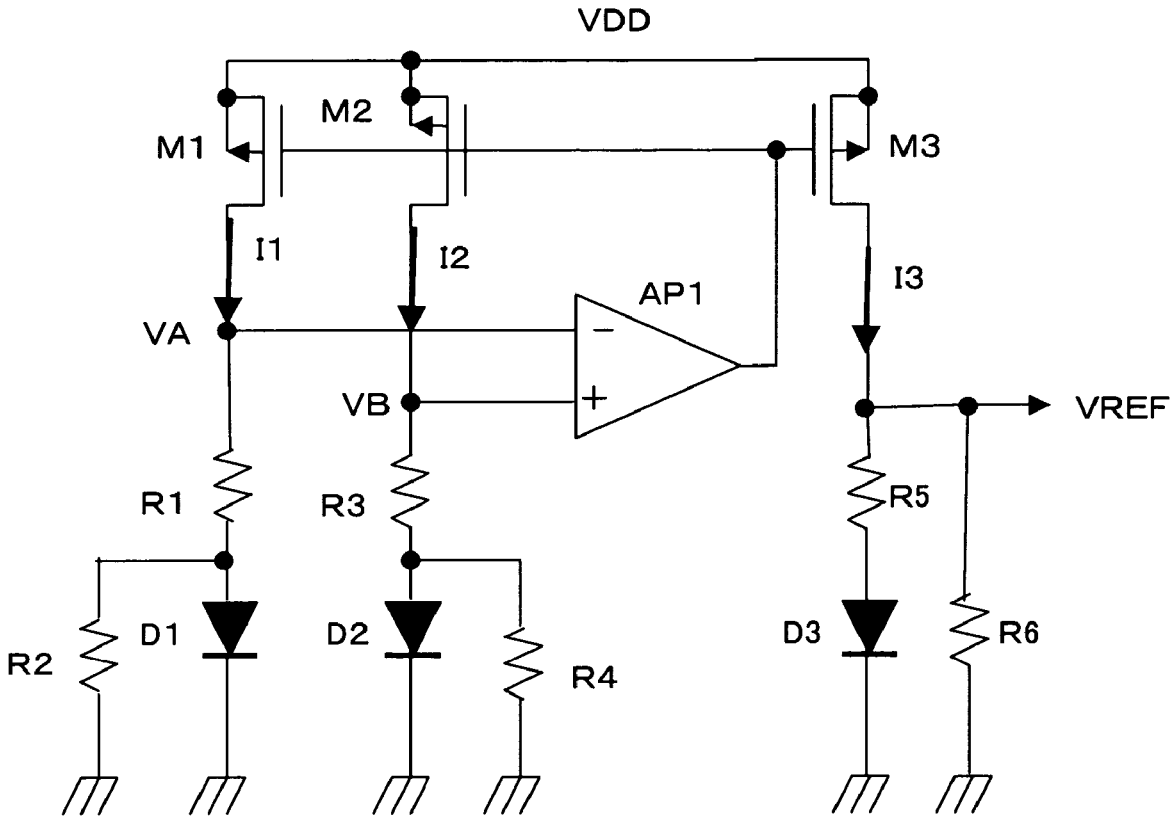
FIG. 11 is a diagram showing a circuit configuration of a third embodiment of (claim 1, 2, or 3 of) the present invention.

A reference voltage circuit shown in FIG. 11 shows an example in which in the circuit shown in FIG. 3, the current-to-voltage conversion circuit illustrated in FIG. 2B has been employed for both of the two current-to-voltage conversion circuits I-V1 and I-V2, and the current-to-voltage conversion circuit illustrated in FIG. 2A has been used for the current-to-voltage conversion circuit I-V3 on an output side.

When currents for MOS transistors M1, M2, and M3 are equal (I1=I2=I3) in FIG. 11, the following equation holds in the output circuit:

$$I3=(VREF-VF3)R5+VREF/R6 \quad (65)$$

Thus, the following expression is given:

$$VREF=\{R6/(R5+R6)\}\{VF3+R5\times I3\} \quad (66)$$

in which the term of {R6/(R5+R6)} for the voltage {VF3+R5×I3} indicates the resistor division ratio between resistors R5 and R6 and indicates that the voltage {VF3+R5×I3} is voltage divided to a lower voltage by the voltage ratio between the resistors R5 and R6. In other words, the reference voltage circuit may be the circuit with a low output voltage.

Further, the voltage VF3 has a temperature coefficient of approximately −1.9 mV/° C. Accordingly, in order to make the voltage {VF3+R5×I3} to have zero temperature coefficient, it is necessary that the voltage R5×I3 has a positive temperature characteristic. That is, when the temperature characteristic of the resistor R5 is neglected, the current I3 needs to have a positive temperature characteristic.

Now, I1=I2=I3 hold. Thus, the ΔVF (=(VF1−VF2) in Equation (58), for example, cannot be made to have a positive temperature characteristic. However, by setting a resistor ratio (R3−R1), the voltage can be made to have the positive temperature characteristic, and an arbitrary current value I1(=I2=I3) can be obtained.

Accordingly, since the resistor division ratio {(R6/(R5+R6)) has zero temperature coefficient, by making the voltage R5×I3 to have the positive temperature characteristic, the temperature characteristics of the output voltage VREF can be compensated.

Embodiment 9

Likewise, any of the circuits in FIGS. 2A and 2B can be used for one of the first current-to-voltage conversion circuit and the second current-to-voltage conversion circuit. Specific circuit diagrams are shown in FIGS. 6 to 8.

Figure 12:
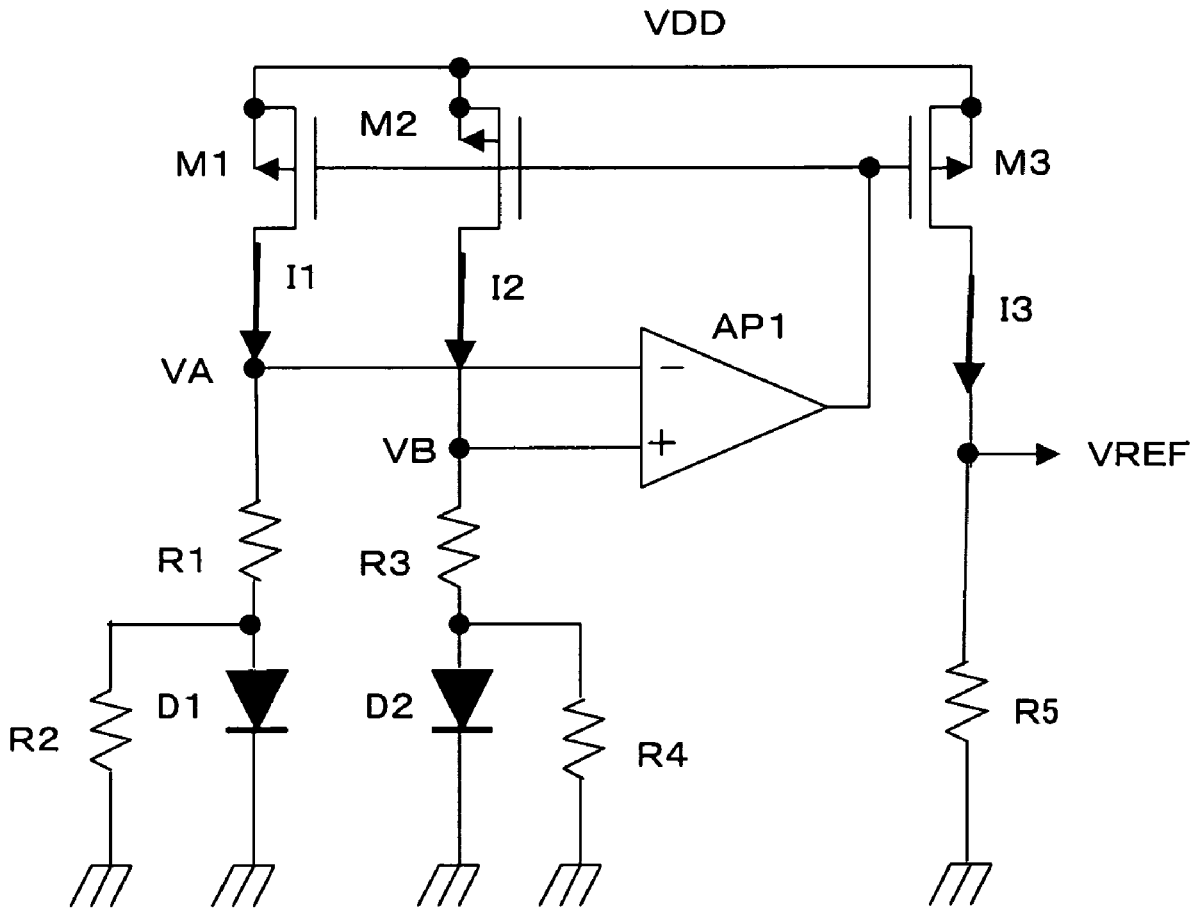
FIG. 12 is a diagram showing a circuit configuration of a fourth embodiment of (claim 1, 2, or 4 of) the present invention.

When the circuit shown in FIG. 2B is used for the first current-to-voltage conversion circuit (I-V1) and the second current-to-voltage conversion circuit (I-V2), and the circuit shown in FIG. 2C is used for the current-to-voltage conversion circuit (I-V3) on the output side, a circuit as shown in FIG. 12 is obtained.

An operation of the present embodiment will be described. When currents for MOS transistors M1 and M2 are equal in FIG. 12, the following equation holds:

$$I1=I2 \quad (67)$$

In this case, by the control circuit (OP amp), the following equation holds:

$$VA=VB \quad (68)$$

In this case, the following equations hold:

$$I1=(VA-VF1)/R1 \quad (69)$$

$$I2=(VB-VF2)/R3 \quad (70)$$

When Equations (69) and (70) are substituted into Equation (67) to obtain VA (=VB), $$VA=\{R1R3/(R3-R1)\}(VF1/R1-VF2/R3) \quad (71)$$

When substitution into Equations (69) and (70) is performed, the following equations are obtained:

$$I1=I2=(VF1-VF2)/(R3-R1)=\Delta VF/(R3-R1) \quad (72)$$

Accordingly, the voltages VA and VB can also be rewritten as follows:

$$VA=VF1+\{R1/(R3-R1)\}\Delta VF \quad (73)$$

$$VB=VF2+\{R3/(R3-R1)\}\Delta VF \quad (74)$$

It should be noted herein that in these circuit analysis equations, resistors R2 and R4 connected to diodes (or diode-connected bipolar transistors) in parallel do not make their presence.

On the actual circuit, the resistors R2 and R4 connected to the diodes (or the diode-connected bipolar transistors) in parallel will change the currents that flow through the diodes (or the diode-connected bipolar transistors) and will influence the temperature characteristics in particular.

When the magnitudes of the resistor R2 and a resistor R3 are made to be extremely different, for example, the currents that flow through the two diodes (or the diode-connected bipolar transistors) can be greatly changed, so that the values of the temperature characteristics of the (negative) forward voltages can be changed.

[Example of Simulation Values]

If R1<R3 (R1=1.2 KΩ and R3=2.408 kΩ), R2 being set to be approximately twice as large as value of R4 (R2=70 kΩ and R4=38 kΩ), N=2, and R5=20 kΩ, as an example of the SPICE simulation, as the voltage VREF, 542.5 mV at −46° C., 541.5 mV at 27° C., and 542.4 mV at 100° C. are obtained. The temperature characteristic of the voltage VREF became +0.185% by a change of 146° C. The temperature characteristic of an extremely minute bowl shape in which the voltage VREF becomes the minimum voltage at ambient temperature and minutely rises at low and high temperatures was obtained. Actually, the temperature characteristic is negligible.

In the simulation, by changing the values of the resistors in the simulation, the upside-down bowl shape has been also obtained. If the values of the resistors are then changed, the temperature characteristic could be made to be linear. In the case of the above-mentioned values, the temperature characteristic extended beyond a straight line a little, so that the temperature characteristic of the bowl type has been obtained.

As described above, it will be understand that the voltage ΔVF in the circuit analysis equation (72) of the circuit in FIG. 12 has the temperature characteristic completely different from the temperature characteristic of the voltage ΔVF in the circuit analysis equation (45) of the circuit in FIG. 6.

Other Embodiment Mode of the Present Invention

In the reference voltage circuit shown in FIG. 3, for one of the two current-to-voltage conversion circuits I-V1 and I-V2 to compared with each other, any of the current-to-voltage conversion circuits illustrated in FIGS. 2A and 2B can be used.

For the current-to-voltage conversion circuit I-V3 in the output circuit, any of the current-to-voltage conversion circuits shown in FIGS. 2A, 2B, and 2C can be used.

Likewise, in the reference voltage circuit shown in FIG. 3, any of the circuits in FIGS. 2A and 2B can be used for one of the first current-to-voltage conversion circuit and the second current-to-voltage conversion circuit.

For the current-to-voltage conversion circuit in the output circuit, any of the current-to-voltage conversion circuits in FIGS. 2A, 2B, and 2C can be used. Specific circuit diagrams are shown in FIGS. 3 to 16.

Embodiment 10

Figure 13:
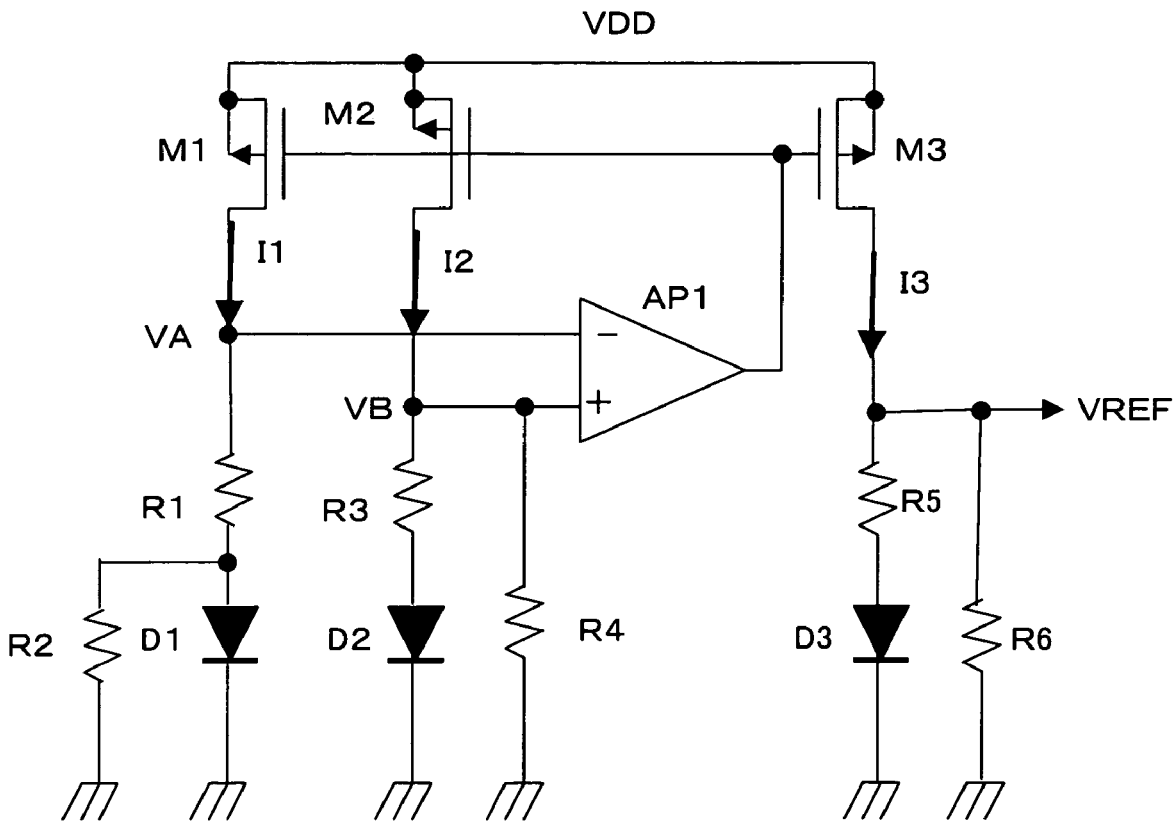
FIG. 13 is a diagram showing a circuit configuration of a fifth embodiment of (claim 1, 2, or 4 of) the present invention.

In a reference voltage circuit shown in FIG. 13, the current-to-voltage conversion circuit illustrated in FIG. 2B is used for the first current-to-voltage conversion circuit, and the current-to-voltage conversion circuit illustrated in FIG. 2A is used for the second current-to-voltage conversion circuit. The current-to-voltage conversion circuit illustrated in FIG. 2A is used for the third current-to-voltage conversion circuit.

Referring to FIG. 13, the two voltages VA and VB to be compared are controlled to be equal by the OP amp. The voltage VA is the voltage generated by the first current-to-voltage conversion circuit (constituted from a resistor R1 and the parallel circuit (constituted from a resistor R2 and a diode D1)). The voltage VB is the voltage generated by the second current-to-voltage conversion circuit (constituted from a series circuit (constituted from a resistor R3 and a diode D2) and a parallel circuit constituted from the second current-to-voltage conversion circuit and a resistor R4. Herein, the current-to-voltage conversion circuit illustrated in FIG. 2B is used as the first current-to-voltage conversion circuit, the current-to-voltage conversion circuit illustrated in FIG. 2A is used as the second current-to-voltage conversion circuit, and the current-to-voltage conversion circuit illustrated in FIG. 2A is used as the third current-to-voltage conversion circuit.

When currents for MOS transistors M1 and M2 are equal in FIG. 13, the following equation holds:

$$I1=I2 \quad (75)$$

In this case, by the control circuit (OP amp), the following equation holds:

$$VA=VB \quad (76)$$

In this case, $$I1=(VA-VF1)/R1 \quad (77)$$

$$I2=(VB-VF2)/R3+VB/R4 \quad (78)$$

When Equations (77) and (78) are substituted into Equation (75) to obtain VA (=VB), $$\begin{aligned} VA &= VB \quad (79) \\ &= \{R1R3R4/(R3R4-R1R4-R3R1)\}(VF1/R1-VF2/R3) \\ &= R4(R3VF1-R1VF2)/(R3R4-R1R4-R3R1) \end{aligned}$$

When substitution into Equations (77) and (78) is performed, the following equations are obtained:

$$I1=I2=\{(R3+R4)VF1-R4VF2/(R3R4-R1R4-R3R1) \quad (80)$$

The output current I3 is expressed as follows:

$$I3=(VREF-VF3)/R5+VREF/R6 \quad (81)$$

Accordingly, the VREF becomes as follows:

$$VREF=\{R6/(R5+R6)\}(VF3+R5\times I3) \quad (82)$$

in which the term of {R6/(R5+R6)} for the voltage {VF3+R5×I3} indicates the resistor division ratio between resistors R5 and R6, and indicates that the voltage {VF3+R5×I3} is voltage divided to a lower voltage by the voltage ratio between the resistors R5 and R6. In other words, the reference voltage circuit may be the circuit with a lower output voltage.

The voltage VF3 has a temperature coefficient of approximately −1.9 mV/° C. Accordingly, in order to make the voltage {VF3+R5×I3} to have zero temperature coefficient, it is necessary that the voltage R5×I3 has a positive temperature characteristic.

That is, when the temperature characteristic of the resistor R5 is neglected, the current I3 needs to have a positive temperature characteristic. Since the resistive voltage ratio {R6/(R5+R6)} has zero temperature coefficient, it can be seen that the temperature characteristics of the output voltage VREF can be compensated by making the voltage R5×I3 to have the positive temperature characteristic.

Alternatively, the VREF can also be expressed as follows:

$$VREF=\{R5R6/(R5+R6)\}[\{(R3+R4)VF1-R4VF2\}/(R3R4-R1R4-R3R1)-VF3/R5] \quad (83)$$

However, as easily seen from Equation (83), both of the voltages VF1, VF2, and VF3 have negative temperature characteristics (in the vicinity of approximately −1.9 mV/° C.). By weighting each of the voltages and performing addition and subtraction, the temperature characteristics of the voltage VREF can be compensated.

Embodiment 11

Figure 14:
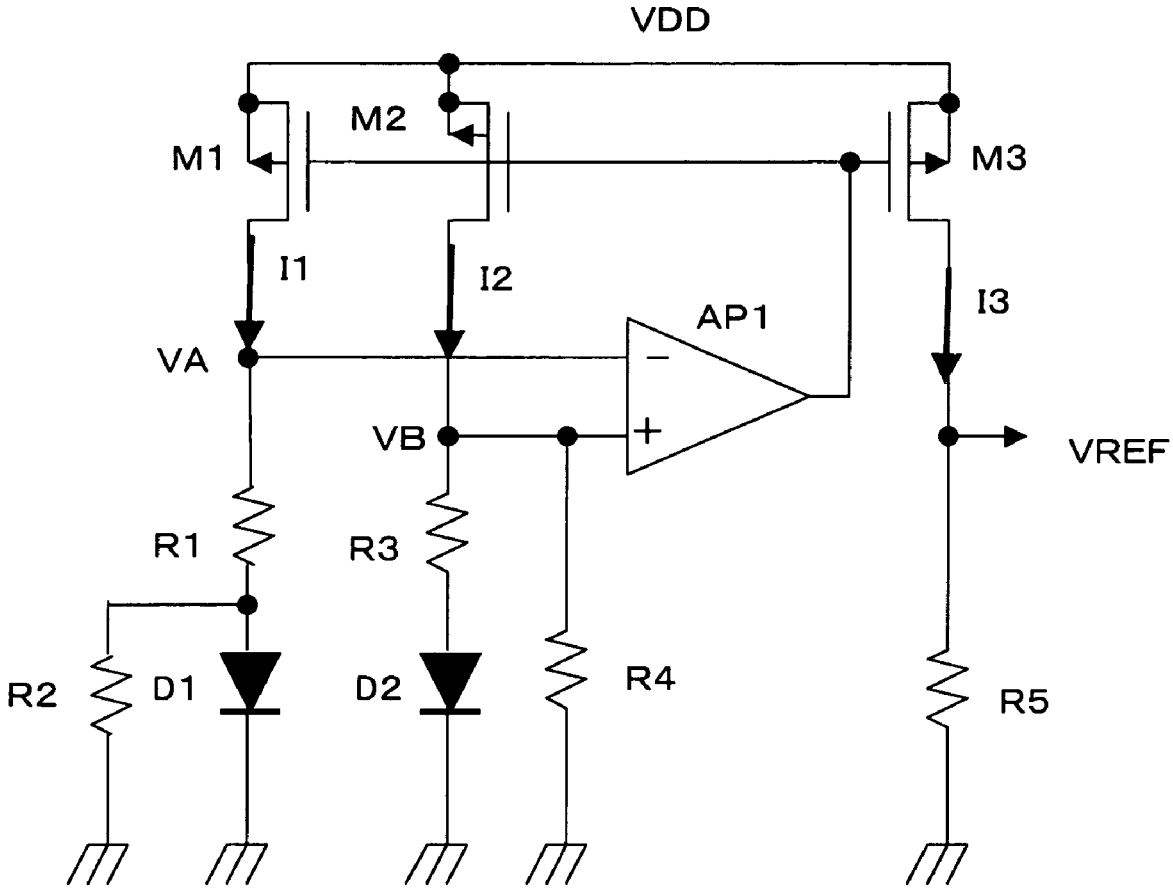
FIG. 14 is a diagram showing a circuit configuration of a sixth embodiment of (claims 1, 2, or 3 of) the present invention.

In a reference voltage circuit shown in FIG. 14, the current-to-voltage conversion circuit illustrated in FIG. 2B is used for the first current-to-voltage conversion circuit, and the current-to-voltage conversion circuit illustrated in FIG. 2A is used for the second current-to-voltage conversion circuit. The current-to-voltage conversion circuit shown in FIG. 2C is used for the third current-to-voltage conversion circuit.

Referring to FIG. 14, the two voltages VA and VB to be compared are controlled to be equal by the OP amp. The voltage VA is the voltage generated by the first current-to-voltage conversion circuit. The voltage VB is the voltage generated by the second current-to-voltage conversion circuit.

As described before, this reference voltage circuit uses the current-to-voltage conversion circuit shown in FIG. 2B for the first current-to-voltage conversion circuit, uses the current-to-voltage conversion circuit shown in FIG. 2A for the second current-to-voltage conversion circuit, and uses the current-to-voltage conversion circuit shown in FIG. 2C for the third current-to-voltage conversion circuit. This circuit configuration is obtained by changing the third current-to-voltage conversion circuit in the output circuit in FIG. 13 to a resistor. Equations (75) to (80) similarly hold.

Accordingly, the reference voltage VREF to be output is expressed as follows:

$$VREF=R5\times I3=R5\{(R3+R4)VF1-R4VF2\}/(R3R4-R1R4-R3R1) \quad (84)$$

As can be easily understood from Equation (84), both of the voltages VF1 and VF2 have negative temperature characteristics (in the vicinity of approximately −1.9 mV/° C.). By weighting each of the voltages and performing addition and subtraction on the weighted voltages, the temperature characteristics of the voltage VREF can be compensated.

[Example of Simulation Values]

Then, assume that the SPICE simulation of the circuit in FIG. 14 is performed. If R1=3 KΩ, R3=4.5 KΩ, R2=R4=100 kΩ, N=3, and R5=10 kΩ, as the voltage VREF, 450.2 mV t −46° C., 451.9 mV at 27° C., and 449.9 mV at 100° are obtained. The temperature characteristic of the voltage VREF became −0.376% by a change of 146° C. As described above, even if a circuit analysis by hand calculation cannot be performed, an operation as the reference voltage circuit can be confirmed by the simulation.

Likewise, it can be considered that, even in FIG. 13, by setting constants of respective devices, characteristics of a desired reference voltage circuit can be obtained.

Embodiment 12

Figure 15:
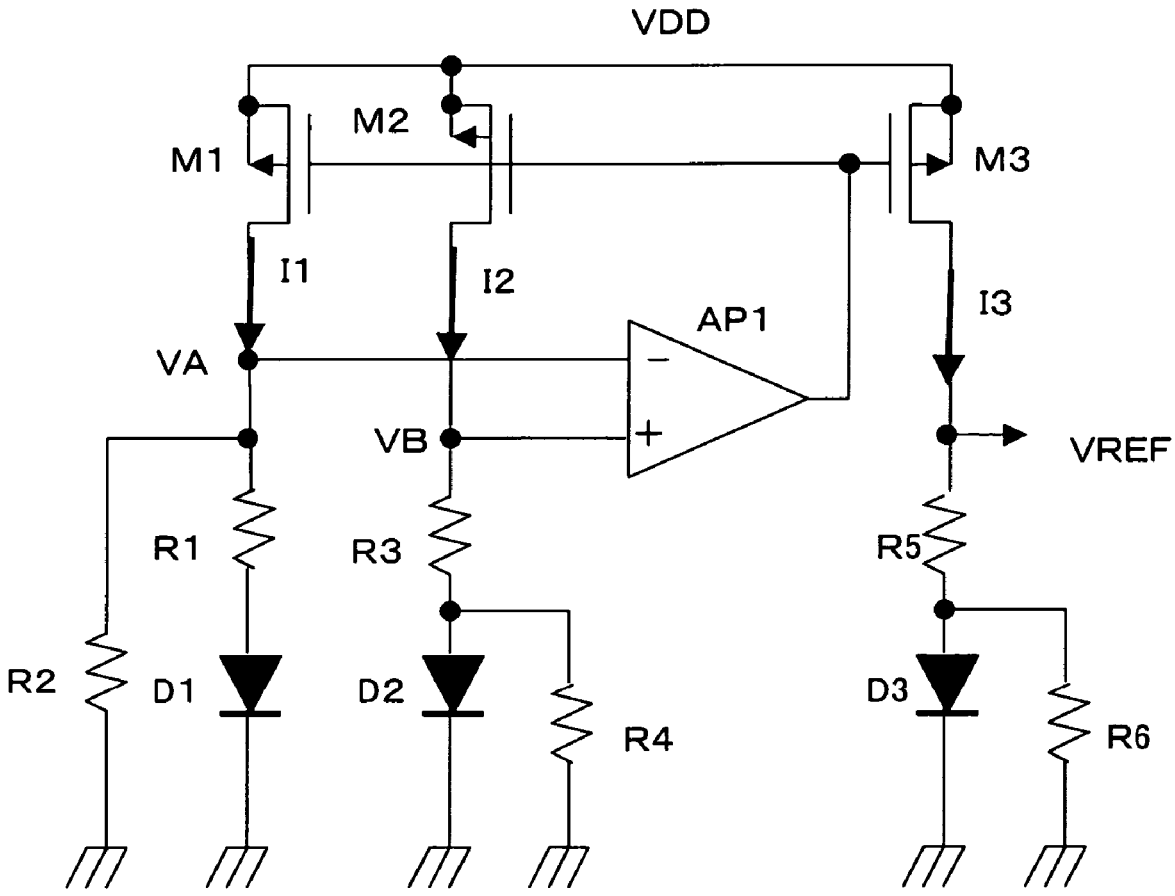
FIG. 15 is a diagram showing a circuit configuration of a seventh embodiment of (claim 1, 2, or 4 of) the present invention.

A reference voltage circuit in FIG. 15 uses the current-to-voltage conversion circuit shown in FIG. 2A for the first current-to-voltage conversion circuit, uses the current-to-voltage conversion circuit shown in FIG. 2B for the second current-to-voltage conversion circuit, and uses the current-to-voltage conversion circuit shown in FIG. 2B for the third current-to-voltage conversion circuit.

An operation of the present embodiment will be described. Referring to FIG. 15, control is performed by the OP amp so that the two voltages VA and VB to be compared with each other become equal. The voltage VA is the voltage generated by the first current-to-voltage conversion circuit, while the voltage VB is the voltage generated by the second current-to-voltage conversion circuit.

This reference voltage circuit uses the current-to-voltage conversion circuit shown in FIG. 2A for the first current-to-voltage conversion circuit, uses the current-to-voltage conversion circuit shown in FIG. 2B for the second current-to-voltage conversion circuit, and uses the current-to-voltage conversion circuit shown in FIG. 2B for the third current-to-voltage conversion circuit. When currents for MOS transistors M1 and M2 are equal in FIG. 15, the following equation holds:

$$I1=I2 \quad (85)$$

In this case, by the control circuit (OP amp), the following equation is set:

$$VA=VB \quad (86)$$

In this circuit, $$I1=(VA-VF1)/R1+VA/R2 \quad (87)$$

$$I2=(VB-VF2)/R3 \quad (88)$$

When Equations (87) and (88) are substituted into Equation (85) to obtain the voltage VA (=VB), the voltage VA is obtained as follows:

$$\begin{aligned} VA &= VB \quad (89) \\ &= \{R1R2R3/(R2R3+R1R3-R1R2)\}(VF1/R1-VF2/R3) \\ &= (R2R3VF1-R1R2VF2)/(R2R3+R1R3-R1R2) \end{aligned}$$

When substitution of the Equation (89) into Equations (87) and (88) is performed, the following equations are obtained:

$$I1=I2=\{R2VF1-(R1+R2)VF2\}/(R2R3+R1R3-R1R2) \quad (90)$$

The output current I3 is expressed as follows:

$$I3=(VREF-VF3)/R5+VREF/R6 \quad (91)$$

Accordingly, the voltage VREF becomes as follows:

$$VREF=\{R6/(R5+R6)\}(VF3+R5\times I3) \quad (92)$$

in which the term of {R6/(R5+R6)} for {VF3+R5×I3} indicates the resistor division ratio between the resistors R5 and R6, and indicates that the voltage {VF3+R5×I3} is voltage divided to a lower voltage by the voltage ratio between resistors R5 and R6. In other words, the reference voltage circuit may be the circuit with a low output voltage.

The voltage VF3 has a temperature coefficient of approximately −1.9 mV/° C. Accordingly, in order to make the voltage {VF3+R5×I3} to have zero temperature coefficient, it is necessary that the voltage R5×I3 has a positive temperature characteristic. That is, when the temperature characteristic of the resistor R5 is neglected, the current I3 needs to have a positive temperature characteristic.

Since the resistor division ratio {R6/(R5+R6)} has zero temperature coefficient, it can be seen that the temperature characteristics of the output voltage VREF can be compensated by making the voltage R5×I3 to have the positive temperature characteristic.

Alternatively, the VREF can also be expressed as follows:

$$VREF=\{R5R6/(R5+R6)\}[\{R2VF1-(R1+R2)VF2\}/(R2R3+R1R3-R1R2)-VF3/R5] \quad (93)$$

However, as easily seen from Equation (93), all of the voltages VF1, VF2, and VF3 have negative temperature characteristics (in the vicinity of approximately −1.9 mV/° C.). By weighting each of the voltages and performing addition and subtraction on the weighted voltages, the temperature characteristics of the voltage VREF can be compensated.

Embodiment 13

Figure 16:
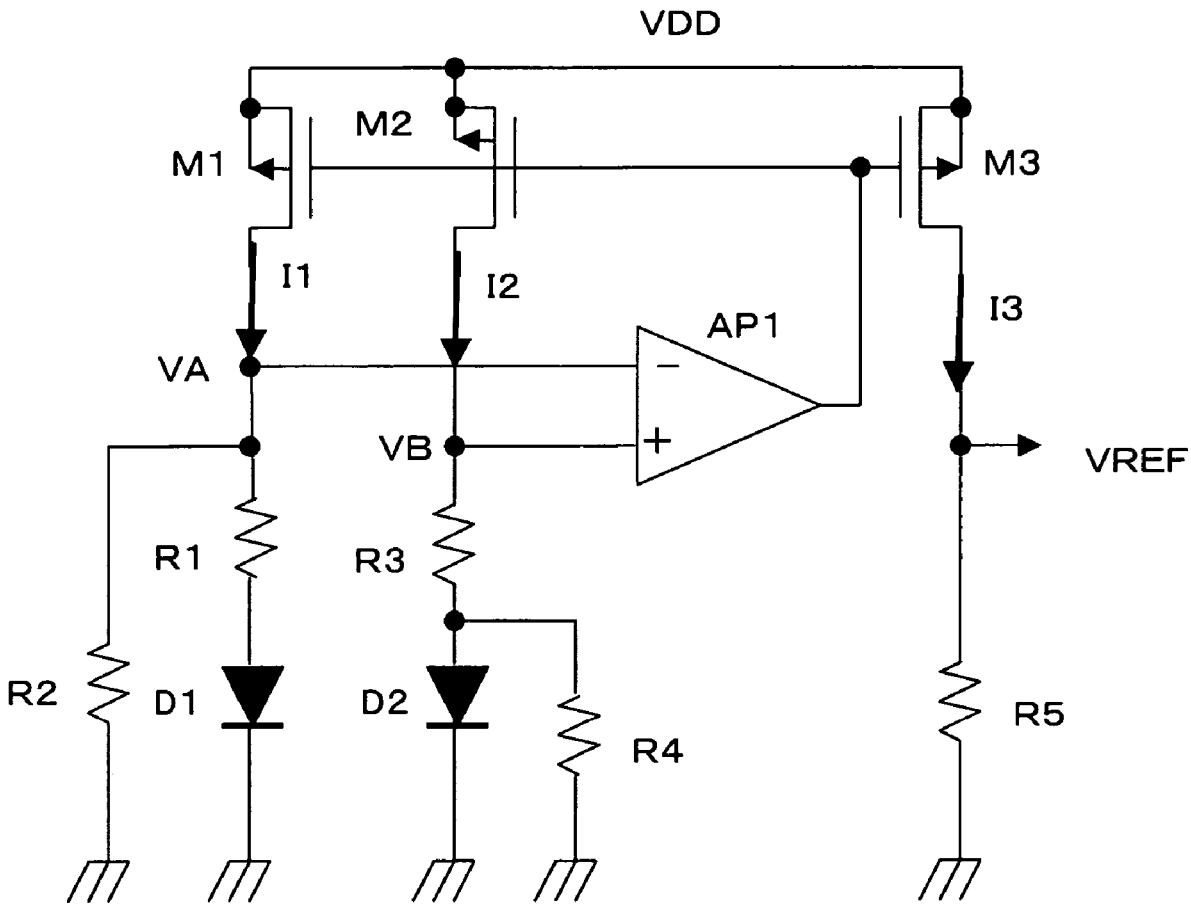
FIG. 16 is a diagram showing a circuit configuration of an eighth embodiment of (claim 1, 2, or 4 of) the present invention.

In a reference voltage circuit shown in FIG. 16, the current-to-voltage conversion circuit illustrated in FIG. 2A is used for the first current-to-voltage conversion circuit, and the current-to-voltage conversion circuit illustrated in FIG. 2B is used for the second current-to-voltage conversion circuit. The current-to-voltage conversion circuit illustrated in FIG. 2C is used for the third current-to-voltage conversion circuit.

An operation of the present embodiment will be described. Referring to FIG. 16, the two voltages VA and VB to be compared with each other are controlled to be equal by the OP amp. The voltage VA is the voltage generated by the first current-to-voltage conversion circuit. The voltage VB is the voltage generated by the second current-to-voltage conversion circuit.

As described before, in this reference voltage circuit, the current-to-voltage conversion circuit illustrated in FIG. 2A is used for the first current-to-voltage conversion circuit, the current-to-voltage conversion circuit illustrated in FIG. 2B is used for the second current-to-voltage conversion circuit, and the current-to-voltage conversion circuit illustrated in FIG. 2C is used for the third current-to-voltage conversion circuit. This circuit configuration is obtained just by changing the current-to-voltage conversion circuit on the output side (constituted by connection of a resistor R6 in parallel with the series circuit of a resistor R5 and a diode D3) to the resistor (R5), and Equations (85) to (91) similarly hold.

Accordingly, the reference voltage VREF to be output is expressed as follows:

$$VREF = R5 \times I3 \quad (94)$$

$$= \frac{R5\{R2VF1-(R1+R2)VF2\}}{(R2R3+R1R3-R1R2)}$$

As easily seen from Equation (94), both of the voltages VF1 and VF2 have negative temperature characteristics (in the vicinity of approximately −1.9 mV/° C.). By weighting each of the voltages and performing addition and subtraction on the weighted voltages, the temperature characteristics of the voltage VREF can be compensated.

Further, in FIGS. 4 through 16, a description was given about a case where a simple current mirror circuit was used as the current mirror circuit, for simplification of the description about the operation.

However, recently, the miniaturization of CMOS processing have remarkably advanced. The influence of the chancel length modulation of a transistor therefore tends to appear. In the circuit in FIG. 4, for example, the drain-to-source voltages of MOS transistors M1 and M2 are equal, but the drain-to-source voltage of an MOS transistor M3 becomes more or less different from the drain-to-source voltages of the MOS transistors M1 and M2. When a temperature variation occurs, in particular, the drain-to-source voltage of each of the MOS transistors M1, M2 and M3 will vary just by the amount of a variation caused by the temperature characteristic of the forward voltage of the diode. Accordingly, strictly speaking, the influence of the transistor channel length modulation can be found, even if it is a very little. For this reason, it is a common practice to employ a cascode current mirror circuit for the current mirror circuit to reduce this influence.

The first current-to-voltage conversion circuit and the second current-to-voltage conversion circuit in FIGS. 4-16 have the same topology. In each of the first current-to-voltage conversion circuit and the second current-to-voltage conversion circuit, the resistor is connected in series with the diode (or the diode-connected bipolar transistor). Generally, in a circuit as in a conventional circuit which includes a diode (or a diode-connected bipolar transistor) and a resistor connected in series with the diode (or a diode-connected bipolar transistor), the magnitude of sensitivity to variations of circuit elements will become a problem.

In a circuit such as a linear current mirror circuit where a current ratio thereof becomes necessary in a bipolar process, it has been a common practice to insert an emitter resistor for a bipolar transistor. Direct grounding of an emitter of the bipolar transistor has been avoided. In a non-linear current mirror circuit where a current ratio thereof is changed, a current mirror circuit such as a Widlar current mirror circuit has been sometimes employed. In the Widlar current mirror circuit, one emitter of a bipolar transistor is directly grounded and the other emitter of the bipolar transistor is grounded through an emitter resistor. However, it has been considered that in the case of a reference current/voltage circuit, matching among circuit elements and inserting a resistor as described above can reduce the influence of the variation of circuit elements to a more extent, and hence the circuit elements matching and the resistor insertion have been heretofore adopted. This application also follows this concept.

In the case of the circuits in FIGS. 4 and 6, at first glance, circuit analysis apparently has been performed successfully by chance. However, when the resistor insertion is performed as described above, generally, the circuit analysis cannot be performed by hand calculation. Thus, it has been a practice to check the characteristics of the circuit using a commonly employed circuit simulation such as the SPICE simulation. In this application as well, though partially, confirmation of the characteristics of the reference voltage circuit to be claimed is performed by the circuit simulation using the SPICE simulation.

Figure 17:
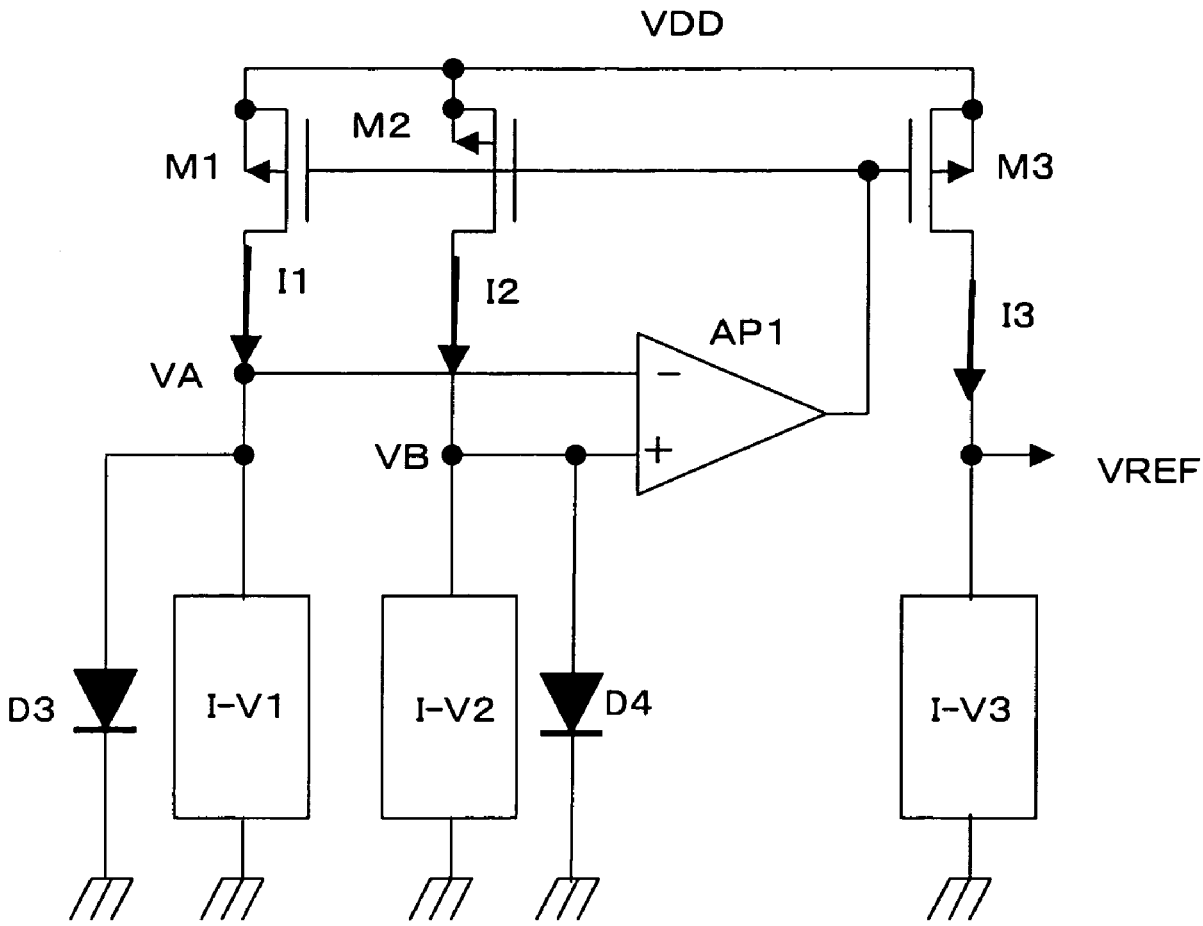
FIG. 17 is a diagram showing a circuit configuration of an embodiment of (claim 3 of) the present invention.

Further, even when two diodes are connected in parallel with the first current-to-voltage conversion circuit and the second current-to-voltage conversion circuit, respectively, as shown in FIG. 17, the reference voltage circuit with temperature characteristics thereof compensated can be implemented.

Embodiment 14

Figure 18:
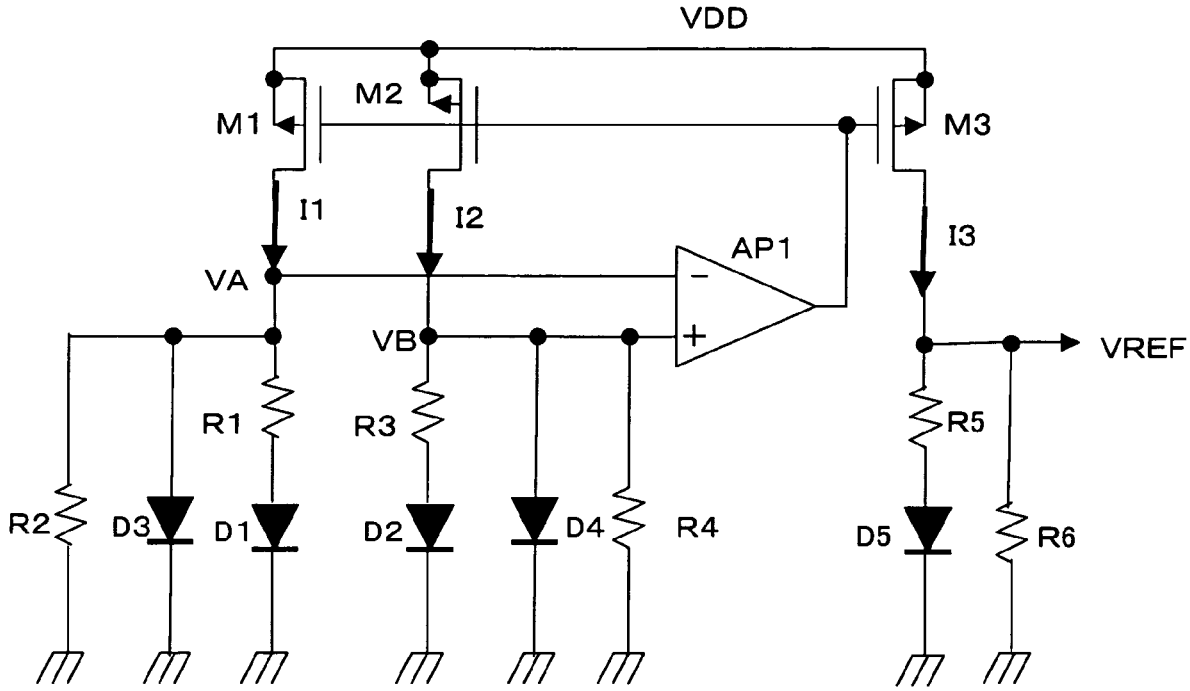
FIG. 18 is a diagram showing a circuit configuration of a first embodiment of (claim 3 of) the present invention.

In a fourteenth embodiment, as shown in FIG. 18, a unit diode D3 and a unit diode D4 are connected in parallel with the first current-to-voltage conversion circuit and the second current-to-voltage conversion circuit of a configuration in FIG. 2A, respectively.

Referring to FIG. 18, the two voltages VA and VB to be compared to each other are controlled to be equal by the OP amp.

The voltage VA is the voltage that is generated by the diode D3 connected in parallel with the first current-to-voltage conversion circuit (I-V1). The voltage VB is the voltage that is generated by the diode D4 connected in parallel with the second current-to-voltage conversion circuit (I-V2).

Herein, for all of the first to third current-to-voltage conversion circuits, the current-to-voltage circuit shown in FIG. 2A is employed.

An operation of the present embodiment will be described. For simplicity of the description, the value of the resistor R2 is set to be equal to the value of the resistor R4. Then, the following equations hold:

$$I1=I2 \tag{95}$$

$$VF3=VF4 \tag{96}$$

When currents that pass through the unit diodes D3 and D4 are set to be equal and represented by IF, the following expressions are given:

$$\begin{aligned} I1 &= VF3/R2 + IF + (VF3 - VF1)/R1 \\ &= VF3/R2 + IF + \Delta VF1/R1 \end{aligned} \tag{97}$$

$$\begin{aligned} I2 &= VF4/R4 + IF + (VF4 - VF2)/R3 \\ &= VF3/R2 + IF + \Delta VF2/R3 \end{aligned} \tag{98}$$

Accordingly, the following equation is derived:

$$\Delta VF1/R1=\Delta VF2/R3 \tag{99}$$

When all of the current IF that flows through the unit diodes D3 and D4 and a current ΔVF1/R1 (=ΔVF2/R3) that flows through resistors R1 and R3 are assumed to have positive temperature characteristics, a current VF3/R2 (=VF4/R4) that flows through resistors R2 and R4 has a negative temperature characteristic.

Now, when the temperature coefficient of the voltage VF3 is assumed to be −1.9 mV/° C., when temperature coefficient of a voltage ΔVF1 is assumed to be +0.0853 mV/° C., and when an equation of VF3/R2: (IF+ΔVF1/R1)=1:22.27 is set, the drive current I1 will have zero temperature coefficient.

That is, the value of the resistor R2 should be set to be larger than the value of the resistor R1, and the sum of the currents that flow through a diode D1 and the diode D3 should be set to 22.27 times the current that flows through the resistor R2. Actually, each of the resistors R1, R2, R3, and R4 (and R5) has a temperature characteristic, and when the resistors R1, R2, R3, and R4 (and R5) are set to have the same temperature characteristic to one another, the reference voltage VREF to be output can also be made to have zero temperature coefficient.

Conversely, by setting a relation of (IF+ΔVF1/R1)/(VF3/R2)>22.27, the drive current I1 can be made to have a positive temperature characteristic.

Further, when the current-to-voltage conversion circuit shown in FIG. 2A is employed on the output side, the reference current VREF to be output becomes as follows:

$$VREF=\{R6/(R5+R6)\}(VF5+R5\times I3) \tag{100}$$

The term of {R6/(R5+R6)} for {VF5+R5×I3} is the resistor division ratio between the resistor R5 and the resistor R6, and indicates that a voltage {VF5+R5×I3} is voltage divided to a lower voltage by the resistor ratio between the resistors R5 and R6. In other words, the reference voltage circuit may be the circuit with a low output voltage.

Further, a voltage VF5 has a temperature coefficient of approximately −1.9 mV/° C. Accordingly, in order to make the voltage {VF5+R5×I3} to have zero temperature coefficient, the voltage R5×I3 needs to have a positive temperature characteristic.

That is, when the temperature characteristic of the resistor R5 is neglected, the current I3 needs to have a positive temperature characteristic. Since the resistor division ratio of {R6/(R5+R6)} has zero temperature coefficient, it can be seen that the temperature characteristics of the output voltage VREF can be compensated by making the voltage R5×I3 to have the positive temperature characteristic.

Since I1=I2=I3, the following equations hold:

$$\begin{aligned} VREF &= \{R6/(R5+R6)\} \\ &\quad \{VF5 + R5\,(VF3/R2 + IF + \Delta VF1/R1)\} \\ &= \{R6/(R5+R6)\} \\ &\quad \{VF5 + R5(VF3/R2 + IF + \Delta VF2/R3)\} \end{aligned} \tag{101}$$

As described above, the voltage (R5×I3) can be made to have the positive temperature characteristic and the temperature characteristic of the output voltage VREF can be compensated.

Embodiment 15

Figure 19:
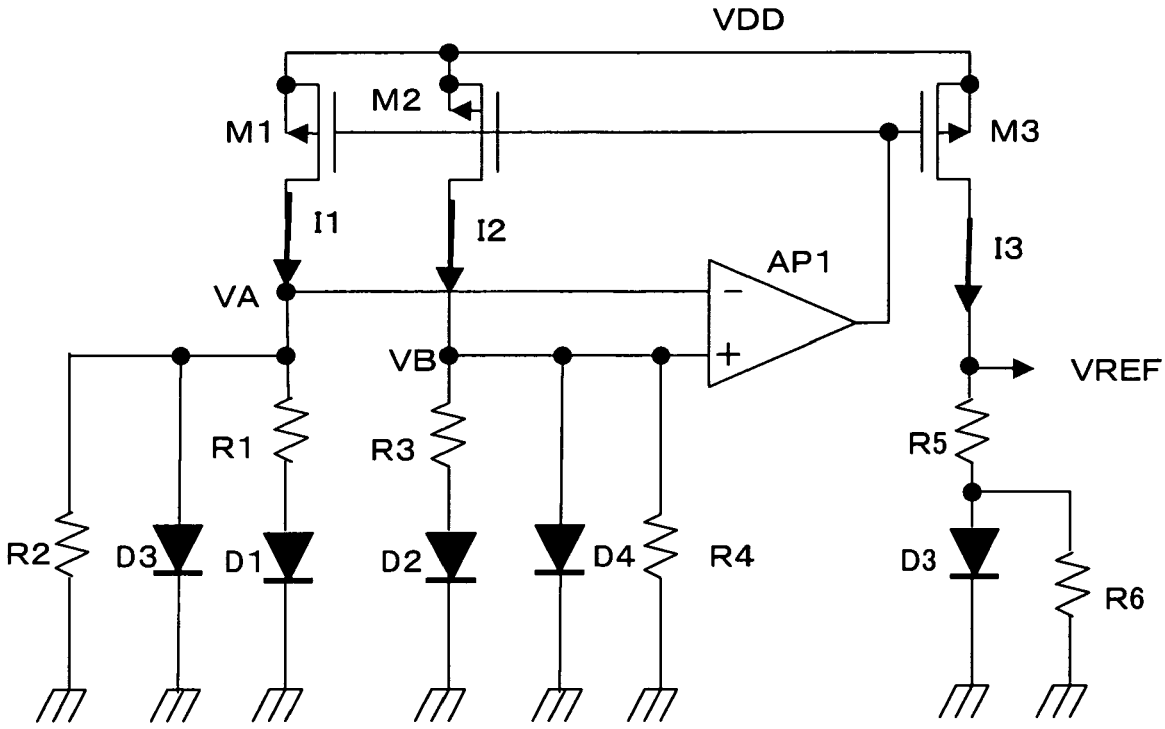
FIG. 19 is a diagram showing a circuit configuration of a second embodiment of (claim 3 of) the present invention.

As shown in FIG. 19, unit diodes D3 and D4 are connected in parallel with the first current-to-voltage conversion circuit and the second current-to-voltage conversion circuit of the configuration in FIG. 2A, respectively. Referring to FIG. 19, the two voltages VA and VB to be compared with each other are controlled to be equal by the OP amp.

The voltage VA is the voltage that is generated by the diode connected in parallel with the first current-to-voltage conversion circuit. The voltage VB is the voltage that is generated by the diode connected in parallel with the second current-to-voltage conversion circuit. Herein, the current-to-voltage conversion circuit shown in FIG. 2A is used for both of the first and second current-to-voltage conversion circuits, while the current-to-voltage conversion circuit shown in FIG. 2B is used for the third current-to-voltage conversion circuit.

An operation of the present embodiment will be described. Referring to FIG. 19, the two voltages VA and VB to be compared with each other are controlled to be equal by the OP amp. The voltage VA is the voltage that is generated by the diode connected in parallel with the first current-to-voltage conversion circuit. The voltage VB is the voltage that is generated by the diode connected in parallel with the second current-to-voltage conversion circuit. Herein, the current-to-voltage conversion circuit shown in FIG. 2A is used for the first current-to-voltage conversion circuit, the current-to-voltage conversion circuit shown in FIG. 2A is used for the second current-to-voltage conversion circuit, and the current-to-voltage conversion circuit shown in FIG. 2B is used for the third current-to-voltage conversion circuit. This circuit configuration is obtained just by changing the current-to-voltage conversion circuit on the output side in FIG. 18 to the current-to-voltage conversion circuit shown in FIG. 2B, so that Equations (95) to (100) similarly hold.

When the circuit in FIG. 2B is employed for the current-to-voltage conversion circuit on the output side as in FIG. 19, the following equation is obtained:

$$I3=(VREF-VF3)/R5 \quad (102)$$

From Equation (102), the reference voltage VREF to be output is obtained as follows:

$$VREF=VF3+R5\times I3 \quad (103)$$

The term of the resistor voltage division ratio {R6/(R5+R6)} is not multiplied in Equation (103). However, on the circuit, a resistor R6 is connected in parallel with a diode D3. The resistor R6 is less represented in Equation (103). Now, when a current that flows through the diode D3 is represented by IF3, the following expression is obtained:

$$I3=IF3+VF3/R6 \quad (104)$$

When Equation (104) is substituted into Equation (103), the following expression is given:

$$VREF=(1-R5/R6)VF3+R5\times IF3 \quad (105)$$

That is, this expression indicates that a voltage obtained by compressing the forward voltage VF3 of the diode by the factor of (1−R5/R6) (being smaller than 1) under the condition in which the value of the resistor R5 is less than the value of the resistor R6 and adding the product of the current IF3 that flows through the diode and the resistor R5 to the compressed forward voltage becomes the voltage VREF. Herein, the voltage VF3 has a temperature characteristic in the vicinity of approximately −1.9 mV/° C., and is compressed by the factor of (1−R5/R6) (being smaller than 1). Accordingly, in order to compensate the temperature characteristics of the reference voltage VREF to be output, a small negative temperature characteristic obtained by compressing the negative temperature characteristic in the vicinity of −1.9 mV/C by the factor of (1−R5/R6) (being smaller than 1) should be added to a corresponding small positive temperature characteristic. This is the same as in the foregoing description. More specifically, by making the current I3 to have a positive temperature characteristic, the temperature characteristic of the current IF3 that flows through the diode is also maintained to be positive. Further, by generating the voltage R5×IF3 that has a positive temperature characteristic corresponding to the negative temperature characteristic of the voltage (1−R5/R6) VF3, the reference voltage VREF that has zero temperature coefficient is obtained.

It can be seen that even with the current-to-voltage conversion circuit shown in FIG. 2B, the output line voltage VREF can be set to an arbitrary voltage value lower than 1.2 V, as described above. That is, the current-to-voltage conversion circuit in FIG. 2B is substantially similar to the current-to-voltage conversion circuit in FIG. 2A, and in the diagram of the current-to-voltage conversion circuit shown in FIG. 2B as well, characteristics similar to those of the current-to-voltage conversion circuit shown in FIG. 2A can be implemented.

Embodiment 16

Figure 20:
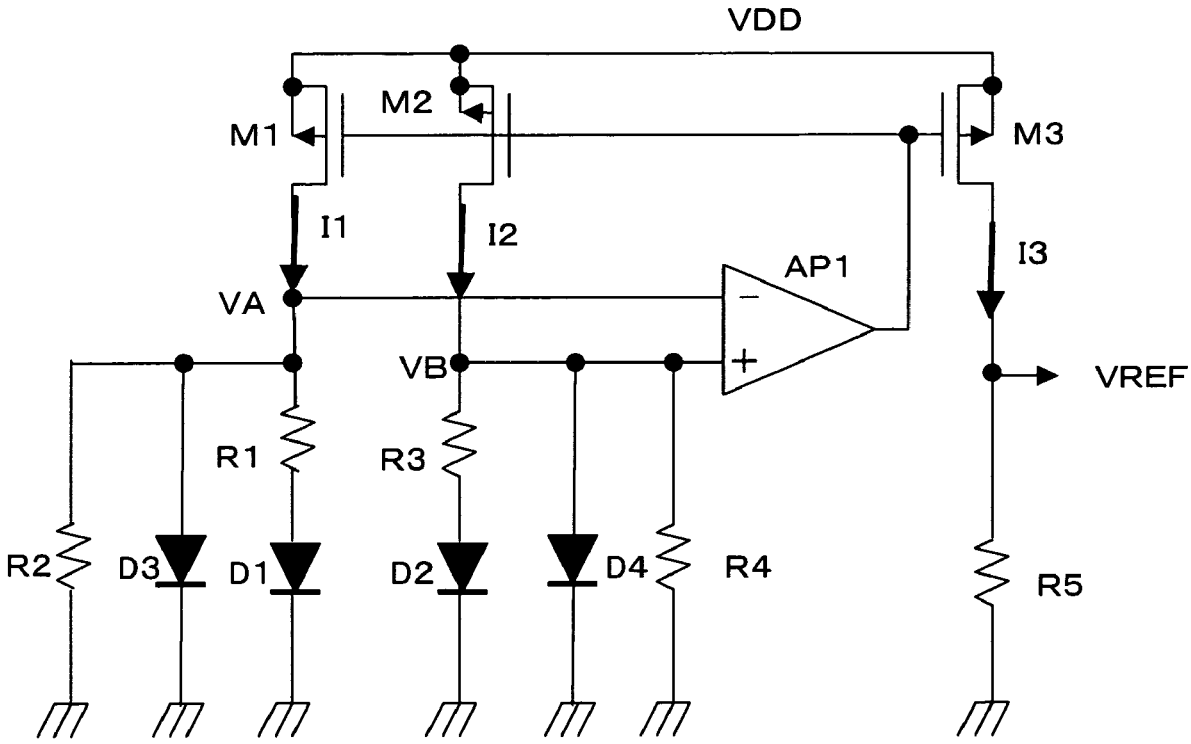
FIG. 20 is a diagram showing a circuit configuration of a third embodiment of (claim 3 of) the present invention.

As shown in FIG. 20, unit diodes D3 and D4 are connected in parallel with the first current-to-voltage conversion circuit and the second current-to-voltage conversion circuit of the configuration shown in FIG. 2A, respectively. Referring to FIG. 20, the two voltages VA and VB to be compared with each other are controlled to be equal by the OP amp. The voltage VA is the voltage that is generated by the diode connected in parallel with the first current-to-voltage conversion circuit. The voltage VB is the voltage that is generated by the diode connected in parallel with the second current-to-voltage conversion circuit.

Herein, the current-to-voltage conversion circuit shown in FIG. 2A is used for both of the first and second current-to-voltage conversion circuits, while the current-to-voltage conversion circuit shown in FIG. 2C is used for the third current-to-voltage conversion circuit. Then, by making the current-to-voltage conversion circuit on the output side to be a resistor, simplification of the circuit is achieved.

Referring to FIG. 20, the two voltages VA and VB to be compared with each other are controlled to be equal by the OP amp. The voltage VA is the voltage that is generated by the diode connected in parallel with the first current-to-voltage conversion circuit. The voltage VB is the voltage that is generated by the diode connected in parallel with the second current-to-voltage conversion circuit. Herein, the current-to-voltage conversion circuit shown in FIG. 2A is used for the first current-to-voltage conversion circuit, the current-to-voltage conversion circuit shown in FIG. 2A is used for the second current-to-voltage conversion circuit, and the current-to-voltage conversion circuit shown in FIG. 2C is used for the third current-to-voltage conversion circuit. This circuit configuration is obtained just by changing the current-to-voltage conversion circuit on the output side in FIG. 18 to the resistor. Accordingly, Equations (95) to (100) similarly hold.

When currents for the MOS transistors M1, M2, and M3 are set to be equal (I1=I2=I3) in FIG. 20, the reference voltage VREF to be output from the output circuit is expressed as follows:

$$\begin{aligned} VREF &= R5I3 \quad (106) \\ &= (R5/R2)[VF3+\{R2IF+(R2/R1)\Delta VF1\}] \\ &= (R5/R2)[VF3+\{R2IF+(R2/R3)\Delta VF2\}] \end{aligned}$$

When all of the current IF that flows through the unit diodes D3 and D4 and the current ΔVF1/R1 (=ΔVF2/R3) that flows through resistors R1 and R3 are assumed to have positive temperature characteristics, the current VF3/R2 (=VF4/R4) that flows through resistors R2 and R4 has a negative temperature characteristic.

Now, when the temperature coefficient of the voltage VF3 is assumed to be −1.9 mV/° C., when the temperature coefficient of the voltage ΔVF1 is assumed to be +0.0853 mV/° C., and when an equation of VF3/R2: (IF+ΔVF1/R1)=1:22.27 is set, the drive current I1 will have zero temperature coefficient. That is, the value of the resistor R2 should be set to be larger than the value of the resistor R1, and the sum of the currents that flow through the diodes D1 and D3 should be set to 22.27 times the current that flows through the resistor R2.

Actually, each of the resistors R1, R2, R3, and R4 (and a resistor R5) has a temperature characteristic, and when the resistors R1, R2, R3, and R4 (and R5) are set to have the same temperature characteristic to one another, the temperature characteristics of the output voltage VREF can also be compensated so that the reference voltage VREF to be output has zero temperature coefficient. That is, the reference voltage VFEF having zero temperature coefficient can be obtained. In this case, the resistor ratio (R5/R2) can be arbitrarily set. Then, when the resistor ratio (R5/R2) is set to be larger than 1, the voltage VREF will become the voltage higher than 1.2

V. When the resistor ratio (R5/R2) is set to be smaller than 1, the voltage VREF will become the voltage lower than 1.2 V, as in the case of the prior art.

Especially when the resistor ratio (R5/R2) is set to be smaller than 1 that makes the voltage VREF to be lower than 1.2 V, the supply voltage can be reduced. When the voltage VREF is set to 1.0 V, for example, the reference voltage circuit can be operated at the supply voltage of approximately 1.2 V or higher.

[Example of Simulation Values]

If R1=3 KΩ, R3=9 KΩ, R2=R4=55 kΩ, N=3, and R5=40 kΩ, as an example of the SPICE simulation, as the voltage VREF, 964.6 mV at −46° C., 968.7 mV at 27° C., and 965.7 mV at 100° C. The temperature characteristic of the voltage VREF became −0.423% by a change of 146° C., and became the maximum voltage at the ambient temperature. The temperature characteristic is minutely reduced at low and high voltages. The temperature characteristic of the minute upside-down bowl shape is obtained.

Likewise, even in the circuit shown in FIG. 17 as well, in order to reduce the supply voltage for the OP amp (AP1) as much as possible, resistors R2 and R4 connected in parallel can be equally divided into voltages R2A and R2B, and into voltages R4A and R4B, respectively, and each of the divided voltages can be set to a differential input signal voltage for the OP amp (AP1).

In this case, the voltages VA and VB are controlled to be equal. These voltages are, however, the voltages through diodes. Thus, these voltages will become approximately 1.1 V to 0.5 V, assuming a temperature change of approximately ±50° C. from the ambient temperature. Accordingly, the OP amp (AP1) has an input differential pair of P-channel transistors and can be operated at an input signal voltage of 0V or higher. For this reason, the lower the voltage of an input signal becomes, the supply voltage for the OP amp (AP1) can be reduced. That is, by dividing the resistors R2 and R4, the voltage of the input signal can be reduced, and as a result, the supply voltage can also be reduced.

Embodiment 17

Figure 21:
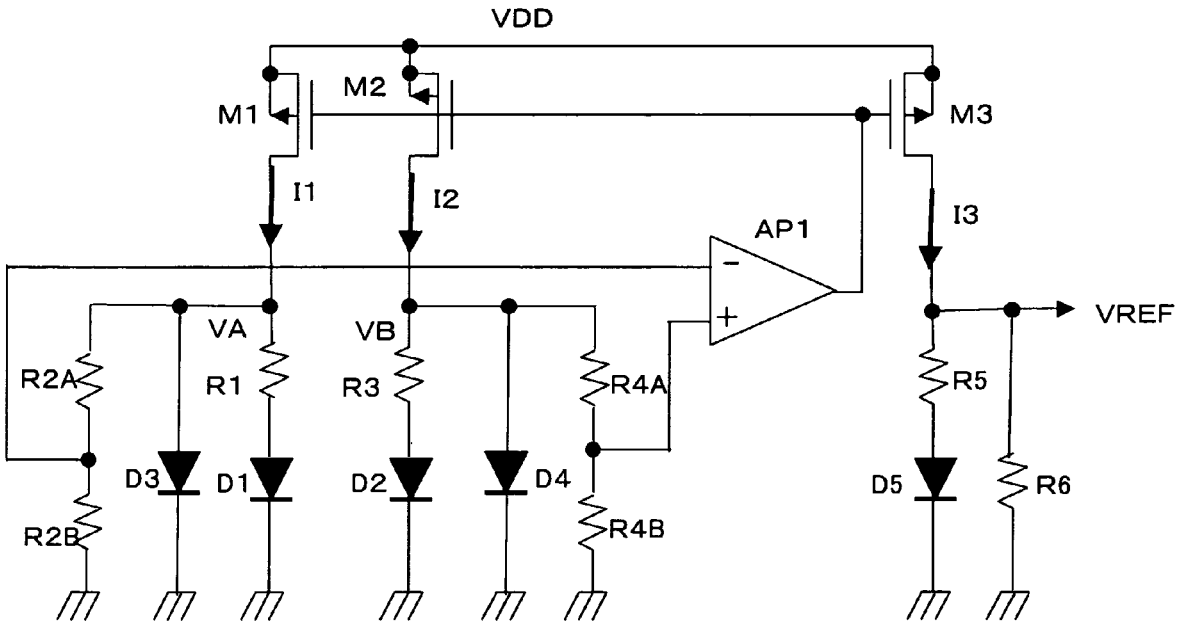
FIG. 21 is a diagram showing a circuit configuration of a fourth embodiment of (claim 5 of) the present invention.

As shown in FIG. 21, unit diodes D3 and D4 are connected in parallel with the first current-to-voltage conversion circuit and the second current-to-voltage conversion circuit of the configuration shown in FIG. 2A, respectively. Referring to FIG. 21, the two voltages VA and VB to be compared with each other are controlled to be equal by the OP amp. The voltage VA is the voltage that is generated by the diode connected in parallel with the first current-to-voltage conversion circuit. The voltage VB is the voltage that is generated by the diode connected in parallel with the second current-to-voltage conversion circuit.

Further, in the first current-to-voltage conversion circuit and the second current-to-voltage conversion circuit for which the comparison is made, the resistor R2 connected in parallel with the first current-to-voltage conversion circuit is equally divided into the resistors R2A and R2B, and the resistor R4 connected in parallel with the second current-to-voltage conversion circuit is equally divided into the resistors R4A and R4B. Then, the respective divided voltages are set to be the differential input signal voltages of the OP amp (AP1). Herein, the current-to-voltage conversion circuit shown in FIG. 2A is used for both of the first and second current-to-voltage conversion circuits, while the current-to-voltage conversion circuit shown in FIG. 2A is used for the third current-to-voltage conversion circuit.

An operation of the present embodiment will be described. When the OP amp in FIG. 21 is constituted from the input differential pair of the p-channel transistors, the OP amp can be operated at the input voltage of approximately 0 V or higher. Accordingly, when the supply voltage is lowered to operate the reference voltage circuit at a lower voltage, the input voltage should be as low as possible so that the operating voltage of the OP amp can be more reduced.

FIG. 21 shows a case in which the resistor R2 is divided into the resistors R2A and R2B and the resistor R4 is divided into the resistors R4A and R4B in the circuit in FIG. 18.

When the following equation is set, $$R2A:R2B=R4A:R4B \tag{107}$$

voltages proportionate to the voltage VA and VB are obtained from midpoints of the divided voltages.

That is, the following equation is obtained:

$$VAR2B/(R2A+R2B)=VBR4B/(R4A+R4B) \tag{108}$$

Then, it is controlled so that the voltage VA becomes equal to the voltage VB. Accordingly, as in the circuit in FIG. 18, the reference voltage circuit can be implemented.

Eighteenth Embodiment

Figure 22:
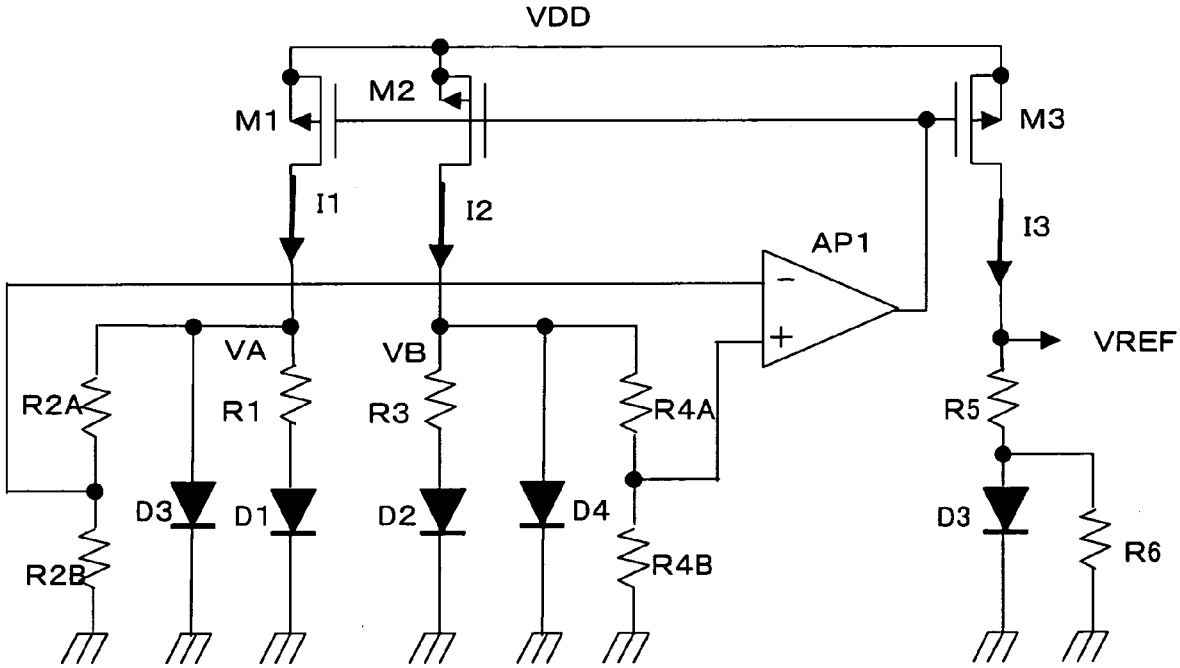
FIG. 22 is a diagram showing a circuit configuration of a fifth embodiment of (claim 5 of) the present invention.

As shown in FIG. 22, unit diodes D3 and D4 are connected in parallel with the first current-to-voltage conversion circuit and the second current-to-voltage conversion circuit of the configuration shown in FIG. 2A, respectively. Referring to FIG. 22, the two voltages VA and VB to be compared with each other are controlled to be equal by the OP amp.

The voltage VA is the voltage that is generated by the diode connected in parallel with the first current-to-voltage conversion circuit. The voltage VB is the voltage that is generated by the diode connected in parallel with the second current-to-voltage conversion circuit. Further, in the first current-to-voltage conversion circuit and the second current-to-voltage conversion circuit for which the comparison is made, a resistor R2 connected in parallel with the first current-to-voltage conversion circuit is equally divided into resistors R2A and R2B, and a resistor R4 connected in parallel with the second current-to-voltage conversion circuit is equally divided into resistors R4A and R4B. Then, each of the divided voltages is set to be the differential input signal voltage for the OP amp (AP1).

Herein, the current-to-voltage conversion circuit shown in FIG. 2A is used for both of the first and second current-to-voltage conversion circuits, while the current-to-voltage conversion circuit shown in FIG. 2B is used for the third current-to-voltage conversion circuit.

An operation of the present embodiment will be described. When the OP amp in FIG. 21 is constituted from the differential pair of p-channel transistors as an input pair thereof, the OP amp can be operated at the input voltage of approximately 0 V or higher. Accordingly, when the supply voltage is lowered to operate the reference voltage circuit at a lower voltage, the input voltage should be as low as possible so that the operating voltage of the OP amp can be more reduced. In this case as well, it is controlled so that the voltage VA becomes equal to the voltage VB. The reference voltage circuit having the same characteristics as those of the circuit in FIG. 19 can be thereby implemented.

Embodiment 19

Figure 23:
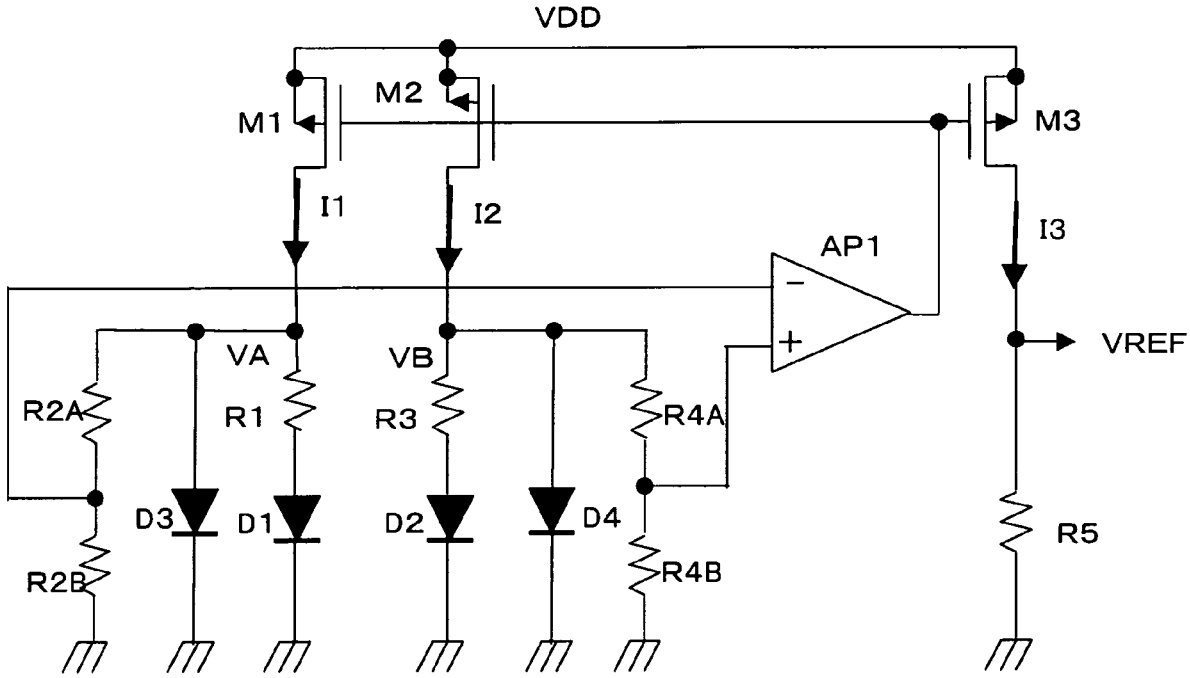
FIG. 23 is a diagram showing a circuit configuration of a sixth embodiment of (claim 5 of) the present invention.

As shown in FIG. 23, unit diodes D3 and D4 are connected in parallel with the first current-to-voltage conversion circuit and the second current-to-voltage conversion circuit of the configuration shown in FIG. 2A, respectively. Referring to FIG. 23, the two voltages VA and VB to be compared with each other are controlled to be equal by the OP amp. The voltage VA is the voltage that is generated by the diode connected in parallel with the first current-to-voltage conversion circuit. The voltage VB is the voltage that is generated by the diode connected in parallel with the second current-to-voltage conversion circuit.

Further, in the first current-to-voltage conversion circuit and the second current-to-voltage conversion circuit for which the comparison is made, a resistor R2 connected in parallel with the first current-to-voltage conversion circuit is equally divided into resistors R2A and R2B, and a resistor R4 connected in parallel the second current-to-voltage conversion circuit is equally divided into resistors R4A and R4B. Then, each of the divided voltages is set to be the differential input signal voltage for the OP amp (AP1). Herein, the current-to-voltage conversion circuit shown in FIG. 2A is used for both of the first to second current-to-voltage conversion circuits, while the resistor shown in FIG. 2C is used for the third current-to-voltage conversion circuit, thereby simplifying the output circuit.

An operation of the present embodiment will be described. When the OP amp in FIG. 23 is constituted from the input differential pair of p-channel transistor, the OP amp can be operated at the input voltage of approximately 0 V or higher. Accordingly, when the supply voltage is lowered to operate the reference voltage circuit at a lower voltage, the input voltage should be as low as possible so that the operating voltage of the OP amp can be more reduced.

In this case as well, it is controlled so that the voltage VA becomes equal to the voltage VB. The reference voltage circuit having the same characteristics as those of the circuit in FIG. 20 can be thereby implemented.

<Other Embodiment Mode of the Present Invention>

In FIG. 17, either of the current-to-voltage conversion circuits shown in FIGS. 2A and 2B can be applied to the first and second current-to-voltage conversion circuits. In addition to the first and second current-to-voltage conversion circuits in FIGS. 18 to 23 having the same circuit topology where only the current-to-voltage conversion circuit shown in FIG. 2A has been employed and of which the circuit analysis has been made and the operation has been described, the reference voltage circuit can be implemented with a circuit configuration using the current-to-voltage conversion circuits having circuit topologies that are different to each other can also be used for implementation. This is the same as in the case of FIG. 3.

However, as described above, it is difficult to perform circuit analysis by hand calculation in both of the circuits. As in the examples of the reference voltage circuit described above, by connecting unit diodes D3 and D4 in parallel with the first current-to-voltage conversion circuit and the second current-to-voltage conversion circuit, respectively, the necessary current ratio (that is equal to 22.27 in the above description) is easily implemented.

<Other Embodiment Mode of the Present Invention>

In the reference voltage circuit shown in FIG. 3 or 17 described above in which one of the current-to-voltage conversion circuits of a circuit topology {(R1−D1)//R2}, a circuit topology {R1−(D1//R2)}, a circuit topology {(R1−D1)//R2//D3}, a circuit topology [{R1−(D1//R2)}//D3] is employed as the first and second current-to-voltage conversion circuits, by performing self-biasing, the OP amp can be omitted. In the circuit topology {(R1−D1)//R2}, a diode (or the diode-connected bipolar transistor) D1 is connected in series with a resistor R1, and a resistor R2 is connected in parallel with the series circuit made up of the diode D1 and the resistor R1. In the circuit topology {(R1−(D1//R2)}, the diode (or the diode-connected bipolar transistor) D1 is connected in parallel with the resistor R2, and the resistor R1 is connected in series with parallel circuit made up of the diode D1 and the resistor R2. In the circuit topology {(R1−D1)//R2//D3}, the diode (or the diode-connected bipolar transistor) D1 is connected in series with the resistor R1, and the resistor R2 and a diode D3 (or the diode-connected bipolar transistor) are connected in parallel with the series circuit made up of the diode D1 and the resistor R1. In the circuit topology [{R1−(D1//R2)}//D3], the diode (or the diode-connected bipolar transistor) D1 is connected in parallel with the resistor R2, and the resistor R1 is connected in series with the parallel circuit made up of the diode D1 and the resistor R2, and the diode (or diode-connected bipolar transistor) D3 is connected in parallel with the circuit made up of the diode D1 and resistors R1 and R2.

Figure 24:
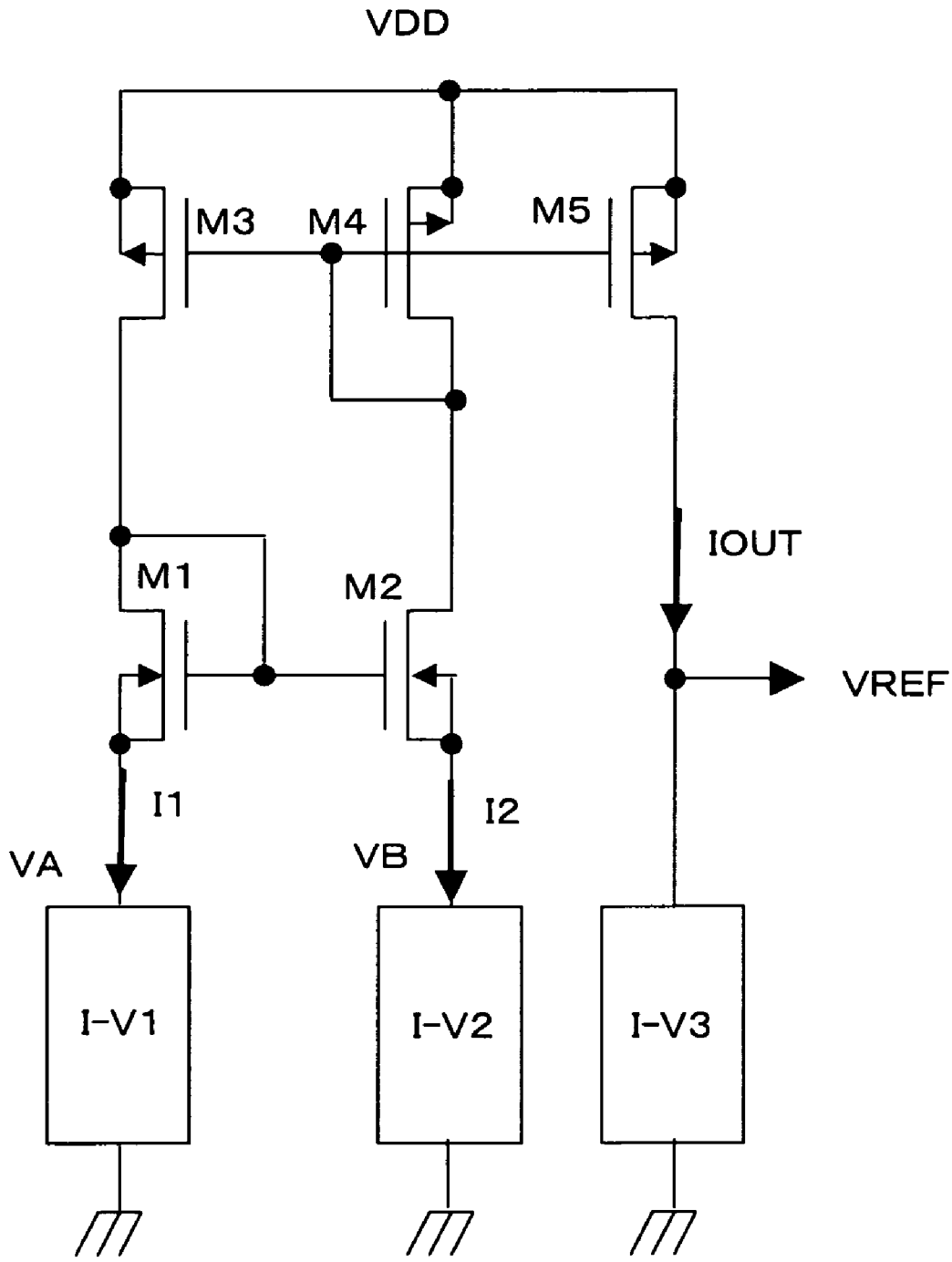
FIG. 24 is a diagram showing a circuit configuration of an embodiment of (claim 6 of) the present invention.
Figure 25:
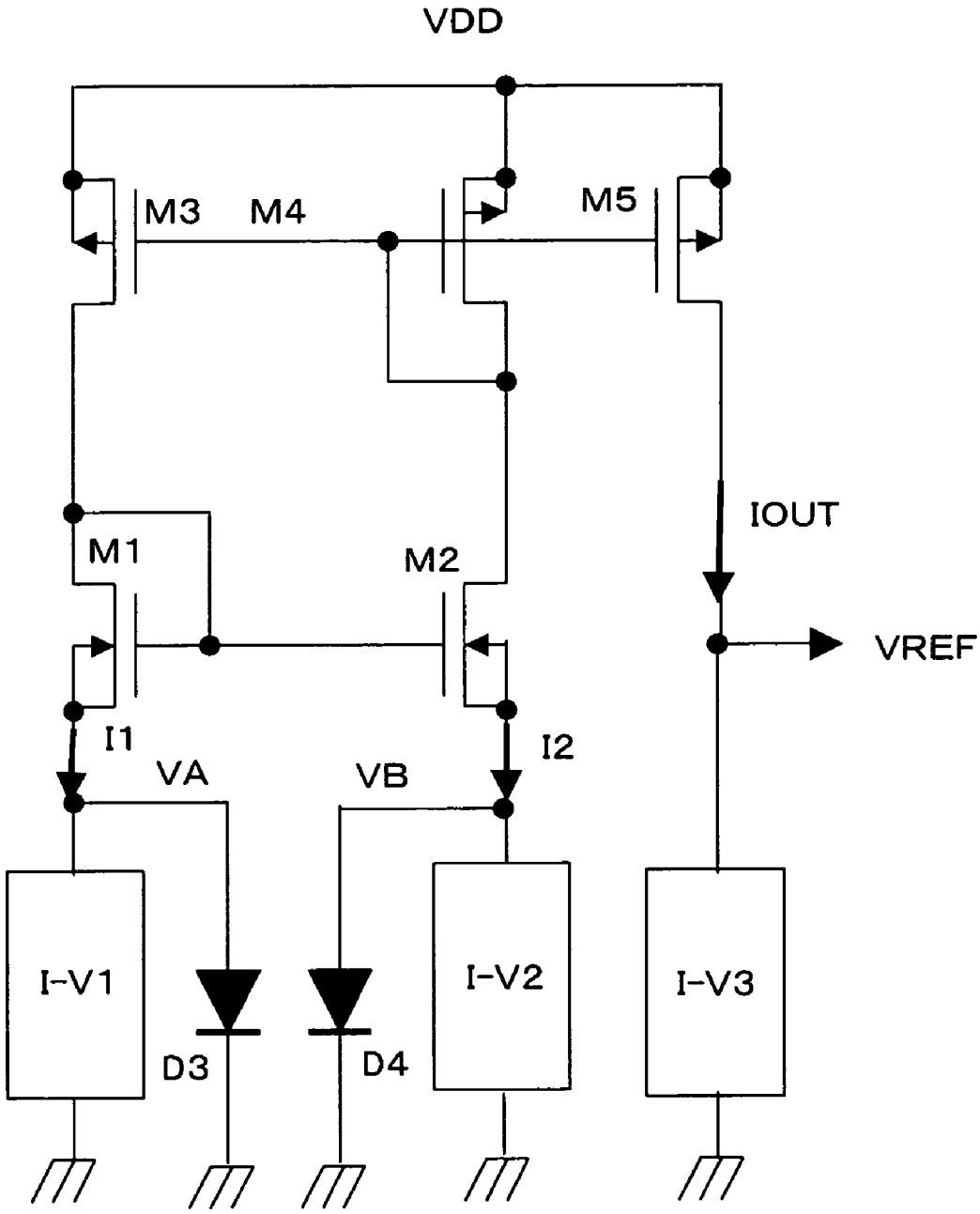
FIG. 25 is a diagram showing a circuit configuration of other embodiment of (claim 6 of) the present invention.

FIGS. 24 and 25 show examples of self-biased reference voltage circuits. For simplicity of the description, a start-up circuit is omitted.

Embodiment 20

Referring to FIG. 24, gates of n-channel transistors M1 and M2 are connected in common, and the gate and a drain of the n-channel transistor M1 are connected in common. Gates of a p-channel transistor M3 and a p-channel transistor M4 (and a p-channel transistor M5) are connected in common. The gate and a drain of the p-channel transistor M4 are connected in common. The n-channel transistors M1 and M2 constitute a current mirror circuit, and the p-channel transistors M3 and M4 and M5 constitute a current mirror circuit. The current mirror circuit constituted from the p-channel transistors M3 and M4 self-biases the current mirror circuit constituted from the n-channel transistors M1 and M2. A drain of the p-channel transistor M5 is connected to the third current-to-voltage conversion circuit (I-V3).

An operation of the present embodiment will be described. Currents that flow through the n-channel transistors M1 and M2 are proportionate to each other. When the transistor sizes of the n-channel transistors M1 and M2 are the same, and when the transistor sizes of the p-channel transistors M3 and M4 are the same, the currents that flow through the n-channel transistors M1 and M2 will become equal.

By being self-biased, respective gate-to-source voltages of the n-channel transistors M1 and M2 become the same. Thus, a voltage to be applied to the first current-to-voltage conversion circuit will become equal to a voltage to be applied to the second current-to-voltage conversion circuit, so that an operating condition in which the above-mentioned OP amp is employed can be implemented. That is, characteristics similar to those in the reference voltage circuit shown in FIG. 3 can be obtained, so that the reference voltage circuit can be implemented.

Embodiment 21

Likewise, as shown in FIG. 25, by performing self-biasing, the OP amp can be omitted. FIG. 25 is obtained by connecting a diode D3 in parallel with the first current-to-voltage conversion circuit (I-V1) and connecting a diode D4 in parallel with the second current-to-voltage conversion circuit (I-V2) in a configuration shown in FIG. 24. Referring to FIG. 25, gates of n-channel transistors M1 and M2 are connected in common, and the gate and a drain of the n-channel transistor M1 are connected in common. Gates of a p-channel transistor M3 and a p-channel transistor M4 (and a p-channel transistor M5) are connected in common. The gate and a drain of the p-channel transistor M4 are connected in common. Accordingly, the n-channel transistors M1 and M2 constitute the current mirror circuit, and the p-channel transistors M3 and M4 (and M5) constitute the current mirror circuit. The current mirror circuit constituted from the p-channel transistors M3 and M4 self-biases the current mirror circuit constituted from the n-channel transistors M1 and M2.

An operation of the present embodiment will be described. Currents that flow through the n-channel transistors M1 and M2 are proportionate to each other. When the transistor sizes of the n-channel transistors M1 and M2 are the same, and when the transistor sizes of the p-channel transistors M3 and M4 are the same, the currents that flow through the n-channel transistors M1 and M2 will become equal.

At any rate, by being self-biased, respective gate-to-source voltages of the n-channel transistors M1 and M2 become the same. Thus, a voltage to be applied to the first current-to-voltage conversion circuit and the diode D3 connected in parallel therewith will become equal to a voltage to be applied to the second current-to-voltage conversion circuit and a diode D4 connected in parallel therewith, so that an operating condition in which the above-mentioned OP amp is employed can be implemented. That is, characteristics similar to those in the reference voltage circuit shown in FIG. 3 can be obtained, so that the reference voltage circuit can be implemented.

In the reference voltage circuits described above, shown in FIGS. 24 and 25, however, the influence of the transistor channel length modulation tends to occur.

Figure 26:
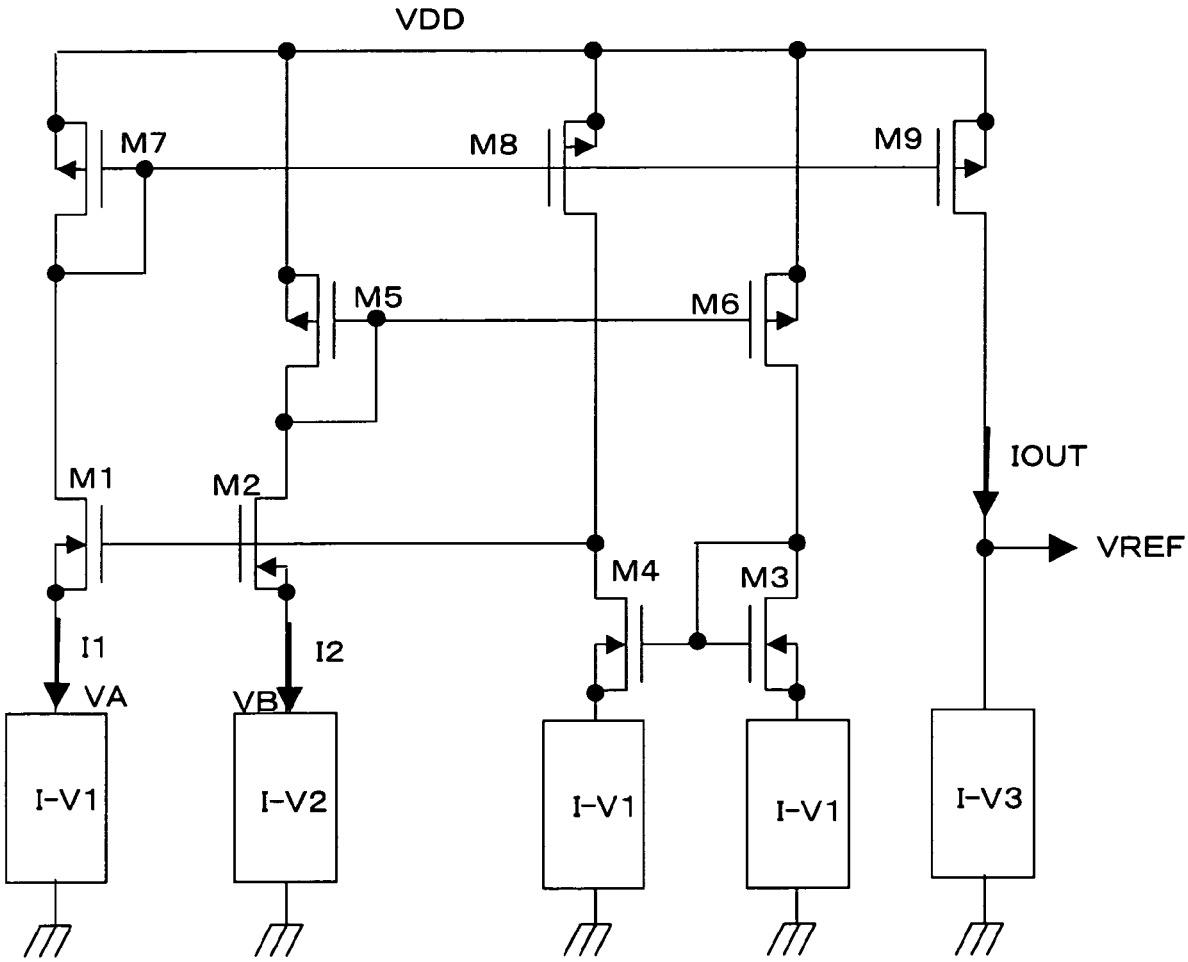
FIG. 26 is a diagram showing a circuit configuration of an embodiment of (claim 7 of) the present invention.
Figure 27:
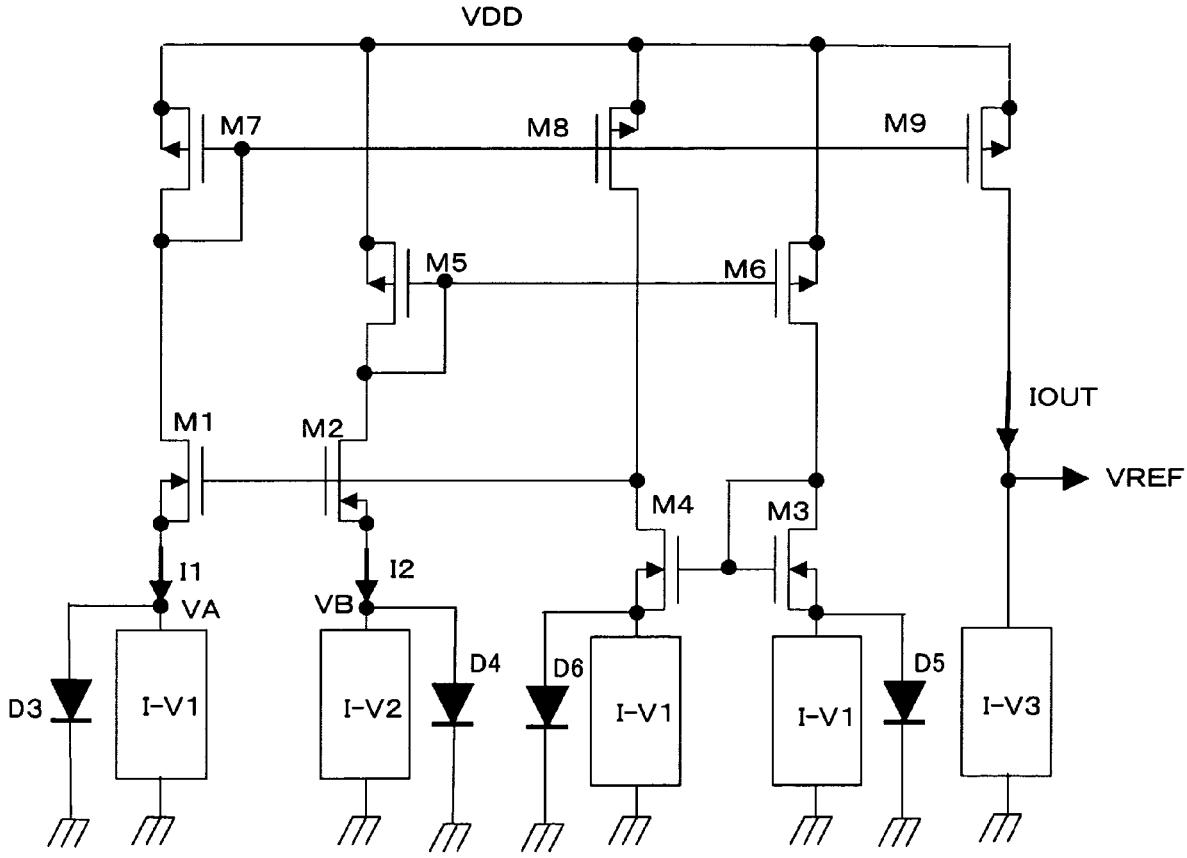
FIG. 27 is a diagram showing a circuit configuration of other embodiment of (claim 7 of) the present invention.

Next, examples of other circuit for reducing the influence of the channel length modulation are shown in FIGS. 26 and 27. For simplicity of the description, the start-up circuit is omitted.

Embodiment 22

Referring to FIG. 26, the circuit includes n-channel transistors M1 and M2 with sources thereof connected to the first and second current-to-voltage conversion circuits (I-V1, I-V2), respectively, a p-channel transistor M7 with a drain and a gate thereof connected to each other and connected between a drain of the n-channel transistor M1 and a power supply VDD, a p-channel transistor M5 with a drain and a gate thereof connected to each other and connected between a drain of the n-channel transistor M2 and the power supply VDD, n-channel transistors M3 and M4 with sources thereof connected to two first current-to-voltage conversion circuits (I-V1) and gates thereof connected in common, a p-channel transistor M8 connected between the n-channel transistor M4 and the power supply VDD, a p-channel transistor M6 connected between the n-channel transistor M3 and the power supply VDD, and a p-channel transistor M9 connected between the third current-to-voltage conversion circuit (I-V3) and the power supply VDD. The n-channel transistors M3 and M4 constitute a current mirror. Gates of the n-channel transistors M1 and M2 are connected in common to a drain of the n-channel transistor M4. Gates of the p-channel transistors M5 and M6 are connected in common, and the p-channel transistors M5 and M6 constitute a current mirror. Gates of the p-channel transistors M7, M8, and M9 are connected in common, and the p-channel transistors M7, M8, and M9 constitute a current mirror.

Referring to FIG. 26, currents that flow through the n-channel transistors M1 and M2 connected to the first and second current-to-voltage conversion circuits, respectively, are compared in a current mirror circuit constituted from the n-channel transistors M3 and M4 through a current mirror circuit constituted from the p-channel transistors M5 and M6 and a current mirror circuit constituted from the p-channel transistors M7 and M8. A common gate voltage of the n-channel transistors M1 and M2 is controlled so that the currents that flow through the n-channel transistors M1 and M2, respectively, are equal.

An operation of the present embodiment will be described. Since respective gate-to-source voltages of the n-channel transistors M1 and M2 become equal, a voltage to be applied to the first current-to-voltage circuit will become equal to a voltage to be applied to the second current-to-voltage circuit. An operating condition that is the same as a case where the above-mentioned OP amp is employed can be implemented. That is, characteristics similar to those in the circuit in FIG. 3 can be obtained, so that the reference voltage circuit can be implemented. The two first current-to-voltage conversion circuits (I-V1) are inserted so that drain voltages of the n-channel transistors M3 and M4 become equal.

Embodiment 23

In an example shown in FIG. 27, a diode is connected in parallel with each of the first and second current-to-voltage circuits (I-V1 and I-V2) in FIG. 26. Referring to FIG. 27, currents that flow through n-channel transistors M1 and M2, respectively, are compared in a current mirror circuit constituted from n-channel transistors M3 and M4 through a current mirror circuit constituted from p-channel transistors M5 and M6 and a current mirror circuit constituted from p-channel transistors M7 and M8. A common gate voltage of the n-channel transistors M1 and M2 is controlled so that the currents that flow through the n-channel transistors M1 and M2, respectively, are equal.

An operation of the present embodiment will be described. Since respective gate-to-source voltages of the n-channel transistors M1 and M2 become equal, a voltage to be applied to the first current-to-voltage circuit and a diode D3 connected in parallel therewith will become equal to a voltage to be applied to the second current-to-voltage circuit and a diode D4 connected in parallel therewith. An operating condition that is the same as the case where the above-mentioned OP amp is employed can be implemented. That is, characteristics similar to those in the circuit in FIG. 3 can be obtained, and the reference voltage circuit can be implemented. The first current-to-voltage conversion circuit and a diode D5 connected in parallel therewith of (I-V1)//D5 and the first current-to-voltage conversion circuit and a diode D6 connected in parallel therewith of (I-V1)//D6 are inserted so that drain voltages of the n-channel transistors M3 and M4 become equal.

Other Embodiment Mode of the Present Invention

Figure 28:
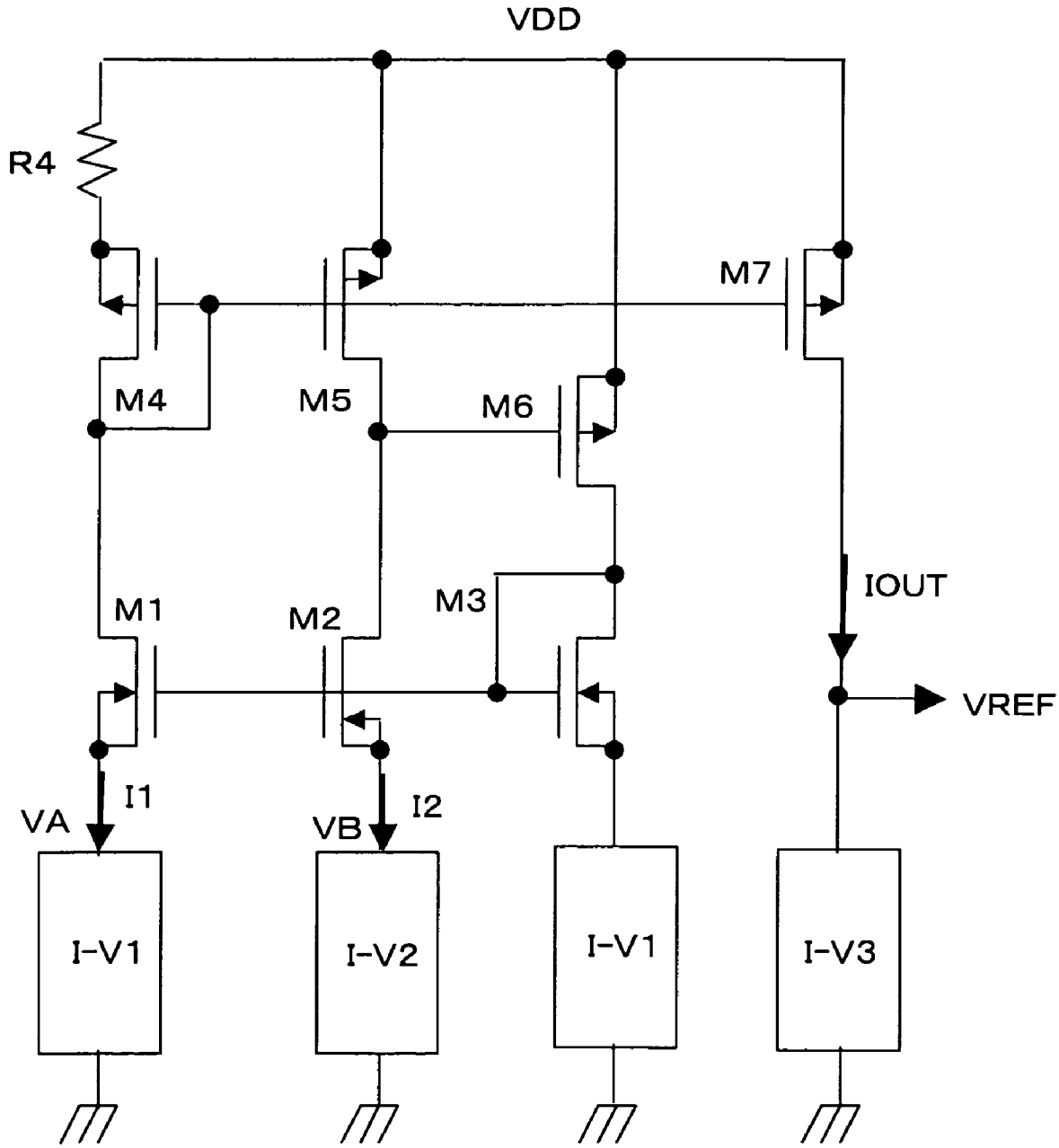
FIG. 28 is a diagram showing a circuit configuration of an embodiment of (claim 8 of) the present invention.
Figure 29:
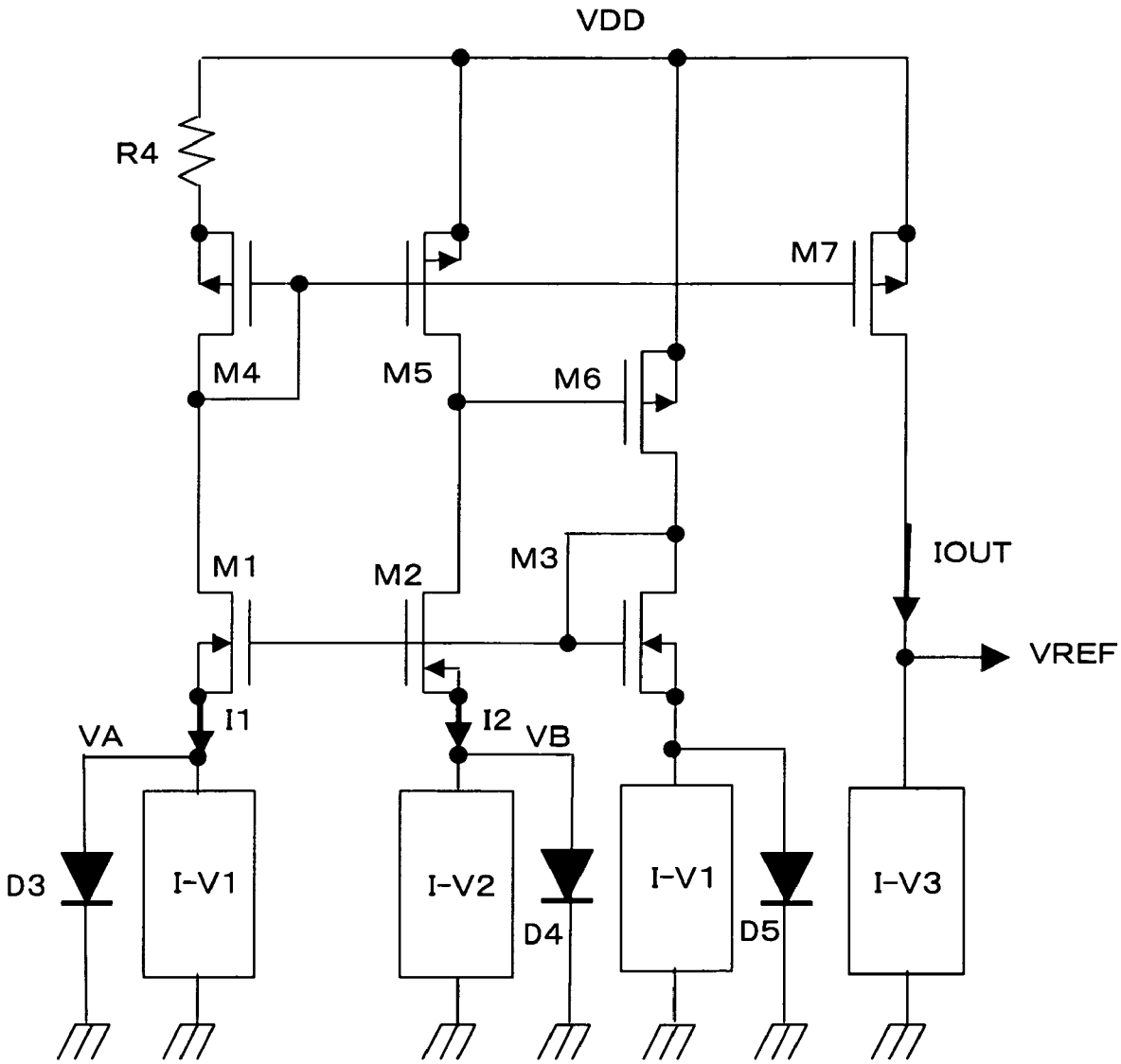
FIG. 29 is a diagram showing a circuit configuration of other embodiment of (claim 8 of) the present invention.

Examples of other circuit for reducing the influence of the channel length modulation will be further shown in FIGS. 28 and 29. For simplicity of the description, the start up circuit will be omitted.

Embodiment 24

Referring to FIG. 28, a resistor R4 is inserted into a source of a p-channel transistor M4, and the p-channel transistor M4 has a gate voltage common to a p-channel transistor M5. Thus, the transistor size of the p-channel transistor M4 is set to be larger than the transistor size of the p-channel transistor M5 so that an equal current may be flown through the p-channel transistors M4 and M5. A current mirror circuit constituted from the p-channel transistors M4 and M5 constitute an inverse Widlar current mirror circuit.

An operation of the present embodiment will be described. When a current that flows through an n-channel transistor M1 is increased, a current that flows through the p-channel transistor M4 is correspondingly increased. However, a current that flows through the p-channel transistor M5 is more increased than it. Thus, an n-channel transistor M2 cannot flow the increased current. Then, a drain voltage of the p-channel transistor M5 is increased, so that a current that flows through a p-channel transistor M6 of which a gate is connected to a drain of the p-channel transistor M5 is reduced. Accordingly, a current that flows through an n-channel transistor M3 of which a drain current is common with the p-channel transistor M6 is also reduced. The n-channel transistor M3 and the n-channel transistor M2 constitute the current mirror circuit. Since the n-channel transistor M1 and the n-channel transistor M2 have a gate voltage thereof in common, a common gate voltage of the transistors M1 to M3 is reduced, so that the current that flows through the n-channel transistor M1 is also reduced.

That is, a current loop constituted from the n-channel transistors M1 to M3 and the p-channel transistors M4 to M6 constitutes a negative feedback circuit, and the common gate voltage of the n-channel transistors M1 and M2 is controlled so that through the inverse Widlar current mirror circuit, the current that flows through the n-channel transistor M1 and a current that flows through the n-channel transistor M2 assume predetermined values or equal values in this example.

Since respective gate-to-source voltages of the n-channel transistors M1 and M2 become equal, a voltage to be applied to the first current-to-voltage circuit becomes equal to a voltage to be applied to the second current-to-voltage circuit. An operating condition that is the same as the case where the above-mentioned OP amp is employed can be implemented. That is, characteristics similar to those in the circuit in FIG. 3 can be obtained, so that the reference voltage circuit can be implemented. The two first current-to-voltage conversion circuits (I-V1) are inserted so that drain voltages of the n-channel transistors M3 and M4 become equal.

Embodiment 25

In an example shown in FIG. 29, a diode is connected in parallel with each of the first and second current-to-voltage conversion circuits (I-V1 and I-V2) in FIG. 28. Referring to FIG. 29, a resistor R4 is inserted into a source of a p-channel transistor M4, and the p-channel transistor M4 has a gate voltage common to a p-channel transistor M5. Thus, the transistor size of the p-channel transistor M4 is set to be larger than the transistor size of the p-channel transistor M5 so that equal currents may be flown through the p-channel transistors M4 and M5. A current mirror circuit constituted from the p-channel transistors M4 and M5 constitute an inverse Widlar current mirror circuit.

An operation of the present embodiment will be described. When a current that flows through an n-channel transistor M1 is increased, a current that flows through the p-channel transistor M4 is correspondingly increased. However, a current that flows through the p-channel transistor M5 is more increased. Thus, an n-channel transistor M2 cannot flow the increased current. Then, a drain voltage of the p-channel transistor M5 is increased, so that a current that flows through a p-channel transistor M6 of which a gate is connected to a drain of the p-channel transistor M5 is reduced.

Accordingly, a current that flows through an n-channel transistor M3 of which a drain current is common is also reduced. The n-channel transistor M3 and the n-channel transistor M2 constitute a current mirror circuit. Since the n-channel transistor M1 and the n-channel transistor M2 have a gate voltage thereof in common, a common gate voltage of the transistors M1 to M3 is reduced, so that the current that flows through the n-channel transistor M1 is also reduced.

That is, a current loop constituted from the n-channel transistors M1 to M3 and the p-channel transistors M4 to M6 constitutes a negative feedback circuit, and the common gate voltage of the n-channel transistors M1 and M2 is controlled so that through the inverse Widlar current mirror circuit, the current that flows through the n-channel transistor M1 and a current that flows through the n-channel transistor M2 assume predetermined values (or equal values in this example).

Since respective gate-to-source voltages of the n-channel transistors M1 and M2 become equal, a voltage to be applied to the first current-to-voltage circuit and a diode D3 connected in parallel therewith becomes equal to a voltage to be applied to the second current-to-voltage circuit and a diode D4 connected in parallel therewith. An operating condition that is the same as the case where the above-mentioned OP amp is employed can be implemented.

That is, characteristics similar to those in a circuit in FIG. 9 can be obtained, and the reference voltage circuit can be implemented. Two first current-to-voltage conversion circuits (I-V1) and a diode D5 connected in parallel therewith are inserted so that drain voltages of the n-channel transistors M3 and M1 become equal.

Other Embodiment Mode of the Present Invention

Further, by replacing the diodes with bipolar transistors, the reference voltage circuit can be operated at a lower voltage. Each of FIGS. 30 to 34 shows a circuit that uses the bipolar transistors. In this case, a bipolar transistor Q1 and a bipolar transistor Q2 constitute a non-linear current mirror circuit. This is an analogy from the conventional inverse Widlar current mirror circuit. For simplicity of the description, the start-up circuit is omitted.

Embodiment 26

Figure 30:
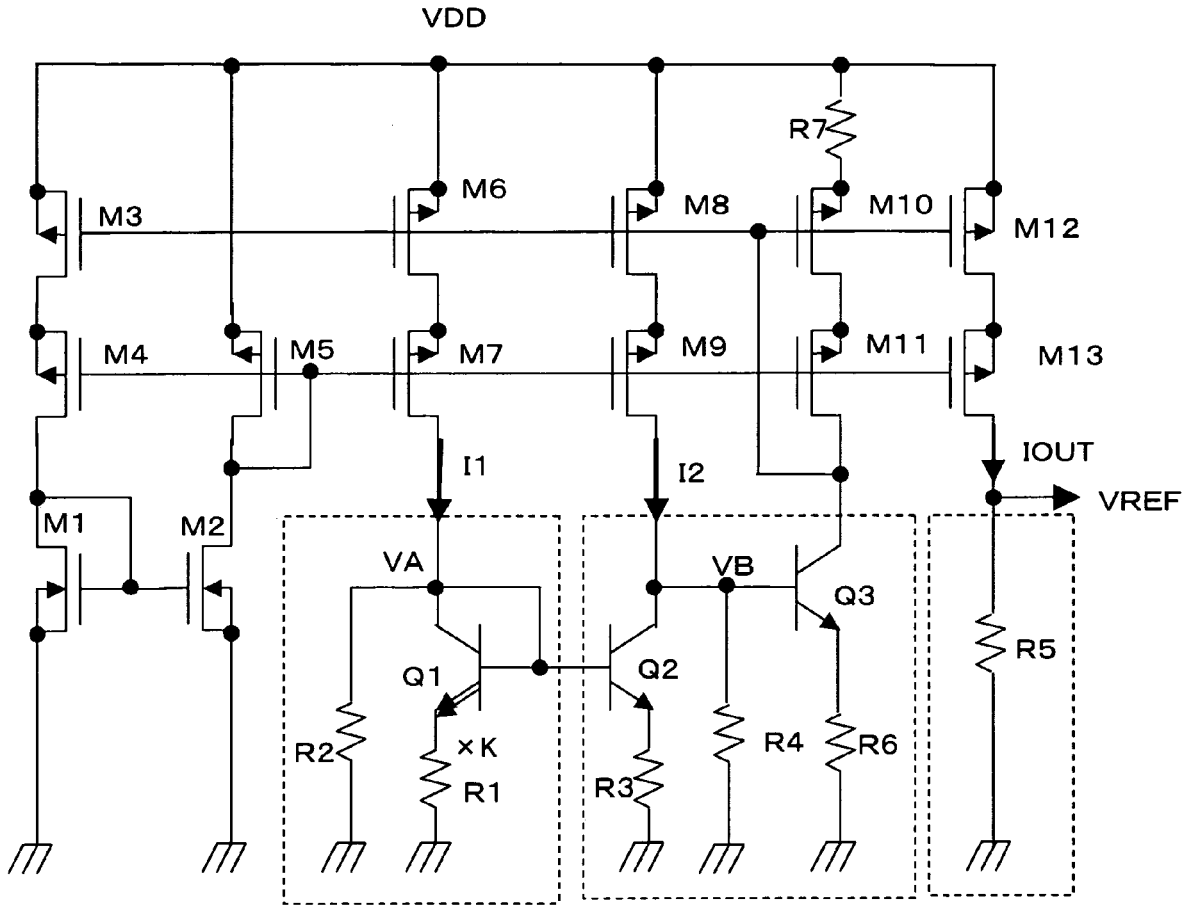
FIG. 30 is a diagram showing a circuit configuration of a first embodiment of (claim 9 of) the present invention.
Figure 31:
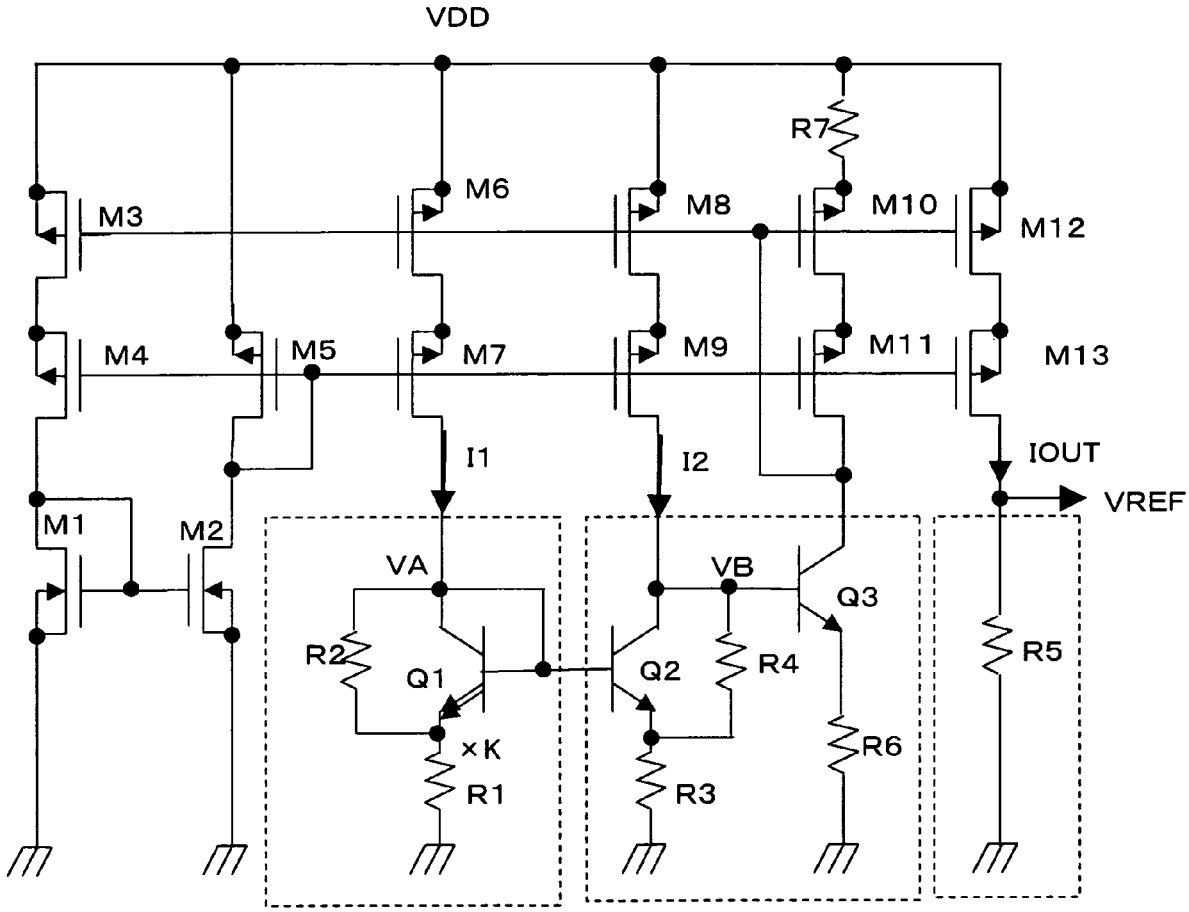
FIG. 31 is a diagram showing a circuit configuration of a second embodiment of (claim 9 of) the present invention.
Figure 32:
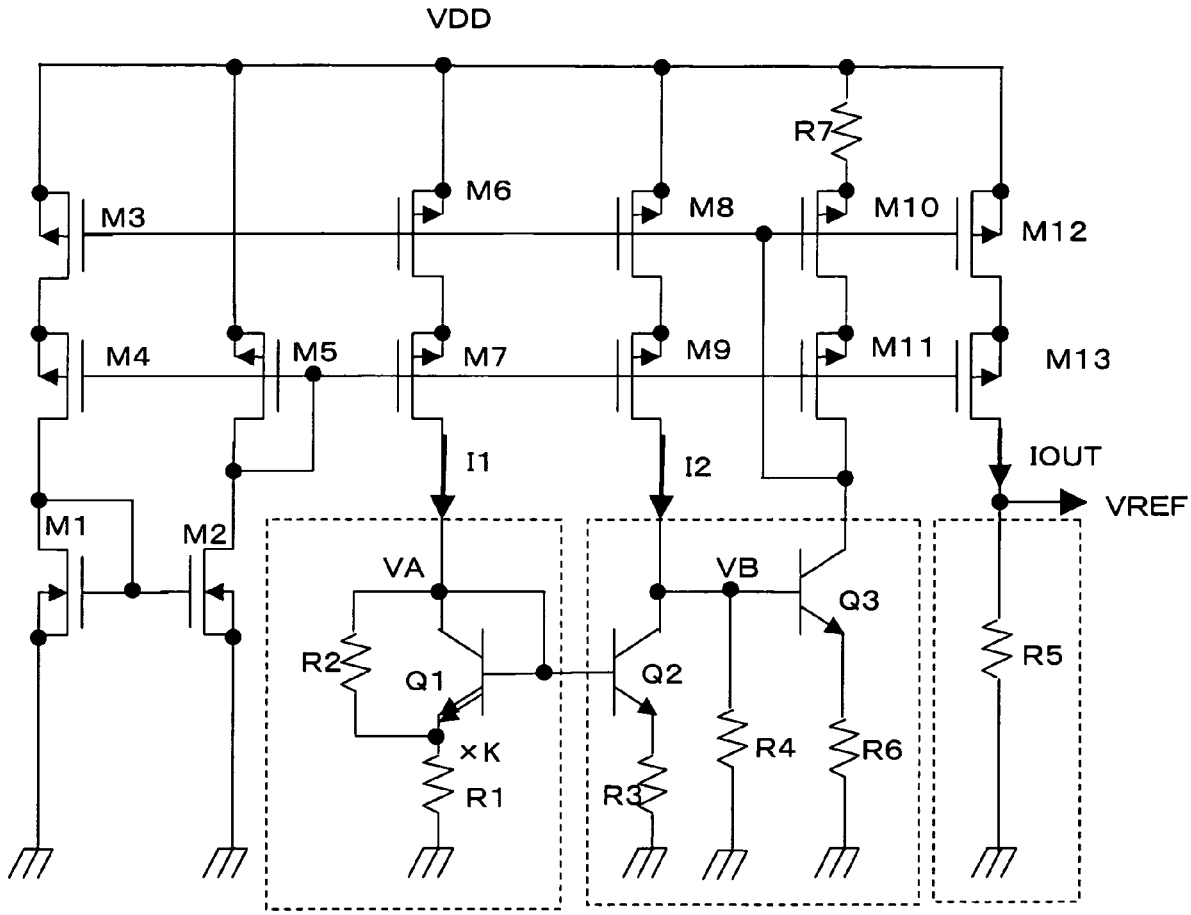
FIG. 32 is a diagram showing a circuit configuration of a third embodiment of (claim 9 of) the present invention.
Figure 33:
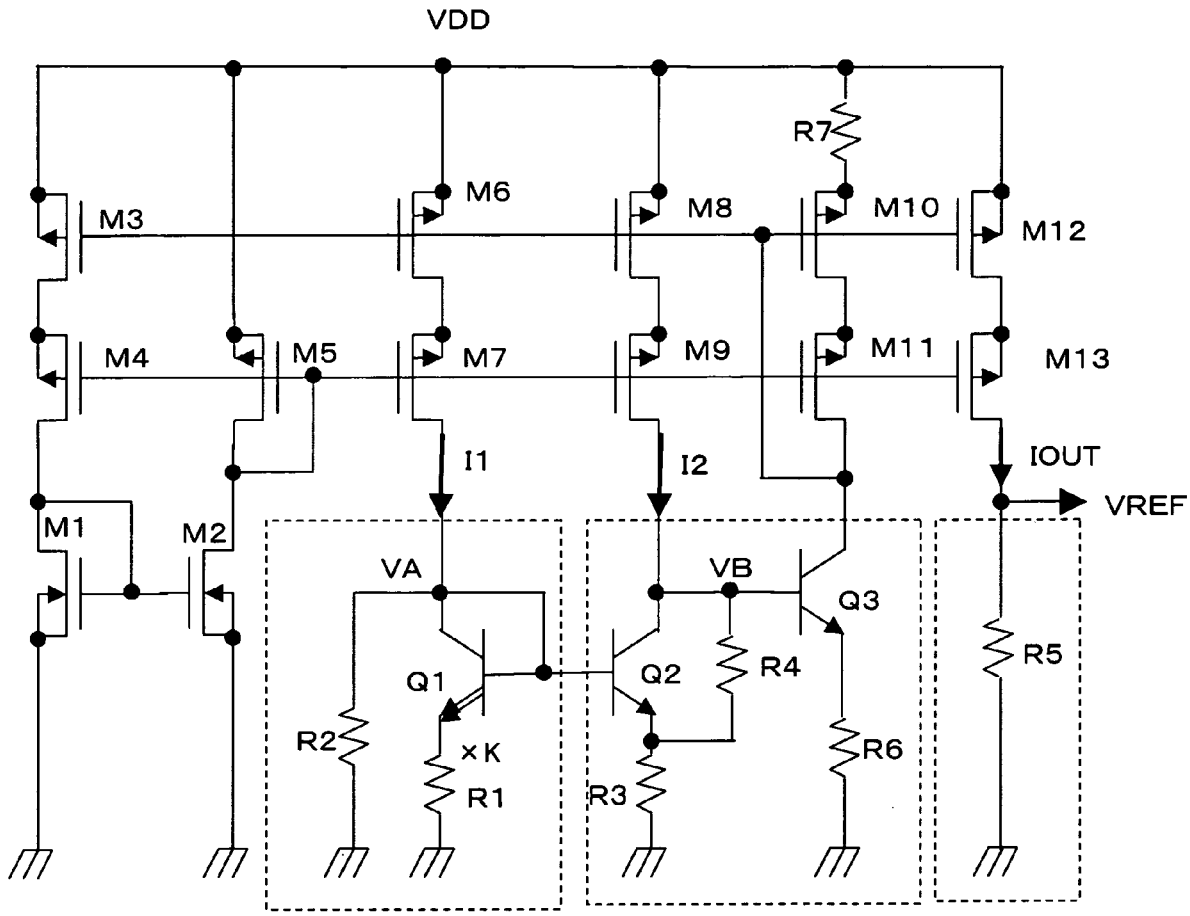
FIG. 33 is a diagram showing a circuit configuration of a fourth embodiment of (claim 9 of) the present invention.

Referring to FIG. 30, an emitter size ratio between a bipolar transistor Q1 and a bipolar transistor Q2 that constitute the first current-to-voltage conversion circuit (I-V1) and the second current-to-voltage conversion circuit (I-V2), respectively is K1 (where K>1). The transistor Q1 constitutes a current mirror circuit having an emitter resistor R1, and the transistor Q2 constitutes a current mirror circuit having an emitter resistor R3 (where R1>R3).

Further, a resistor R2 is inserted between a common base of the bipolar transistors Q1 and Q2 and a ground (GND). A resistor R4 is inserted between a base of a bipolar transistor Q3 on the side of a collector of the bipolar transistor Q2 and the ground (GND). Herein, the resistor R2 is assumed to be equal to the resistor R4. P-channel transistors M6 and M7 are cascode-connected between a collector of the bipolar transistor Q1 of the first current-to-voltage conversion circuit (I-V1) and the power supply VDD. P-channel transistors M8 and M9 are cascade-connected between a collector of the bipolar transistor Q3 of the second current-to-voltage conversion circuit (I-V2) and the power supply VDD. P-channel transistors M10 and M11 are cascode-connected between a collector of the bipolar transistor Q3 and the power supply VDD. P-channel transistors M12 and M13 are cascode-connected between the power supply and an other end of a resistor R5 with one end thereof connected to the ground. P-channel transistors M3 and M4 are cascode-connected between an n-channel transistor M1 of the n-channel transistor M1 and an n-channel transistor M2 that constitute a current mirror circuit and the power supply VDD. A diode-connected p-channel transistor M5 is connected between the n-channel transistor M2 and the power supply. Gates of the p-channel transistors M3, M6, M8, M10, and M12 are connected in common, while gates of the p-channel transistors M4, M5, M7, M9, M11, and M13 are connected in common. A resistor R7 is connected between a source of the transistor M10 and the power supply.

An operation of the present embodiment will be described. Now, it is assumed that base currents of the bipolar transistors can be neglected, and a collector voltage VA of the bipolar transistor Q1 becomes equal to a collector voltage VB of the bipolar transistor Q2 when a current that flows through the bipolar transistor Q1 is equal to a current that flows through the bipolar transistor Q2.

At this point, a collector current (IC1) of the bipolar transistor Q1 and a collector current (IC2) of the bipolar transistor Q2 are expressed as follows:

$$\begin{aligned} IC(IC1 = IC2) &= (VBE2 - VBE1)/(R1 - R3) \\ &= \Delta VBE/(R1 - R3) \\ &= V_T \ln(K)/(R1 - R3) \end{aligned} \tag{109}$$

When the collector current (IC1) of the bipolar transistor Q1 is increased to be larger than the value of IC in Equation (109), a common base voltage of the bipolar transistors Q1 and Q2 is increased. However, the common base voltage is the sum of a voltage VBE1 and a voltage R1IC1, and is also the sum of a voltage VBE2 and a voltage R31C2. As is well known, an increase in a base-to-emitter voltage VBE caused by an increase in the collector current is logarithmically compressed. The increase of the VBE therefore is confined to be some degree.

An increase in a voltage drop at the emitter resistor is proportionate to the increase in the collector current. Since the value of the resistor R1 is larger than the value of the resistor R3, an increment in a voltage drop at the emitter resistor R1 becomes larger than an increment in a voltage drop at the emitter resistor R3. Accordingly, the collector current ($I_{C2}$) of the bipolar transistor Q2 is going to become larger than the collector current ($I_{C1}$) of the bipolar transistor Q1. However, when drive currents for the bipolar transistors Q1 and Q2 are set to be equal, the bipolar transistor Q2 uses as the collector current ($I_{C2}$) a part of current which is for flowing through the resistor R4. Thus, the terminal voltage of the resistor R4 falls to reduce a base voltage of the bipolar transistor Q3.

Accordingly, a collector current ($I_{C3}$) of the bipolar transistor. Q3 will be reduced. This collector current ($I_{C3}$) of the bipolar transistor Q3 is a drive current for the cascade-connected transistors M10 and M11.

The resistor R7 is inserted between the cascoded transistors M10 and M11 and the power supply VDD. The cascoded transistors M10 and M11, cascoded transistors M6 and M7, and cascoded transistors M8 and M9 constitute an inverse Widlar current mirror circuit.

When a current that flows through the cascoded transistors M10 to M11 is increased, currents that flow through the cascoded transistors M6 and M7 and M8 and M9 are increased. Equal currents flow through the cascoded transistors M6 and M7 and the cascoded transistors M8 and M9. As a result, with the increase of the current that flows through the cascoded transistors M6 to M7, the current that flows through the bipolar transistor Q1 is increased, and the current that flows through the resistor R1 is also increased. The current that flows through the bipolar transistor Q2 is further increased, so that the current that flows through the resistor R4 is reduced. The base voltage of the bipolar transistor Q3 is reduced, thereby operating to reduce the current that flows through the cascoded transistors M10 to M11. The current that flows through the cascoded transistors M6 and M7 will also be reduced to be fixed at a predetermined current value.

That is, it can be seen that among the bipolar transistors Q1 to Q3 and the inverse Widlar current mirror circuits that constitutes a self-biasing circuit, a negative feedback current loop is formed.

The current that flows through the cascoded transistors M6 to M7 at this point is expressed as follows:

$$\begin{aligned} I1 &= IC + (VBE1 + ICR1)/R2 \\ &= [VBE1 + \{(R1 + R2)/(R1 - R3)\} V_T \ln(K)]/R2 \\ &= [VBE1 + \{(R1 + R2)/(R1 - R3)\} \Delta VBE]/R2 \\ &= [VBE2 + \{(R2 + R3)/(R1 - R3)\} \Delta VBE]/R2 \end{aligned} \tag{110}$$

When the current that flows through the cascoded transistors M6 and M7 is set to be equal to a current IOUT that flows through cascoded transistors M12 and M13, the following equations hold:

$$\begin{aligned} VREF &= R5IOUT \\ &= (R5/R2)[VBE1 + \{(R1 + R2)/(R1 - R3)\}\Delta VBE] \\ &= (R5/R2)[VBE2 + \{(R3 + R2)/(R1 - R3)\}\Delta VBE] \end{aligned} \tag{111}$$

The voltage VBE1 has a temperature coefficient of approximately −1.9 mV/° C. The voltage VBE2 also has a temperature coefficient of approximately −1.9 mV/° C. As is well known, a voltage ΔVBE has a positive temperature characteristic in this circuit as well, which is proportionate to the thermal voltage $V_T$ (a temperature coefficient thereof being 0.0853 mV/° C.).

That is, the temperature characteristics of the term [VBE1 +{(R1+R2)/(R1−R3)}ΔVBE] in Equation (110) can be compensated by setting a resistor ratio {(R1+R2)/(R1−R3)} and performing weighting of the voltage ΔVBE having the positive temperature characteristic by the resistor ratio {(R1+R2)/(R1−R3)} and adding the resulting voltage to the voltage VBE1 having the negative temperature characteristic.

Accordingly, it can be seen that when the voltage VBE1 is set to become approximately 580 mV at ambient temperature, the voltage VBE2 will become 620 mV at the ambient temperature, and the voltage [VBE1+{(R1+R2)/(R1−R3)}ΔVBE] will likewise become approximately 1.2 V.

Further, the resistor ratio (R5/R2) has zero temperature coefficient. Thus, the reference voltage VREF to be output becomes the voltage in which temperature characteristics thereof have been compensated.

In this case, the resistor ratio (R5/R2) can be arbitrarily set. Then, when the resistor ratio (R5/R2) is set to be larger than 1, the voltage VREF becomes larger than 1.2 V. When the resistor ratio (R5/R2) is set to be smaller than 1, the voltage VREF becomes lower than 1.2 V. These phenomena are the same as those with the prior art. Especially when the resistor ratio (R5/R2) is set to be smaller than 1 that makes the voltage VREF to be lower than 1.2 V, the supply voltage can be reduced. When the voltage VREF is set to 0.8 V, for example, the reference voltage circuit can be operated at the supply voltage of approximately 1.2 V or higher.

Embodiment 27

Figure 34:
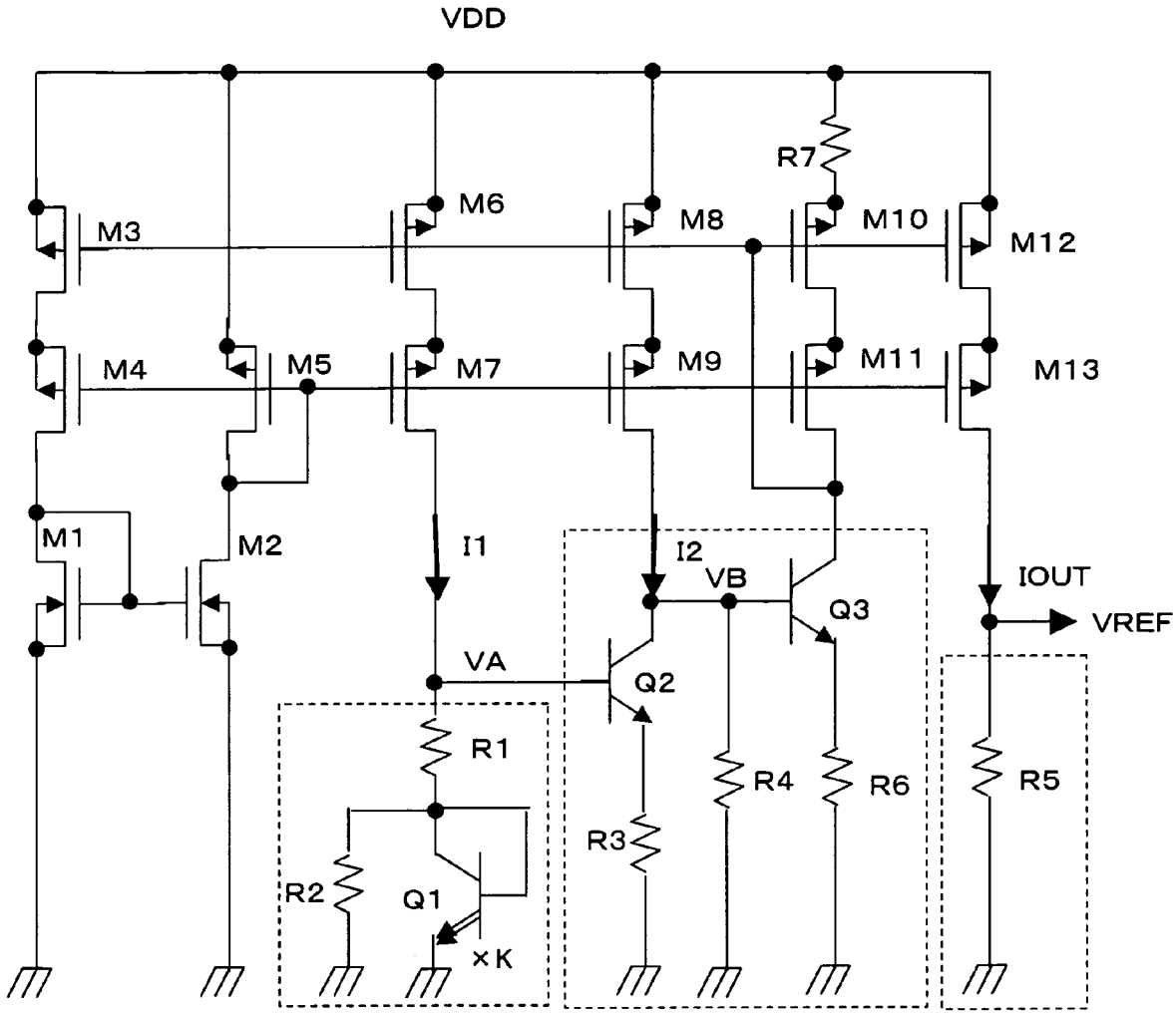
FIG. 34 is a diagram showing a circuit configuration of a fifth embodiment of (claim 9 of) the present invention.

Likewise, the circuit can be changed to each of those in FIGS. 31 to 34. The circuit in FIG. 34 is equivalent to the circuit in FIG. 32, in which interchange among circuit elements connected in series (specifically, a diode-connected bipolar transistor Q1 and a resistor R2 connected in parallel with the diode-connected bipolar transistor Q1 and a resistor R1 connected in series with those elements) is performed. In both of the circuits, the circuit analysis by hand calculation is difficult.

An operation of the present embodiment will be described. In FIGS. 31 to 34 as well, as in the case shown in FIG. 30, when a current that flows through cascoded transistors M6 to M7 is increased, a current that flows through the bipolar transistor Q1 is increased, and a current that flows through the resistor R1 is also increased. A current that flows through a bipolar transistor Q2 is further increased, so that a current that flows through a resistor R4 is reduced. A base voltage of a bipolar transistor Q3 is reduced. A current that flows through the bipolar transistor Q3 is thus reduced, thereby operating to reduce a current that flows through cascoded transistors M10 to M11. The current that flows through the cascoded transistors M6 to M7 will also be reduced to be fixed at a predetermined current value.

That is, it can be seen that among the bipolar transistors Q1 to Q3 and an inverse Widlar current mirror circuit that constitutes a self-biasing circuit, a negative feedback current loop is formed.

Accordingly, in any circuit of FIGS. 31 to 34, it is controlled so that a base voltage of the bipolar transistor Q2 becomes equal to the base voltage of the bipolar transistor Q3. The compensation of the temperature characteristic is carried out by weighting a current which has a positive temperature characteristic and which is proportionate to the difference voltage ΔVBE between the voltage VBE of the bipolar transistor Q1 and the voltage VBE of the bipolar transistor Q2 with respective resistance values of the resistors R1 to R4 and adding the resulting current to a current having a negative temperature characteristic proportionate to the VBE of the bipolar transistor (by actually reducing only temperature characteristics of the resistors). Then, by converting the resulting current to a voltage through the resistor, an arbitrary reference voltage having zero temperature coefficient can be obtained.

Other Embodiment Mode of the Present Invention

The reference voltage circuit shown in FIG. 30 can be modified such that the current is branched into the currents that flow through the bipolar transistors and the currents that flow through the resistors connected in parallel with therewith, thereby setting the drive currents.

Embodiment 28

Figure 35:
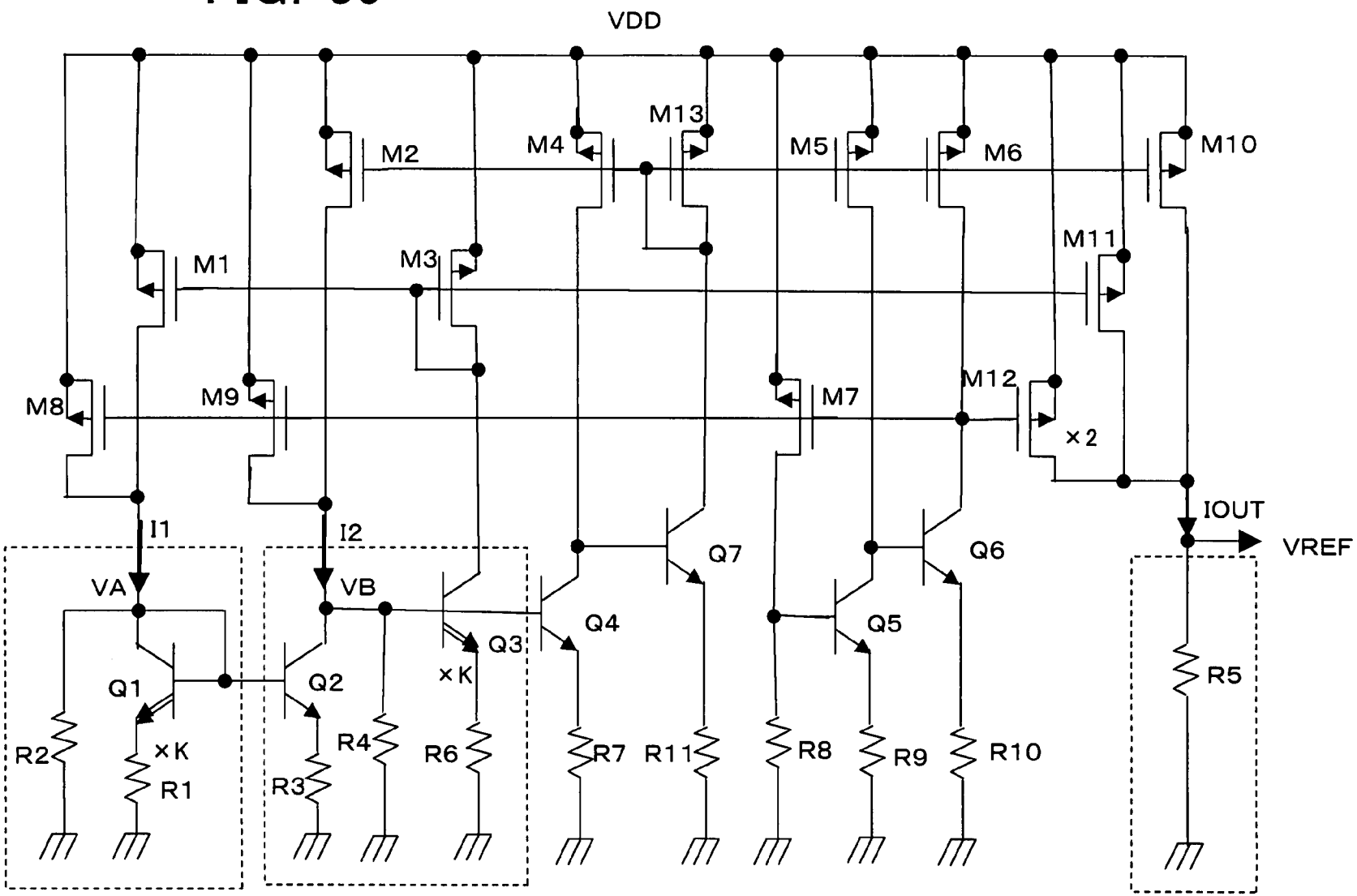
FIG. 35 is a diagram showing a circuit configuration of a first embodiment of (claim 10 of) the present invention.

FIG. 35 shows a circuit when a self-biasing system of the reference voltage circuit shown in FIG. 30 is modified such that the current is branched into the currents that flow through the bipolar transistors and the currents that flow through the resistors connected in parallel with therewith, thereby setting the drive currents. In this case, for simplicity of the description, the start-up circuit is omitted. A p-channel transistor M8 and a p-channel transistor M1 that have been diode-connected are connected in parallel between a collector of a transistor Q1 of the first current-to-voltage conversion circuit (I-V1) and the power supply. A p-channel transistor M9 and a p-channel transistor M2 that have been diode-connected are connected in parallel between a collector of the transistor Q2 of the second current-to-voltage conversion circuit (I-V2) and the power supply. A diode-connected p-channel transistor M3 is connected between a collector of a transistor Q3 and the power supply. P-channel transistors M4 and M13 are connected between a transistor Q4 and the power supply and between a transistor Q7 and the power supply, respectively. A p-channel transistor M7 is connected between the power supply and a connecting point between a base of a transistor Q5 and a resistor R8, a p-channel transistor M5 is connected between a collector of a transistor Q5 and the power supply, a p-channel transistor M6 is connected between a collector of a transistor Q6 and the power supply. P-channel transistors M10, M11, and M12 are connected in parallel between a resistor R5 of the third current-to-voltage conversion circuit (I-V3) and the power supply. Gates of the transistors M2, M4, M13, M5, M6, and M10 are connected in common to a collector of the transistor Q6. The gates of the transistors M1, M3, M13, and M11 are connected in common to the collector of the transistor Q6. The gates of the transistors M8, M9, M13, M7, M6 and M12 are connected in common to the collector of the transistor Q6. A W/L ratio of the transistor M8 in this case is set to be twice as large as that of the unit transistor M11 or M10.

The transistor size of the bipolar transistor Q1 is assumed to be k times that of the transistor Q2, which is a unit bipolar transistor.

The transistor size of the bipolar transistor Q3 is assumed to be k times that of the transistor Q3, which is the unit bipolar transistor.

It is assumed that the resistors R2, R4, and R8 are set to be equal, the resistors R1 is set to be equal to the resistor R6, and the resistors R3, R7, R9, and R11 are set to be equal.

Each of the bipolar transistor Q5 and the bipolar transistor Q6 to be driven by the MOS transistors M5 and M6, respectively, constitutes a negative phase amplifier, thereby constituting a positive phase amplifier in two stages. That is, an output of this two-stage (positive phase) amplifier is connected to a gate of the MOS transistor M7. A drain output current of the MOS transistor M7 is grounded through the resistor R8. The other terminal of the resistor R8 is connected to a base of the (unit) bipolar transistor Q5.

On the other hand, the MOS transistor M4 and the bipolar transistor Q4 that is driven by M4 constitute a negative phase amplifier. The diode-connected MOS transistor M13 and the bipolar transistor Q7 constitute a positive phase amplifier. A negative phase amplifier is thereby constituted in two stages.

Further, the MOS transistors M2 and M9 and the bipolar transistor Q2 that is driven thereby constitute a negative phase amplifier. The diode-connected MOS transistor M3 and the bipolar transistor Q3 constitute a positive phase amplifier to the contrary. A negative phase amplifier is thereby likewise constituted in two stages.

The gates of the MOS transistors M7, M8, and M9 are connected to one another, thereby constituting a current mirror circuit having a current ratio of 1:1:1.

Likewise, the gates of the MOS transistors M1 and M2 are connected in common, thereby constituting a current mirror circuit with a current ratio of 1:1. The gates of the MOS transistors M13, M2, and M4 are connected in common, thereby constituting a current mirror circuit with a current ratio of 1:1:1.

An operation of the present embodiment will be described. First, a description that a collector voltage (=base voltage) VA of the diode-connected bipolar transistor Q1 becomes equal to a collector voltage of the (unit) bipolar transistor Q5 will be made.

The bipolar transistor Q5 and the resistor R9, the bipolar transistor Q6 and the resistor R10, the bipolar transistor Q7 and the resistor R11 are all copies of the bipolar transistor Q2 and the resistor R3. The resistor R8 is the copy of the resistor R2 (=R4).

The bipolar transistor Q3 and the resistor R6 are the copy of the bipolar transistor Q1 and the resistor R1. The bipolar transistor Q4 and the resistor R7 are the copy of the bipolar transistor Q2 and the resistor R3.

Accordingly, a current that flows in common through the bipolar transistor Q7 and the resistor R11 is copied through the MOS transistor M13 to the MOS transistors M2, M4, M5 and M6 that constitute the current mirror circuit with the MOS transistor M13. Accordingly, by an output signal of the two-stage (positive phase) amplifier constituted from the bipolar transistor Q5, resistor R9, load transistor M5, bipolar transistor Q6, resistor R10, and load transistor M6, the currents that pass through the MOS transistors are controlled. A terminal voltage of the grounded resistor R8 will be controlled through a negative feedback path (loop) so that the current that passes in common through the bipolar transistor Q5 and the resistor R9 becomes equal to the current that passes in common through the bipolar transistor Q6 and the resistor R10. Accordingly, equal currents are supplied to the bipolar transistor Q2, resistor R3, and resistor R4 connected in parallel with the bipolar transistor Q2 and the resistor R3 through the MOS transistor M2 that constitutes the current mirror circuit with this MOS transistor M4.

The current that flows in common through the bipolar transistor Q3 and the resistor R6 is copied through the MOS transistor M3 to the MOS transistor M1 that constitutes a current mirror circuit with the MOS transistor M3. Accordingly, a current which is equal to the current that flows in common through this bipolar transistor Q3 and the resistor R6 is supplied to the bipolar transistor Q1 and the resistor R1, and the resistor R2 connected in parallel with the bipolar transistor Q1 and the resistor R1.

The MOS transistors M2 and M9, bipolar transistor Q2, resistor R3, and resistor R4 connected in parallel therewith in this case constitute a negative phase amplifier and constitute a negative feedback path, thereby operating to cause the current that flows in common through the bipolar transistor Q3 and the resistor R6 to become a predetermined value.

The current that flows in common through the bipolar transistor Q7 and the resistor R11 is copied through the MOS transistor M13 to the MOS transistors M4 and M2 that constitute the current mirror circuit with the MOS transistor M13. Accordingly, a current which is equal to the current that flows in common through this bipolar transistor Q7 and the resistor R11 is supplied to the bipolar transistor Q2 and the resistor R3, and the resistor R4 connected in parallel with the bipolar transistor Q2 and the resistor R3.

The MOS transistor M4, bipolar transistor Q4, and resistor R7 in this case constitute a negative phase amplifier and constitute a negative feedback path, thereby operating to cause the current that flows in common through the bipolar transistor Q7 and the resistor R11 to become a predetermined value.

As described above, by constituting two folded negative feedback paths, the value of the current that flows through the current mirror circuit constituted from the MOS transistor M3 and the MOS transistor M1 and the value of the current that flows through the current mirror circuit constituted from the MOS transistors M13, M2, and M4 are set to the predetermined values.

On the other hand, a current that flows through the resistor R8 is copied through the MOS transistor M7 to the MOS transistors M8 and M9 that constitute the current mirror circuit with the MOS transistor M7. Accordingly, it can be seen that the drive current I1 that generates the terminal voltage VA is a sum of the current that flows in common through the bipolar transistor Q3 and the resistor R6 and the current that flows through the resistor R8, and that the drive current I2 that generates the terminal voltage VB is a sum of the current that passes in common through the bipolar transistor Q4 and the resistor R7 and the current that flows through the resistor R8.

A base of the bipolar transistor Q1 and a base of the bipolar transistor Q2 are connected in common, and their terminal voltage is the voltage VA, and a base of the bipolar transistor Q3 and the base of the bipolar transistor Q4 are connected in common, and their terminal voltage is the voltage VB.

Since the values of the resistors R2, R4, and R8 are all equal, and currents that flow through the resistors R2 and R4 and the currents that flow through the resistor R8 are all equal, the terminal voltage VA becomes equal to the terminal voltage VB.

As described above, in the present invention, the three negative feedback paths are constituted. The drive currents I1 and I2 are thereby set to the predetermined values. When an emitter area ratio K of the bipolar transistor Q3 (=Q1), and the resistor R6 (=R1) and the resistor R7 (=R3) (in which the resistor R6 is larger than the resistor R7) are set, the voltage value VB (=VA) larger than zero are uniquely determined when the circuit is turned on.

Now, assume that the resistor R6 (=R1) and the resistor R7 (=R3), in which the value of the resistor R6 is larger than the value of the resistor R7, are set in order to set the current I1 to be equal to the current I2. In this case, when a slight difference 6 between a current IC4 that flows through the bipolar transistor Q4 and the current IC3 that flows through the bipolar transistor Q3 is generated, (or when IC3=(1+δ)IC4), the following expressions are given:

$$\begin{aligned}\Delta VBE &= VBE4 - VBE3 \\ &= V_T In\{K/(1+\delta)\} \\ &= R6I_{C3} - R7I_{C4} \\ &= \{R6(1+\delta) - R7\}I_{C4}\end{aligned} \tag{112}$$

A current ratio difference is canceled by setting the values of the resistors R6 and R7 again.

In other words, by setting the values of the resistors R6 and R7, the drive current I1 can be made to be equal to the drive current I2. At any rate, the voltage VA is set to be equal to the voltage VB. That is, the voltage VA is set to be equal to the voltage VB. That is, an operating condition which is the same as that in the reference voltage circuit in FIG. 30 is implemented.

When the MOS transistors M10 and M11 are set to the unit MOS transistors, and the transistor size of the MOS transistor M12 is set to be twice as large as the transistor size of the unit MOS transistor, the MOS transistors M13 and M10 form a current mirror circuit, the MOS transistors M3 and M11 form a current mirror circuit, and the MOS transistors M7 and M12 form a current mirror circuit. Then, current copying is performed, so that the following equations hold:

$$IOUT=I1+I2=2I2 \tag{113}$$

When the current-to-voltage conversion circuit in the output circuit is set to the resistor shown in FIG. 2(*c*), the following expression is given:

$$VREF=R5\times IOUT \tag{114}$$

Thus, the same result as that in the reference voltage circuit shown in FIG. 30 can be obtained.

Other Embodiment Mode of the Present Invention

As described above, in the reference voltage circuits shown in FIGS. 30 to 35, the emitter size ratio between the bipolar transistor Q1 and the bipolar transistor Q2 constituting the current mirror circuit was set to K to 1 (in which K is larger than 1). Since the bipolar transistors Q1 and Q2 constitute the non-linear current mirror circuit, analogy from the conventional Widlar current mirror circuit may be performed. That is, the emitter size ratio of the bipolar transistor Q1 to the bipolar transistor Q2 may be set to 1 to K (in which K is larger than 1).

FIGS. 36 to 41 show reference voltage circuits obtained when the emitter size ratio between the bipolar transistor Q1 and the bipolar transistor Q2 constituting the current mirror circuit was set to 1:K (in which K is larger than 1). For simplicity of the description, the startup circuit is omitted.

Embodiment 29

Figure 36:
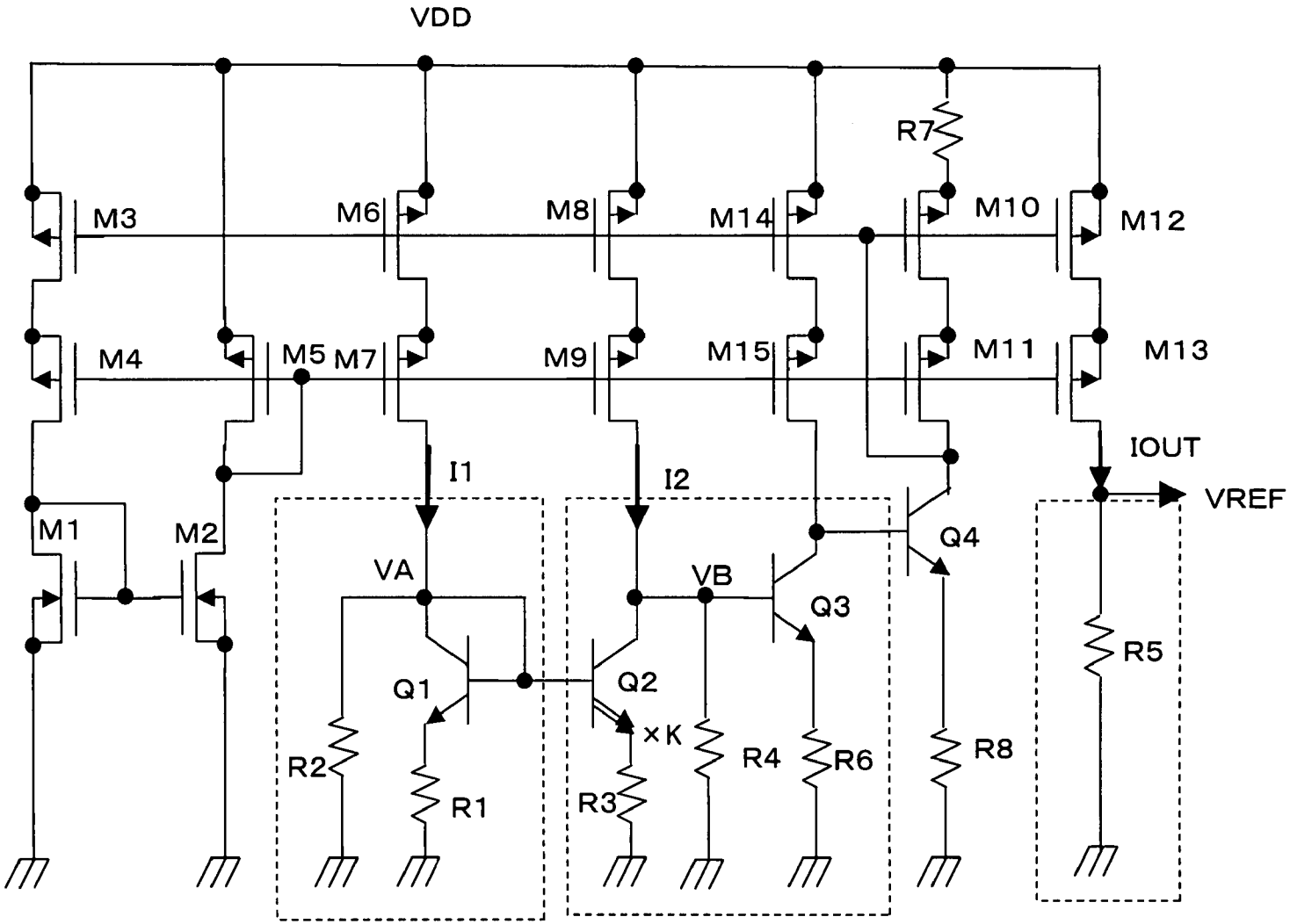
FIG. 36 is a diagram showing a circuit configuration of a fifth embodiment of (claim 9 of) the present invention.
Figure 37:
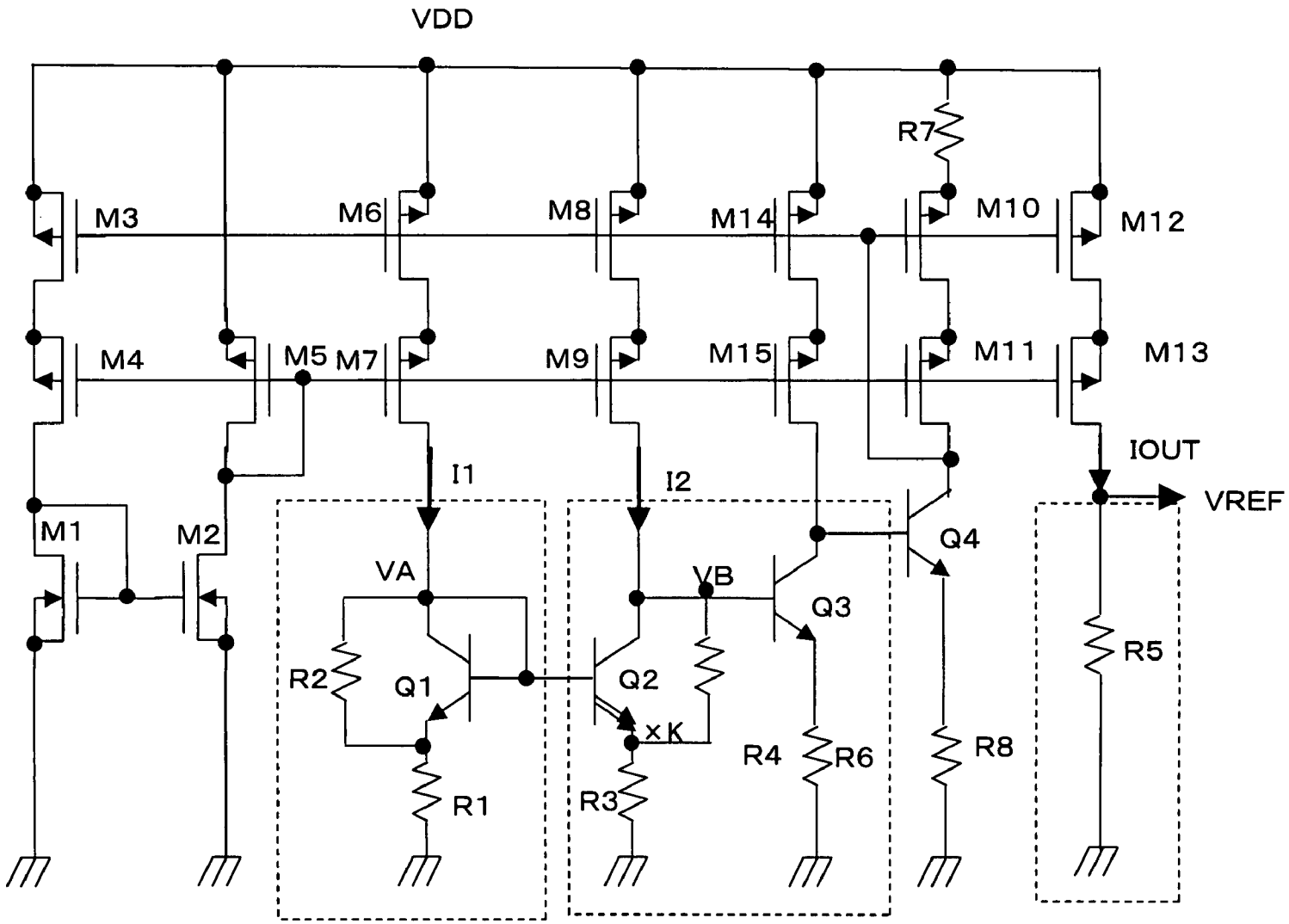
FIG. 37 is a diagram showing a circuit configuration of a sixth embodiment of (claim 9 of) the present invention.
Figure 38:
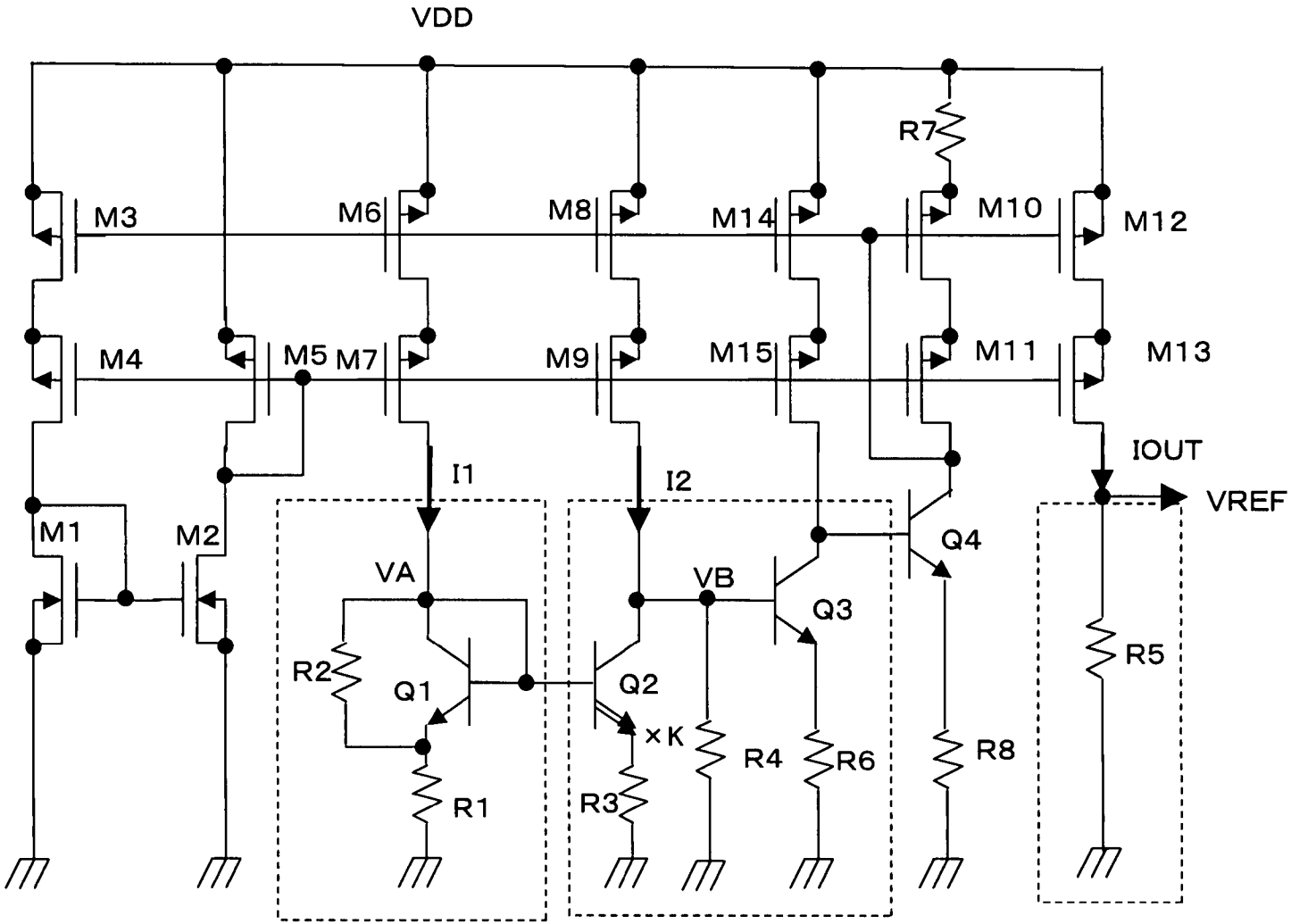
FIG. 38 is a diagram showing a circuit configuration of a seventh embodiment of (claim 9 of) the present invention.
Figure 39:
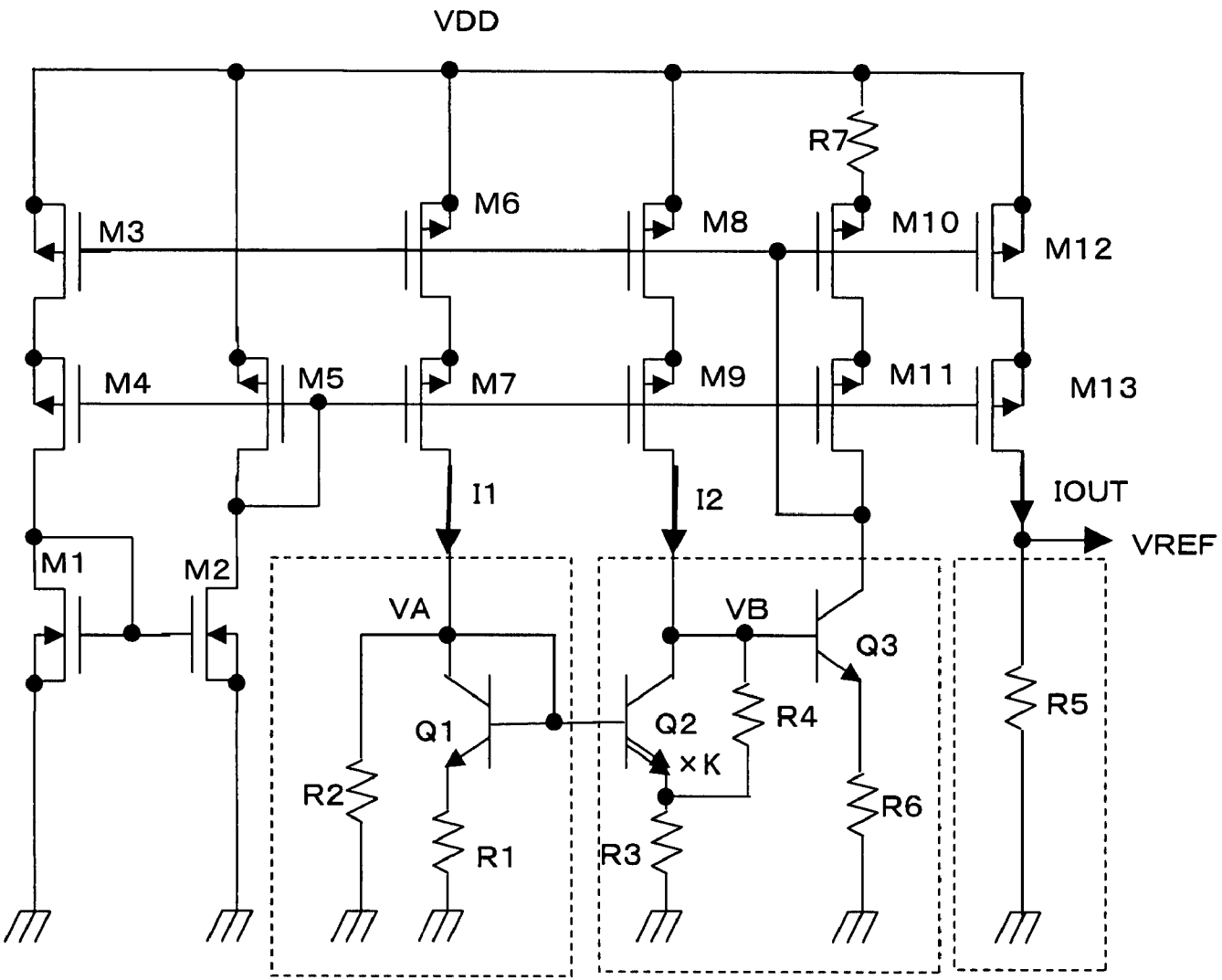
FIG. 39 is a diagram showing a circuit configuration of an eighth embodiment of (claim 9 of) the present invention.

Referring to FIG. 36, the emitter size ratio of a bipolar transistor Q1 to a bipolar transistor Q2 is 1:K (in which K is larger than 1). The transistors Q1 and Q2 constitute the current mirror circuit, having emitter resistors R1 and R3, respectively, (in which the value of the resistor R1 is larger than the value of the resistor R3).

A resistor R2 is inserted between a common base and the ground (GND). A resistor R4 is inserted between a base of the bipolar transistor Q3 on the side of a collector of the bipolar transistor Q2 and the ground (GND). Herein, the resistor R2 is assumed to be equal to the resistor R4.

An operation of the present embodiment will be described. Now, it is assumed that the base currents of the bipolar transistors can be neglected, and a collector voltage of the bipolar transistor Q1 becomes equal to a collector voltage of the bipolar transistor Q2 when a current that flows through the bipolar transistor Q1 is equal to a current that flows through the bipolar transistor Q2.

At this point, the collector current (IC1) of the bipolar transistor Q1 and the collector current (IC2) of the bipolar transistor Q2 are expressed as follows:

$$\begin{aligned} IC(=IC1=IC2) &= (VBE1-VBE2)/(R3-R1) \\ &= \Delta VBE/(R3-R1) \\ &= V_T\ln(K)/(R3-R1) \end{aligned} \tag{115}$$

When the collector current (IC 1) of the bipolar transistor Q1 is increased to be larger than the IC value shown in Equation (114), a common base voltage of the bipolar transistors Q1 and Q2 will be naturally increased. The common base voltage is, however, the sum of the voltage VBE 1 and the voltage R1IC1, and is also the sum of the voltage VBE2 and the voltage R3IC2. As is well known, an increase in the voltage VBE caused by an increase in the collector current is logarithmically compressed. The increase therefore is confined to be some degree. However, an increase in a voltage drop at the emitter resistor is proportionate to the increase in the collector current. Since the value of the resistor R3 is larger than the value of the resistor R1, an increment in a voltage drop at the emitter resistor R3 becomes larger than an increment in a voltage drop at the emitter resistor R1.

Accordingly, the collector current (IC2) of the bipolar transistor Q2 operates to be smaller than the collector current (IC1) of the bipolar transistor Q1. However, when drive currents for the bipolar transistors Q1 and Q2 are set to be equal, a current that flows through the bipolar transistor Q2 is limited. Thus, the reminder of the current is flown into the resistor R4. Thus, a base voltage of the bipolar transistor Q3 will be increased. Accordingly, the collector current ($I_{C3}$) of the bipolar transistor Q3 will be increased. Since this bipolar transistor Q3 constitutes a negative phase amplifier circuit, a collector voltage of the bipolar transistor Q3 is reduced. A base voltage of the bipolar transistor Q4 connected to the transistor Q3 is reduced. Thus, a collector current of the bipolar transistor Q4 will be reduced. The collector current ($I_{C4}$) of this bipolar transistor Q4 is the drive current for cascoded transistors M10 to M11.

On the other hand, a resistor R7 is inserted between the cascoded transistors M10 and M11 and the power supply VDD, and the cascoded transistors M10 and M11, cascoded transistors M6 and M7, and cascoded transistors M8 and M9 constitute an inverse Widlar current mirror circuit. Accordingly, when a current that flows through the cascoded transistors M10 and M11 is reduced, currents that flow through the cascoded transistors M6 and M7 and the cascoded transistors M8 and M9 will be abruptly reduced.

The equal currents flow through the cascoded transistors M6 and M7 and the cascoded transistors M8 and M9, respectively.

Accordingly, when the current that flows through the cascoded transistors M6 and M7 is reduced, the current that flows through the transistor Q1 is reduced, and a current that flows through the resistor R1 is also reduced. A decrease in the current that flows through the bipolar transistor Q2 is small. The current that flows through the resistor R4 is reduced, so that the base voltage of the bipolar transistor Q3 is reduced. The current that flows through the bipolar transistor Q3 is thereby reduced. The function of this negative phase amplifier circuit operates to reduce the current that flows through the bipolar transistor Q4 to the contrary, and operates to reduce the current that flows through the cascoded transistors M10 and M11. The current that flows through the cascoded transistors M6 and M7 will also be reduced and will be fixed at a predetermined current value.

That is, it can be seen that a negative feedback current loop is formed between the bipolar transistors Q1 to Q3 and the inverse Widlar cascode current mirror circuit that constitutes a self-biasing circuit.

The current that flows through the cascoded transistors M6 and M7 at this point is expressed as follows:

$$\begin{aligned} I1 &= IC+(VBE1+ICR1)/R2 \\ &= [VBE1+\{(R1+R2)/(R3-R1)\}V_T\ln(K)]/R2 \\ &= [VBE1+\{(R1+R2)/(R3-R1)\}\Delta VBE]/R2 \\ &= [VBE2+\{(R2+R3)/(R3-R1)\}\Delta VBE]/R2 \end{aligned} \tag{116}$$

When the current that flows through the cascoded transistors M6 and M7 is set to be equal to the current IOUT that flows through the cascoded transistors M12 and M13, the following equations hold:

$$VREF = R5IOUT \tag{117}$$

$$= (R5/R2)[VBE1 + \{(R1 + R2)/(R3 - R1)\}\Delta VBE]$$

$$= (R5/R2)[VBE2 + \{(R3 + R2)/(R3 - R1)\}\Delta VBE]$$

The voltage VBE1 has a temperature coefficient of approximately −1.9 mV/° C. The voltage VBE2 also has a temperature coefficient of approximately −1.9 mV/° C. Further, as is well known, the voltage ΔVBE has a positive temperature characteristic in this circuit as well, which is proportionate to the thermal voltage $V_T$ (with the temperature characteristic thereof being 0.0853 mV/° C.).

That is, the temperature characteristics of the term [VBE1+{(R1+R2)/(R1−R3)}ΔVBE] in Equation (117) can be compensated by setting the resistor ratio {(R2+R2)/(R1−R3)} and performing weighting of the voltage ΔVBE having the positive temperature characteristic by the set resistor ratio and adding the resulting voltage to the voltage VBE1 having the negative temperature characteristic and.

Accordingly, it can be seen that, when the voltage VBE 1 is set to be approximately 580 mV at ambient temperature, the voltage VBE2 becomes 620 mV at the ambient temperature, and the voltage [VBE1+{(R1+R2)/(R1−R3)}ΔVBE] will likewise become approximately 1.2 V.

Since the resistor ratio (R5/R2) has zero temperature coefficient, the output reference voltage VREF becomes the voltage in which the temperature characteristics thereof have been compensated. Assume that the resistor ratio (R5/R2) can be arbitrarily set, and is set to be smaller than 1. Then, the voltage VREF becomes the voltage higher than 1.2V. If the resistor ratio (R5/R2) is set to be smaller than 1, the voltage VREF becomes the voltage lower than 1.2V. These phenomena are the same as those with the prior art. Especially when the resistor ratio (R5/R2) is set to be smaller than 1 that makes the voltage VREF to be lower than 1.2V, the supply voltage can be reduced. When the voltage VREF is set to 1.0V, for example, the reference voltage circuit can be operated at the supply voltage of approximately 1.2V or higher.

Embodiment 30

Figure 40:
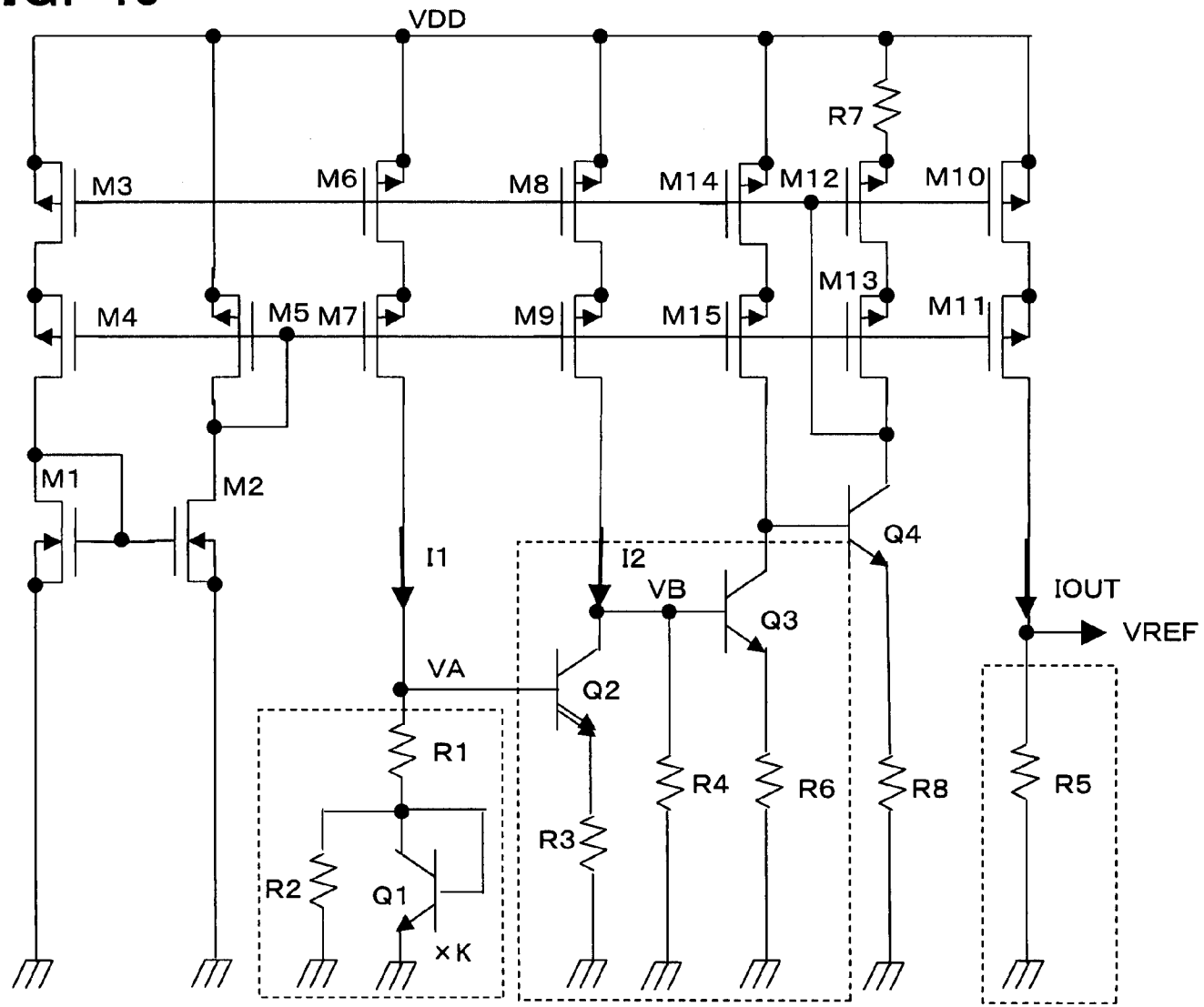
FIG. 40 is a diagram showing a circuit configuration of a ninth embodiment of (claim 9 of) the present invention.

Likewise, the circuit can be changed to each of those in FIGS. 37 to 40. The circuit FIG. 40 is, however, equivalent to the circuit in FIG. 38, in which interchange among circuit elements connected in series (specifically, a diode-connected bipolar transistor Q1, a resistor R2 connected in parallel with the diode-connected bipolar transistor Q1, and a resistor R1 connected in series with those elements) is performed. In both of the circuits, the circuit analysis by hand calculation is difficult.

In FIGS. 37 to 40 as well, as in the case shown in FIG. 36, when a current that flows through cascoded transistors M6 and M7 is increased, a current that flows through the transistor Q1 is increased, and a current that flows through the resistor R1 is also increased. An increase in a current that flows through the bipolar transistor Q2 is small. A current that flows through a resistor R4 is increased, so that a base voltage of a bipolar transistor Q3 is improved (enhanced). A current that flows through the bipolar transistor Q3 is thereby increased. The function of this negative phase amplifier circuit operates to reduce a current that flows through the bipolar transistor Q4 to the contrary, and operates to reduce a current that flows through cascoded transistors M10 and M11. The current that flows through the cascoded transistors M6 and M7 will also be reduced and will be fixed at a predetermined current value.

That is, it can be seen that a negative feedback current loop is formed between the bipolar transistors Q1 to Q3 and an inverse Widlar cascode current mirror circuit that constitutes a self-biasing circuit.

Accordingly, in the case of any of the circuits, it is controlled so that a base voltage of the bipolar transistor Q2 becomes equal to the base voltage of the bipolar transistor Q3. Temperature characteristics can be compensated by performing weighting of a current having a positive temperature characteristic proportionate to the difference voltage ΔVBE between the voltage VBE of the bipolar transistor Q1 and the voltage VBE of the bipolar transistor Q2 using respective resistance values of the resistors R1 to R4 and adding the resulting current to a current having a negative temperature characteristic proportionate to the VBE of the bipolar transistor (by reducing only temperature characteristics of the resistors, actually). Then, by converting the resulting current to a voltage through the resistor, an arbitrary reference voltage having zero temperature coefficient can be obtained.

Other Embodiment Mode of the Present Invention

The reference voltage circuit shown in FIG. 36 can be likewise modified such that the current is branched into the currents that flow through the bipolar transistors and the currents that flow through the resistors connected in parallel with therewith, thereby setting the drive currents.

Embodiment 31

Figure 41:
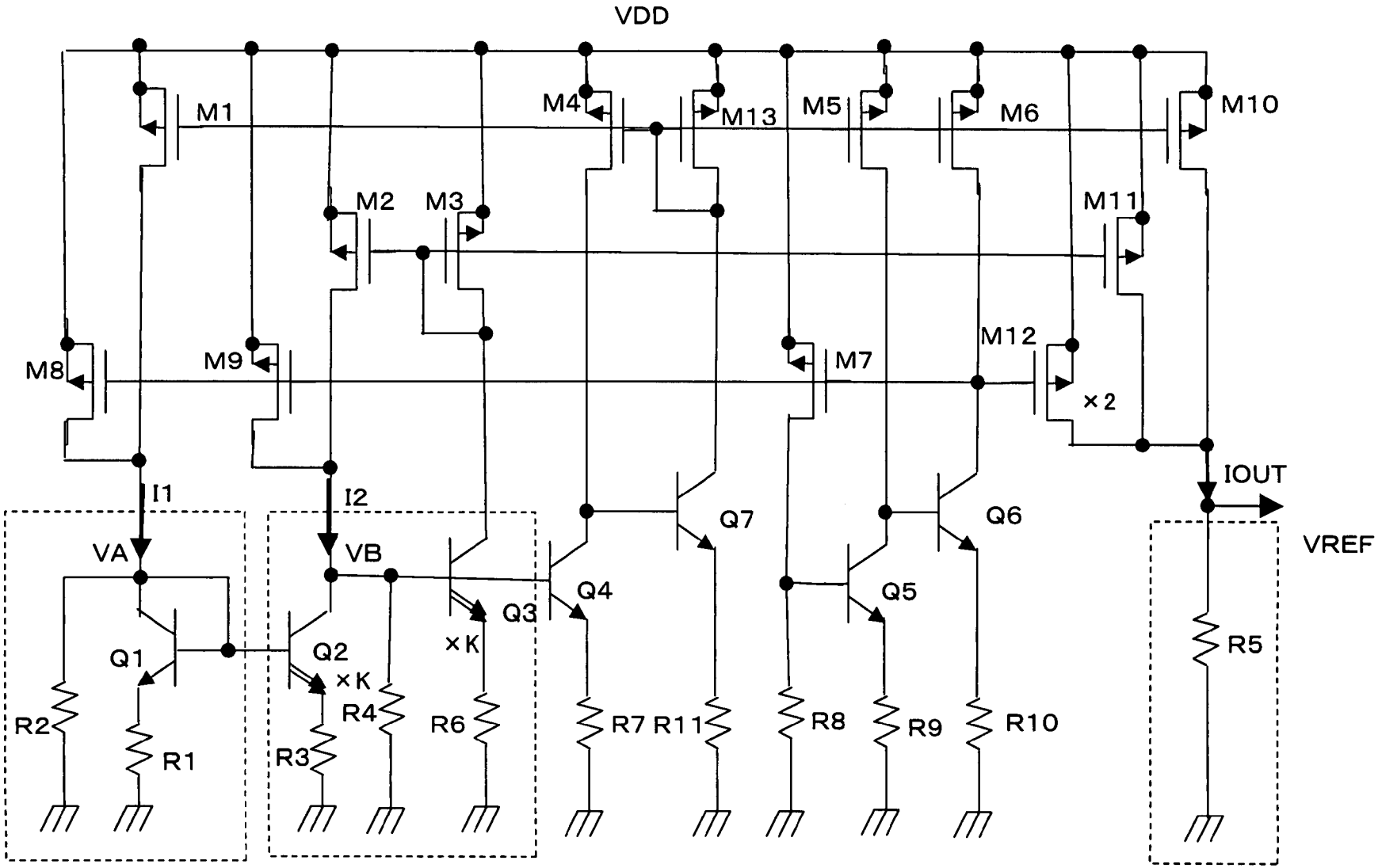
FIG. 41 is a diagram showing a circuit configuration of a second embodiment of (claim 10 of) the present invention.

FIG. 41 shows a circuit when a self-biasing system of the reference voltage circuit shown in FIG. 36 is modified such that the current is branched into the currents that flow through the bipolar transistors and the currents that flow through the resistors connected in parallel with therewith, thereby setting the drive currents. In this case, for simplicity of the description, the start-up circuit is omitted.

Now, assume that the transistor size of a bipolar transistor Q2 is K times as large as that of a transistor Q1, which is the unit bipolar transistor.

Also assume that the transistor size of a bipolar transistor Q3 is K times as large as that of the transistor Q1, which is the unit bipolar transistor.

Resistors R2, R4, and R8 are set to be equal. A resistor R3 is set to be equal to a resistor R6. Then, resistors R1, R7, R9, and R11 are set to be equal. Each of a bipolar transistor Q5 and a bipolar transistor Q6 to be driven by MOS transistors M5 and M6, respectively, constitutes the negative phase amplifier, thereby constituting a positive phase amplifier in two stages.

That is, an output of this two-stage (positive phase) amplifier is connected to a gate of an MOS transistor M7. A drain output current of the MOS transistor M7 is grounded through the resistor R8. The other terminal of the resistor R8 is connected to a base of the (unit) bipolar transistor Q5.

On the other hand, an MOS transistor M4 and a bipolar transistor Q4 that is driven thereby constitute a negative phase amplifier. A diode-connected MOS transistor M13 and a bipolar transistor Q7 constitute a positive phase amplifier to the contrary. A negative phase amplifier is thereby constituted in two stages.

Further, MOS transistors M2 and M9 and the bipolar transistor Q2 to be driven thereby constitute a negative phase amplifier. A diode-connected MOS transistor M3 and the bipolar transistor Q3 constitute a positive phase amplifier to the contrary. Likewise, a negative phase amplifier is thereby constituted in two stages.

The gate of the MOS transistor M7 and gates of MOS transistors M8 and M9 are connected to one another, thereby constituting a current mirror circuit having a current ratio of 1:1:1.

Likewise, gates of the MOS transistors M3 and M2 are connected in common, thereby constituting a current mirror circuit having a current ratio of 1:1. A gate of the MOS transistor M13, a gate of an MOS transistor M1, and a gate of the MOS transistor M4 are connected in common, thereby constituting a current mirror circuit having a current ratio of 1:1:1.

An operation of the present embodiment will be described. First, a description that the collector voltage (=base voltage) VA of a diode-connected bipolar transistor Q1 becomes equal to a collector voltage of the (unit) bipolar transistor Q5 will be made.

The bipolar transistor Q5 and the resistor R9, the bipolar transistor Q6 and the resistor R10, the bipolar transistor Q7 and the resistor R11 are all copies of the bipolar transistor Q1 and the resistor R1. The resistor R8 is a copy of the resistor R2 (=R4).

The bipolar transistor Q3 and the resistor R6 are a copy of the bipolar transistor Q2 and the resistor R3. The bipolar transistor Q4 and the resistor R7 are a copy of the bipolar transistor Q1 and the resistor R1.

Accordingly, a current that flows in common through the bipolar transistor Q7 and the resistor R11 is copied through the MOS transistor to the MOS transistors M1, M4, M5, and M6 that constitute the current mirror circuit with the MOS transistor M13.

Accordingly, by an output signal of the two-stage (positive phase) amplifier constituted from the bipolar transistor Q5, resistor R9, load transistor M5, bipolar transistor Q6, resistor R10, and load transistor M6, currents that flow through the MOS transistors are controlled. A terminal voltage of the grounded resistor R8 will be controlled through a negative feedback path (loop) so that the current that flows in common through the bipolar transistor Q5 and the resistor R9 becomes equal to the current that flows in common through the bipolar transistor Q6 and the resistor R10.

Accordingly, equal currents are supplied to the bipolar transistor Q1, resistor R1, and resistor R2 connected in parallel with the bipolar transistor Q1 and the resistor R1 through the MOS transistor M1 that constitutes the current mirror circuit with this MOS transistor M4.

The current that flows in common through the bipolar transistor Q3 and the resistor R6 is copied through the MOS transistor M3 to the MOS transistor M2 that constitutes the current mirror circuit with the MOS transistor M3.

Accordingly, the current which is equal to the current that flows in common through this bipolar transistor Q3 and the resistor R6 is supplied to the bipolar transistor Q2 and the resistor R3, and the resistor R4 connected in parallel with the bipolar transistor Q2 and the resistor R3.

The MOS transistors M2 and M9, bipolar transistor Q2, resistor R3, and resistor R4 connected in parallel therewith constitute a negative phase amplifier and constitute a negative feedback path, thereby operating to cause the current that flows in common through the bipolar transistor Q3 and the resistor R6 to become a predetermined value. The current that flows in common through the bipolar transistor Q7 and the resistor R11 is copied through the MOS transistor M13 to the MOS transistor M4 and the MOS transistor M1 that constitute the current mirror circuit with the MOS transistor M13. Accordingly, a current which is equal to the current that flows in common through this bipolar transistor Q7 and this resistor R11 is supplied to the bipolar transistor Q1 and the resistor R1, and the resistor R2 connected in parallel with the bipolar transistor Q1 and the resistor R1.

The MOS transistor M4, bipolar transistor Q4, and resistor R7 constitute a negative phase amplifier and constitute a negative feedback path, thereby operating to cause the current that flows in common through the bipolar transistor Q7 and the resistor R11 to become a predetermined value.

As described above, by constituting the double negative feedback path, the value of the current that flows through the current mirror circuit constituted from the MOS transistor M3 and the MOS transistor M1 and the value of the current that flows through the current mirror circuit constituted from the MOS transistors M13, M1, and M4 are set to the predetermined values.

On the other hand, the current that flows through the resistor R8 is copied through the MOS transistor M7 to the MOS transistor M8 and M9 that constitutes the current mirror circuit with the MOS transistor M7.

Accordingly, it can be seen that the drive current I1 that generates the terminal voltage VA is the sum of the current that flows in common through the bipolar transistor Q3 and the resistor R6 and the current that flows through the resistor R8, and that the drive current I2 that generates the terminal voltage VB is the sum of the current that passes in common through the bipolar transistor Q4 and the resistor R7 and the current that flows through the resistor R8. A base of the bipolar transistor Q1 and a base of the bipolar transistor Q2 are connected in common, and their terminal voltage is the voltage VA, and a base of the bipolar transistor Q3 and a base of the bipolar transistor Q4 are connected in common, and their terminal voltage is the voltage VB. Since the values of the resistors R2, R4, and R8 are all equal, and the currents that pass through the resistors R2, R4, and R8 are all equal, the terminal voltage VA becomes equal to the terminal voltage VB.

As described above, in this embodiment, the three negative feedback paths are constituted. The drive currents I1 and I2 are thereby set to the predetermined values.

When the emitter area ratio K of the bipolar transistor Q3 (=Q2) and the values of the resistor R6 (=R3) and resistor R11 (=R7(=R1)) (in which the value of the resistor R6 is larger than the value of the resistor R11 (=R7)) are set, the voltage value VB (=VA) larger than zero is uniquely determined when the circuit is started up.

Now, assume that the resistor R6 (=R3) and the resistor R11 (=R7(=R1)), (in which the resistor R6 is larger than the resistor R11 (=R7)), are set in order to set the current I1 to be equal to the current I2.

In this case, when the slight difference δ between a current IC7 that flows through the bipolar transistor Q7(=Q4) and the current IC3 that flows through the bipolar transistor Q3 is generated, (or when IC3=(1+δ)$I_{C7}$), the following expressions are obtained:

$$\begin{aligned}\Delta VBE &= VBE4 - VBE3 \\ &= V_T In\{K/(1+\delta)\} \\ &= R6 I_{C3} - R7 I_{C7} \\ &= \{R6(1+\delta) - R7\} I_{C7}\end{aligned} \tag{118}$$

Thus, a current ratio difference is canceled by setting the values of the resistor R6 and the resistor R11 (=R7) again. In other words, by setting the values of the resistors R6 and R11 (=R7), the drive current I1 can be made to be equal to the drive current I2.

At any rate, the voltage VA is set to be equal to the voltage VB. That is, an operating condition which is the same as that in the reference voltage circuit in FIG. 36 is implemented.

When MOS transistors M10 and M11 are set to the unit MOS transistors, and the transistor size of an MOS transistor M12 is set to be twice as large as the transistor size of the unit transistor, the MOS transistors M13 and M10, the MOS transistors M3 and M1, and the MOS transistors M7 and M12 form current mirror circuits respectively. Then, current copying is performed, so that the following equations hold:

$$IOUT=I1+I2=2I2 \tag{119}$$

When the current-to-voltage conversion circuit in the output circuit is set to the resistor shown in FIG. 2C, the following expression is given:

$$VREF=R5\times IOUT \tag{120}$$

Thus, the same result as that in the reference voltage circuit shown in FIG. 36 can be obtained.

Other Embodiment Mode of the Present Invention

As described above, in the reference voltage circuits shown in FIGS. 30 to 41, the bipolar transistor Q1 that constitutes the current mirror circuit was diode-connected. Since the bipolar transistors Q1 and Q2 constitute the non-linear current mirror circuit, analogy from a conventional Nagata current mirror circuit may be performed. The emitter size ratio of the bipolar transistor Q1 to the bipolar transistor Q2 may be set to 1:K (in which K is larger than 1).

FIGS. 42 to 46 show reference voltage circuits obtained when the emitter size ratio between the bipolar transistor Q1 and the bipolar transistor Q2 constituting the current mirror circuit is set to 1:K (in which K is larger than 1). For simplicity of the description, the startup circuit is omitted.

Embodiment 32

Figure 42:
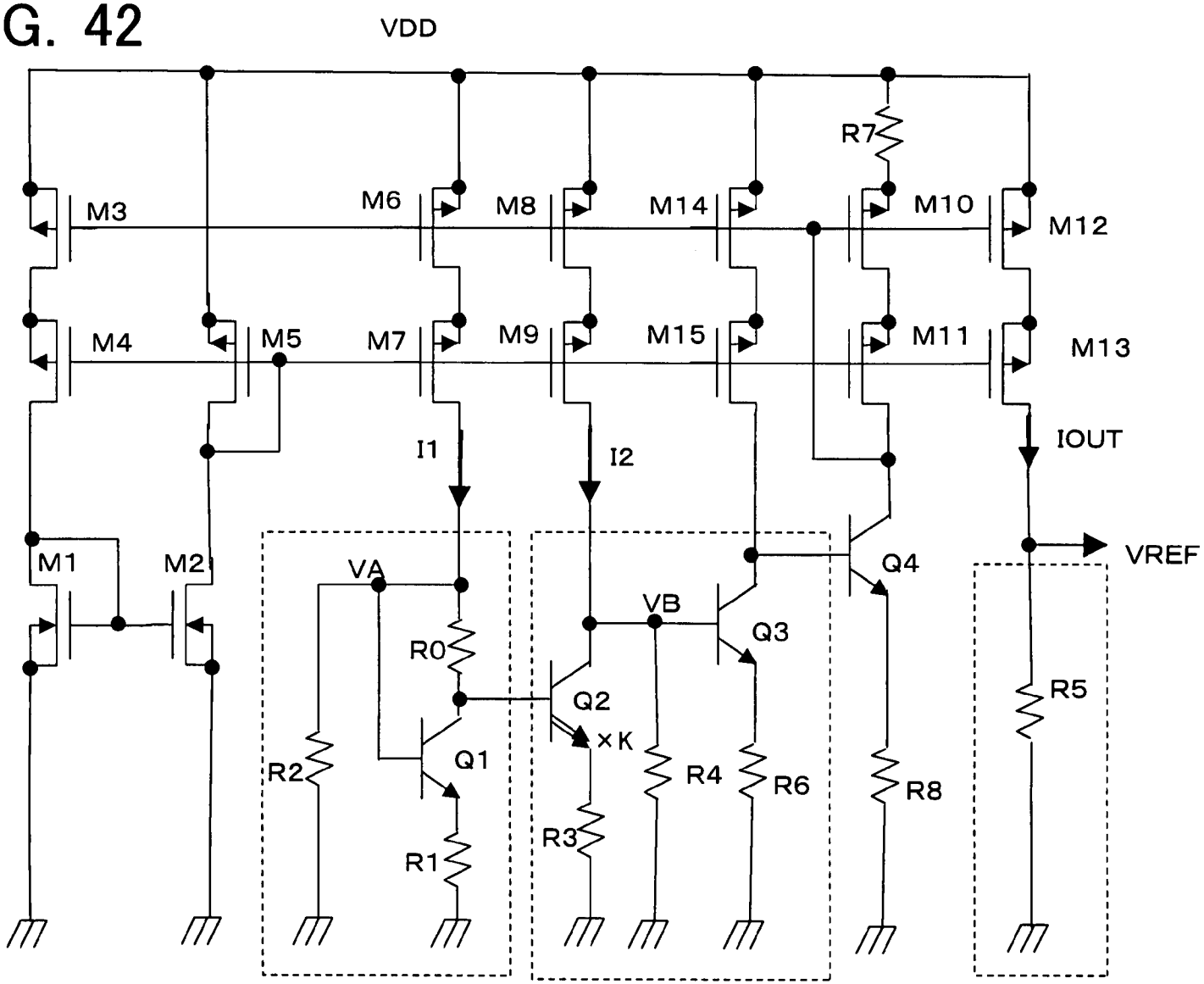
FIG. 42 is a diagram showing a circuit configuration of a tenth embodiment of (claim 10 of) the present invention.
Figure 43:
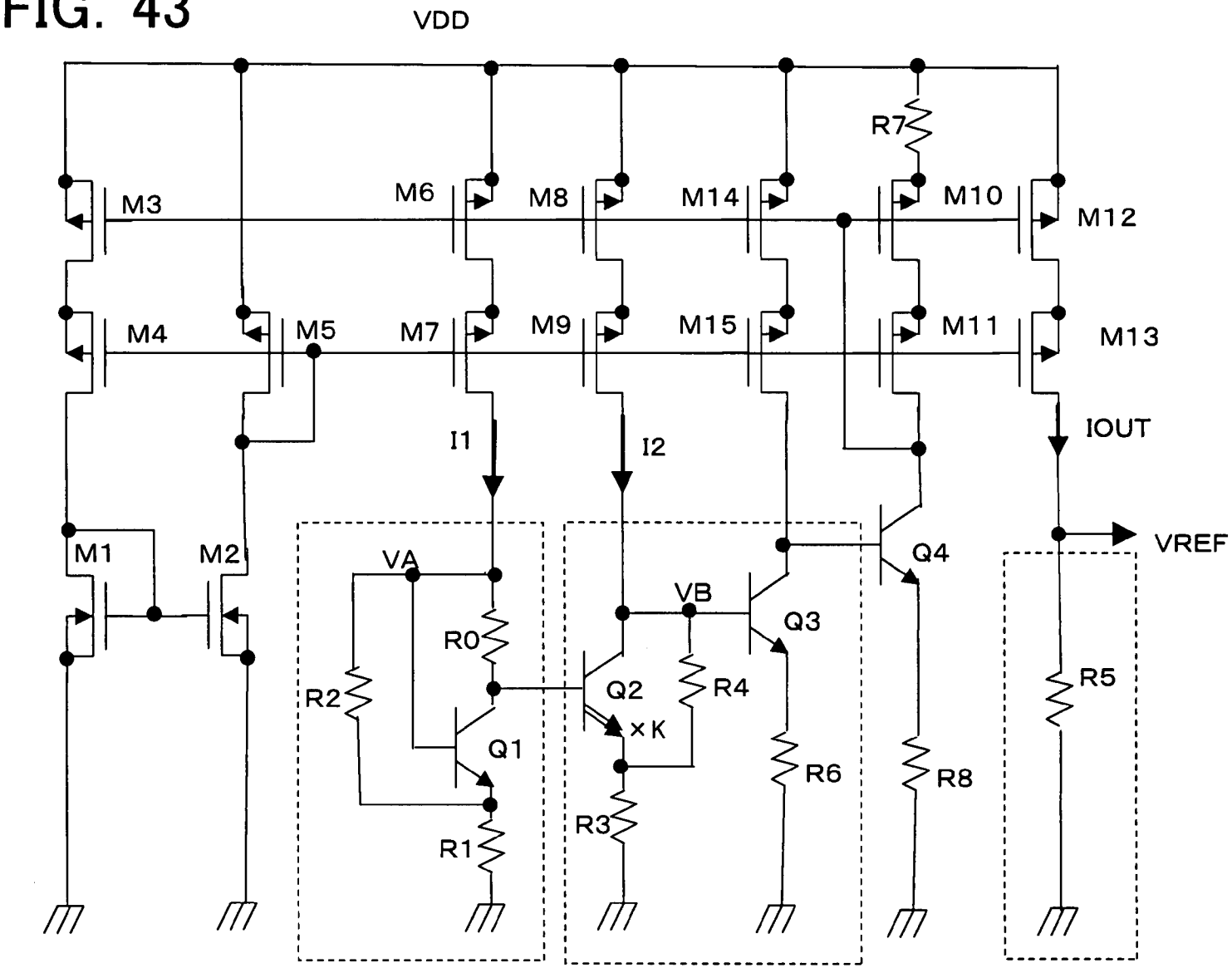
FIG. 43 is a diagram showing a circuit configuration of an eleventh embodiment of (claim 9 of) the present invention.
Figure 44:
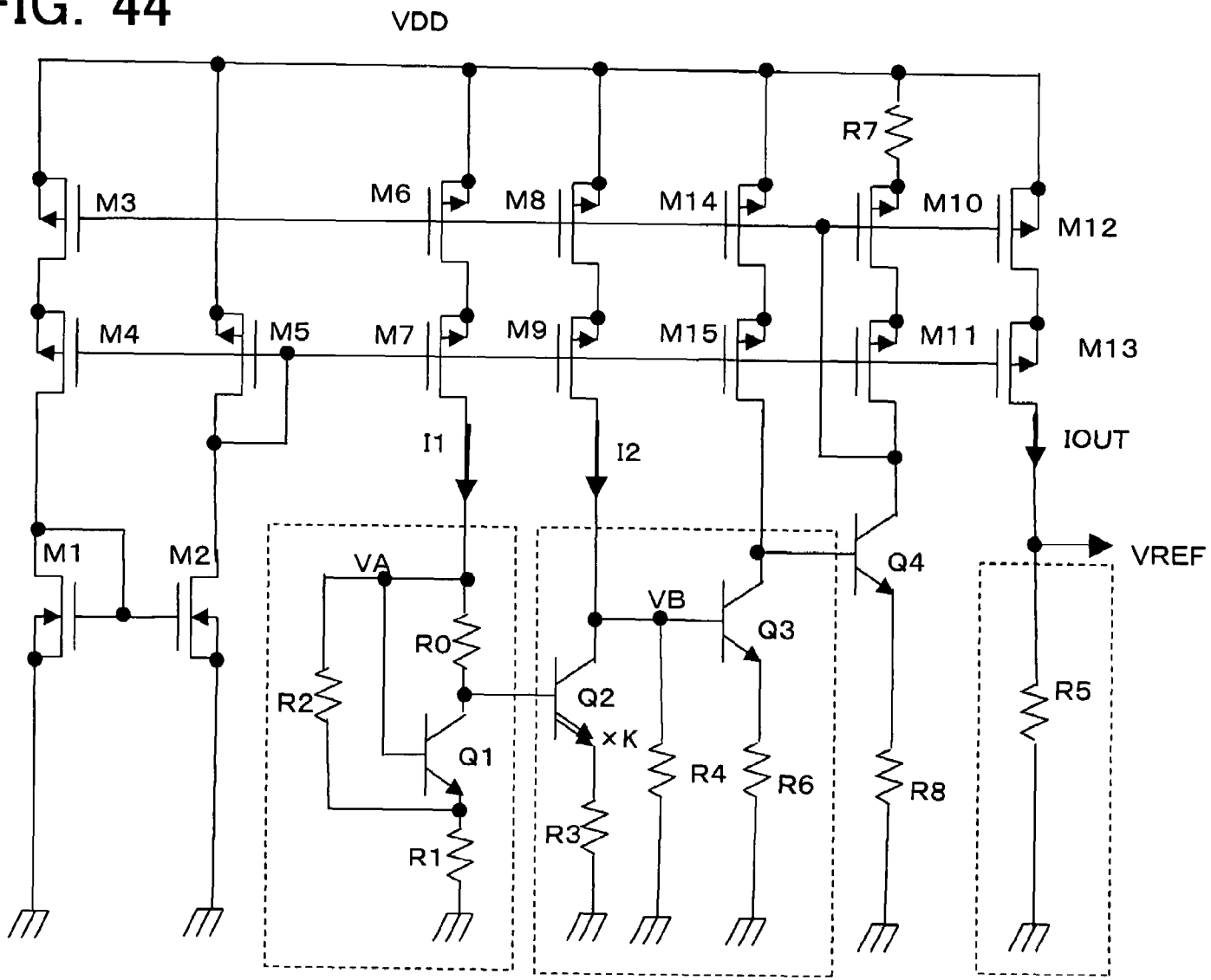
FIG. 44 is a diagram showing a circuit configuration of a twelfth embodiment of (claim 9 of) the present invention.
Figure 45:
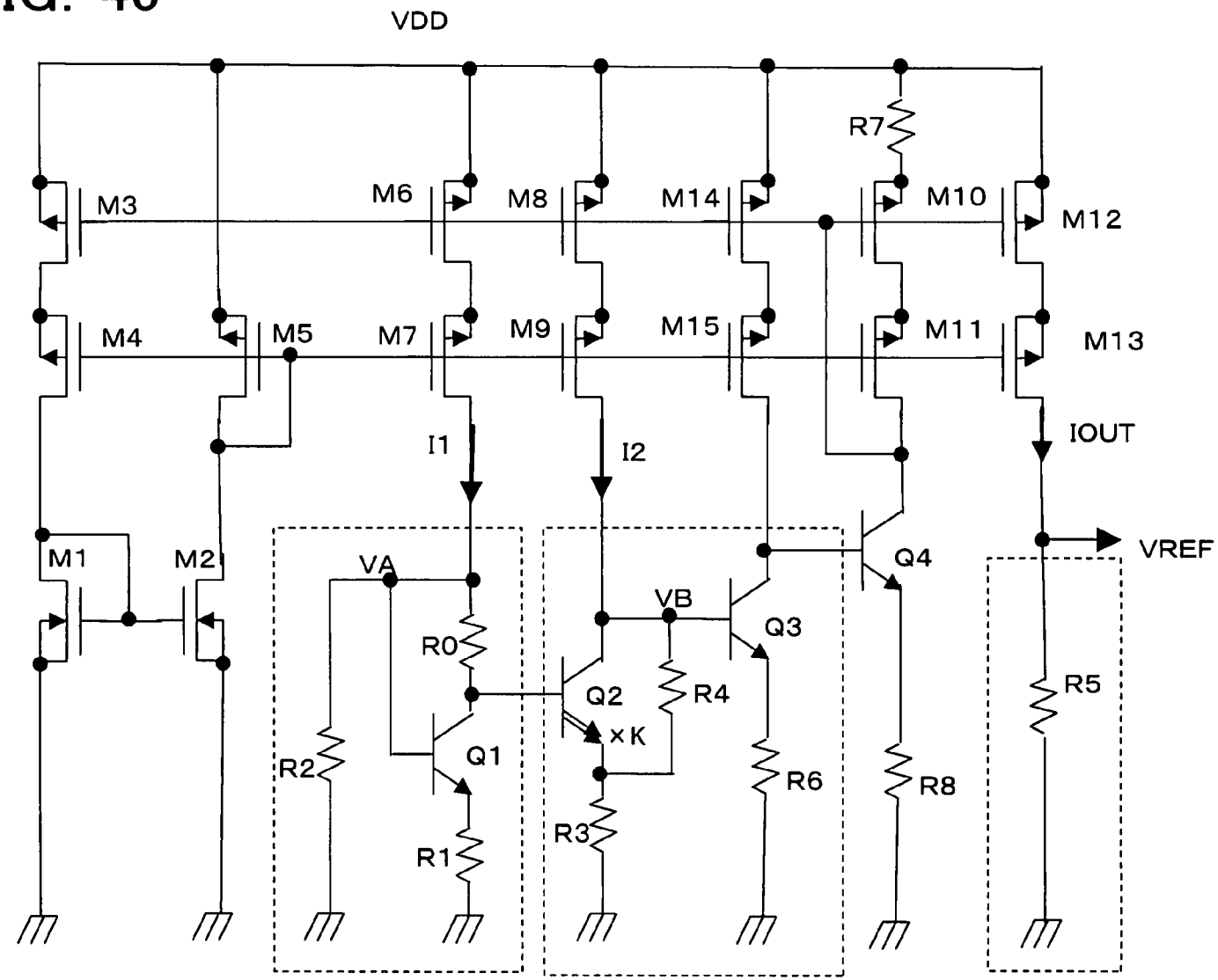
FIG. 45 is a diagram showing a circuit configuration of a thirteenth embodiment of (claim 9 of) the present invention.

Referring to FIG. 42, the emitter size ratio of the bipolar transistor Q1 to the bipolar transistor Q2 is set to 1:K (in which K is larger than 1). A resistor R0 is inserted between a base and a collector of the bipolar transistor Q1. The base of the bipolar transistor Q1 and the collector of the bipolar transistor Q1 are grounded through emitter resistors R1 and R3, respectively. The collector of the bipolar transistor Q1 is connected to a base of the bipolar transistor Q2, thereby constituting a non-linear current mirror circuit.

A resistor R2 is inserted between the base of the bipolar transistor Q1 and the ground (GND). A resistor R4 is inserted between a connecting node between a collector of the bipolar transistor Q2 and a base of the bipolar transistor Q3 and the ground (GND). Herein, the resistor R2 is herein assumed to be equal to the resistor R4.

Some description about an operation of the non-linear current mirror circuit constituted from the bipolar transistors Q1 and Q2, resistor R0, and emitter resistors R1 and R3 shown in FIG. 42 will be required.

The configuration of this circuit represents the simplest non-linear current mirror circuit. When the value of the resistor R0 is set to be equal to the value of the resistor R3 and set to zero, and when the value of the resistor R1 is set to not zero, a traditionally known Widlar current mirror circuit is obtained.

Alternatively, when the value of the resistor R0 is set to be equal to the value of the resistor R1 and set to zero, and when the value of the resistor R3 is set to not zero, a traditionally known Widlar current mirror circuit is obtained. Alternatively, when the value of the resistor R1 is set to be equal to the value of the resistor R3 and set to zero, and when the value of the resistor R0 is set to not zero, a traditionally known Nagata current mirror circuit having a peak characteristic is obtained.

Alternatively, when the values of the resistor R0 and the resistor are set to not zero, and when the value of the resistor R1 is set to zero, a traditionally known Nagata-Widlar current mirror circuit having a weakened peak characteristic is obtained.

Further, when the value of the resistor R3 is set to zero, and when the values of the resistors R0 and R1 are set to not zero, characteristics similar to those of the inverse Widlar current mirror circuit are obtained when the value of the resistor R1 is larger than the value of the resistor R0. When the value of the resistor R1 is smaller than the value of the resistor R0, characteristics similar to those of the Nagata current mirror circuit are obtained.

Herein, the emitter resistors R1 and R3 are inserted so as to reduce variations in the bipolar transistors. Thus, consideration will be limited to a monotonously increasing region in which the non-linear current mirror circuit has a peak characteristic and reaches a peak value, when the resistors R0, R1, and R3 are set to not zero and the value of the resistor R0 is larger than the value of the resistor R1.

An operation of the present embodiment will be described. Now, it is assumed that base currents of the bipolar transistors can be neglected, and a collector voltage of the bipolar transistor Q1 becomes equal to a collector voltage of the bipolar transistor Q2 when a current that flows through the bipolar transistor Q1 is equal to a current that flows through the bipolar transistor Q2.

The collector current (IC1) of the bipolar transistor Q1 and the collector current (IC2) of the bipolar transistor Q2 at this point are expressed as follows:

$$\begin{aligned} IC(=IC1=IC2) &= (VBE1-VBE2)/(R0+R3-R1) \\ &= \Delta VBE/(R0+R3-R1) \\ &= V_T\ln(K)/(R0+R3-R1) \end{aligned} \tag{121}$$

When the collector current (IC1) of the bipolar transistor Q1 is increased to be larger than the IC value shown in Equation (121), the collector voltage of the bipolar transistor Q1 or a base voltage of the bipolar transistor Q2 will be naturally increased because the non-linear current mirror circuit is in the monotonously increasing region. However, the base voltage of the bipolar transistor Q2 has the value of the voltage obtained by subtracting a voltage R0IC1 from the sum of the voltage VBE1 and the voltage R1IC1, and is also the sum of the voltage VBE2 and the voltage R3IC2.

As is well known, an increase in the voltage VBE caused by an increase in the collector current is logarithmically compressed. The increase therefore is confined to be some degree. However, an increase in a voltage drop at the emitter resistor is proportionate to the increase in the collector current. An increase in a voltage drop at a collector resistor is also proportionate to the increase in the collector current.

Since the value of the resistor R0 is larger than zero and the non-linear current mirror circuit is in the monotonously increasing region, an increment in a voltage drop at the emitter resistor R3 (an increment in a voltage drop at the resistor R0) becomes larger than an increment in the voltage drop at the emitter resistor R1.

Accordingly, the collector current (IC2) of the bipolar transistor Q2 operates to be smaller than the collector current (IC1) of the bipolar transistor Q1. However, when the drive currents for the bipolar transistors Q1 and Q2 are set to be equal, the current that flows through the bipolar transistor Q2 is limited, and the remainder of the current is flown into the resistor R4. Thus, a base voltage of the bipolar transistor Q3 will be increased. Accordingly, the collector current ($I_{C3}$) of the bipolar transistor Q3 will be increased.

Since this bipolar transistor Q3 constitutes a negative phase amplifier circuit, the collector voltage of the bipolar transistor Q3 is reduced, so that a base voltage of the bipolar transistor Q4 connected to the bipolar transistor Q3 will be reduced. Thus, a collector current of the bipolar transistor Q4 will be reduced.

The collector current ($I_{C4}$) of this bipolar transistor Q4 is the drive current of the cascoded transistors M10 and M11.

On the other hand, a resistor R7 is inserted between the cascoded transistors M10 and M11 and the power supply VDD. The cascoded transistors M10 and M11, cascoded transistors M6 and M7, and cascoded transistors M8 and M9 constitute an inverse Widlar current mirror circuit. Accordingly, when a current that flows through the cascoded transistors M10 and M11 is reduced, currents that flow through the cascoded transistors M6 and M7 and M8 and M9 will be abruptly reduced.

Equal currents flow through the cascoded transistors M6 and M7 and the cascoded transistors M8 to M9. Accordingly, when the current that flows through the cascoded transistors M6 and M7 is reduced, the current that flows through the bipolar transistor Q1 is reduced, and a current that flows through the resistor R1 is also reduced. A decrease in the current that flows through the bipolar transistor Q2 is small, so that a current that flows through the resistor R4 is reduced. The base voltage of the bipolar transistor Q3 is reduced, and a current that flows through the bipolar transistors Q3 is thereby reduced. The function of this negative phase amplifier circuit operates to reduce a current that flows through the bipolar transistor Q4 to the contrary, and operates to reduce the current that flows through the cascoded transistors M10 to M11. The current that flows through the cascoded transistors M6 and M7 is also reduced to be fixed at a predetermined current value.

That is, it can be seen that among the bipolar transistors Q1 to Q3 and the inverse Widlar current mirror circuit that constitutes a self-biasing circuit, a negative feedback current loop is formed.

The current that flows through the cascoded transistors M6 to M7 at this point is expressed as follows:

$$\begin{aligned} I1 &= IC + (VBE1 + ICR1)/R2 \\ &= [VBE1 + \{(R1 + R2)/(R0 + R3 - R1)\}V_T\ln(K)]/R2 \\ &= [VBE1 + \{(R1 + R2)/(R0 + R3 - R1)\}\Delta VBE]/R2 \\ &= [VBE2 + \{(R0 + R2 + R3)/(R0 + R3 - R1)\}\Delta VBE]/R2 \end{aligned} \tag{122}$$

When the current that flows through the cascoded transistors M6 and M7 is set to be equal to the current IOUT that flows through the cascoded transistors M12 and M13, the following equations hold:

$$\begin{aligned} VREF &= R5IOUT \\ &= (R5/R2)[VBE1 + \{(R1 + R2)/(R0 + R3 - R1)\}\Delta VBE] \\ &= (R5/R2)[VBE2 + \{(R0 + R2 + R3)/(R0 + R3 - R1)\}\Delta VBE] \end{aligned} \tag{123}$$

The voltage VBE1 has a temperature coefficient of approximately −1.9 mV/° C. The voltage VBE2 also has a temperature coefficient of approximately −1.9 mV/° C. As is well known, the voltage ΔVBE has a positive temperature characteristic in this circuit as well and is proportionate to the thermal voltage $V_T$ (the temperature characteristic thereof being 0.0853 mV/° C.).

That is, the temperature characteristics of the term [VBE1+{(R1+R2)/(R0+R3−R1)}ΔVBE] in Equation (122) can be compensated by setting a resistor ratio {(R2+R2)/(R0+R3−R1)} and performing weighting of the voltage ΔVBE having the positive temperature characteristic by the set resistor ratio and adding the resulting voltage to the voltage VBE1 having the positive temperature characteristic.

Accordingly, it can be seen that when the voltage VBE1 is set to become approximately 620 mV at ambient temperature, the voltage VBE2 becomes 580 mV at the ambient temperature, and the voltage [VBE1+{(R1+R2)/(R0+R3−R1)}ΔVBE] likewise becomes approximately 1.2 V.

Further, the resistor ratio (R5/R2) has zero temperature coefficient. Thus, the reference voltage VREF to be output becomes the voltage in which temperature characteristic thereof is compensated. In this case, the resistor ratio (R5/R2) can be arbitrarily set. Then, when the resistor ratio (R5/R2) is set to be larger than 1, the voltage VREF becomes higher than 1.2 V. When the resistor ratio (R5/R2) is set to be smaller than 1, the voltage VREF becomes lower than 1.2 V. These phenomena are the same as those with the prior art. Especially when the resistor ratio (R5/R2) is set to be smaller than 1 that makes the voltage VREF to be lower than 1.2 V, the supply voltage can be reduced. When the voltage VREF is set to 0.8 V, for example, the reference voltage circuit can be operated at the supply voltage of approximately 1.2 V or higher.

Embodiment 33

Likewise, the circuit can be changed to each of those in FIGS. 43 to 46. In all of the circuits, the circuit analysis by hand calculation is difficult. An operation of the present embodiment will be described.

In FIGS. 43 to 46 as well, as in a case shown in FIG. 42, when a current that flows through cascoded transistors M6 and M7 is increased, a current that flows through the transistor Q1 is increased, and a current that flows through a resistor R0 is also increased. Since a current mirror circuit that includes the bipolar transistors Q1 and Q2 is in the monotonously increasing reason, an increase in a current that flows through the bipolar transistor Q2 is small. A current that flows through a resistor R4 is increased, so that a base voltage of the bipolar transistor Q3 is improved (enhanced). A current that flows through the bipolar transistor Q3 is thereby increased. The function of this negative phase amplifier circuit operates to reduce a current that flows through a bipolar transistor Q4 to the contrary, and operates to reduce a current that flows through the cascoded transistors M10 and M11. The current that flows through the cascoded transistors M6 and M7 will also be reduced and will be fixed at a predetermined current value.

That is, it can be seen that a negative feedback current loop is formed between the bipolar transistors Q1 to Q4 and an inverse Widlar cascode current mirror circuit that constitutes a self-biasing circuit. Accordingly, in the case of any of the circuits, it is controlled so that a base voltage of the bipolar transistor Q2 becomes equal to the base voltage of the bipolar transistor Q3. Temperature characteristics can be compensated by performing weighting of a current having a positive temperature characteristic proportionate to the difference voltage ΔVBE between the voltage VBE of the bipolar transistor Q1 and the voltage VBE of the bipolar transistor Q2 using respective resistance values of the resistors R0 to R4 and adding the resulting current to a current having a negative temperature characteristic proportionate to the VBE of the bipolar transistor (by reducing only temperature characteristics of the resistors, actually). Then, by converting the resulting current to a voltage through the resistor, an arbitrary reference voltage having zero temperature coefficient can be obtained.

Other Embodiment Mode of the Present Invention

The reference voltage circuit shown in FIG. 42 can be likewise modified such that the current is branched into the currents that flow through the bipolar transistors and the currents that flow through the resistors connected in parallel with therewith, thereby setting the drive currents.

Embodiment 34

Figure 46:
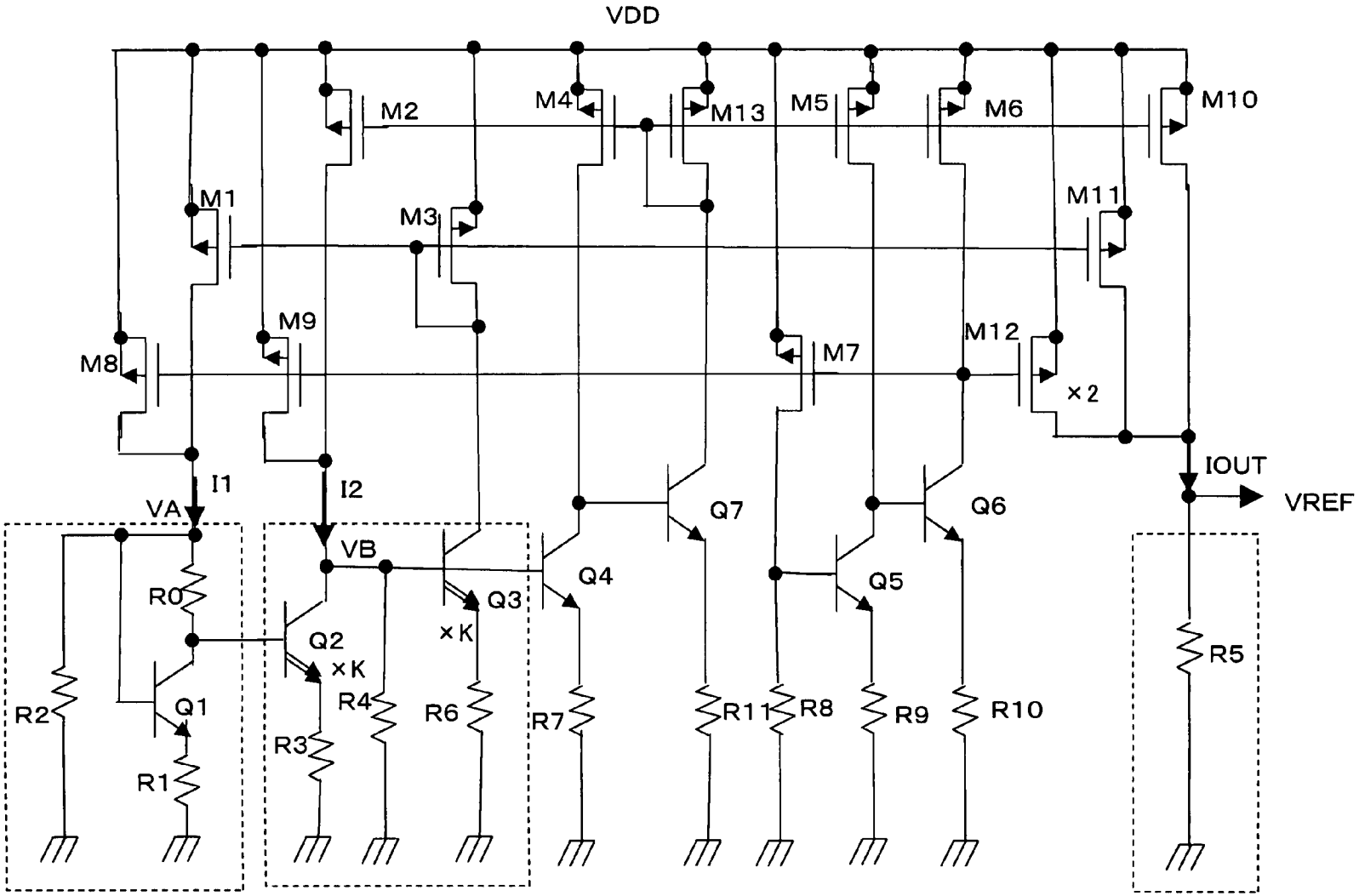
FIG. 46 is a diagram showing a circuit configuration of a third embodiment of (claim 10 of) the present invention.

FIG. 46 shows a circuit when a self-biasing system of the reference voltage circuit shown in FIG. 42 is modified such that the current is branched into the currents that flow through the bipolar transistors and the currents that flow through the resistors connected in parallel with therewith, thereby setting the drive currents. In this case, for simplicity of the description, the start-up circuit is omitted.

Now, assume that the transistor size of a bipolar transistor Q2 is K times as large as that of a transistor Q1, which is the unit bipolar transistor. Also assume that the transistor size of the bipolar transistor Q3 is K times as large as that of the transistor Q1, which is the unit bipolar transistor.

Further, resistors R2, R4, and R8 are set to be equal. A resistor R3 is set to be equal to a resistor R6. Further, resistors R1, R7, R9, R10, and R11 are set to be equal. Each of a bipolar transistor Q5 and a bipolar transistor Q6 to be driven by MOS transistors M5 and M6, respectively, constitutes a negative phase amplifier, thereby constituting a positive phase amplifier in two stages.

That is, an output of this two-stage (positive phase) amplifier is connected to a gate of an MOS transistor M7. A drain output current of the MOS transistor M7 is grounded through a resistor R8. The other terminal of the resistor R8 is connected to a base of the (unit) bipolar transistor Q5.

On the other hand, an MOS transistor M4 and a bipolar transistor Q4 that is driven thereby constitute a negative phase amplifier. A diode-connected MOS transistor M13 and a bipolar transistor Q7 constitute a positive phase amplifier to the contrary. A negative phase amplifier is thereby constituted in two stages.

Further, since the reference voltage circuit is in the monotonously increasing region, MOS transistors M2 and M9 and the bipolar transistor Q2 to be driven thereby constitute a negative phase amplifier. A diode-connected MOS transistor M3 and the bipolar transistor Q3 constitute a positive phase amplifier to the contrary. Likewise, a negative phase amplifier is thereby constituted in two stages.

Gates of the MOS transistors M7 and M9 and a gate of an MOS transistor M8 are connected to one another, thereby constituting a current mirror circuit having a current ratio of 1:1:1.

Likewise, a gates of an MOS transistor M1 and a gate of the MOS transistor M3 are connected in common, thereby constituting a current mirror circuit having a current ratio of 1:1. Gates of the MOS transistors M13 and M4, and a gate of an MOS transistor M2 are connected in common, thereby constituting a current mirror circuit having a current ratio of 1:1:1.

An operation of the present embodiment will be described. First, a description that a collector voltage (=base voltage) VA of the diode-connected bipolar transistor Q1 becomes equal to a collector voltage of the (unit) bipolar transistor Q5 will be made.

The bipolar transistor Q5 and the resistor R9, the bipolar transistor Q6 and the resistor R10, the bipolar transistor Q7 and the resistor R11 are all copies of the bipolar transistor Q1 and the resistor R1. The resistor R8 is the copy of the resistor R2 (=R4). The bipolar transistor Q3 and the resistor R6 are the copy of the bipolar transistor Q2 and the resistor R3. The bipolar transistor Q4 and the resistor R7 are the copy of the bipolar transistor Q1 and the resistor R1.

Accordingly, a current that flows in common through the bipolar transistor Q7 and the resistor R11 is copied through the MOS transistor M13 to the MOS transistors M1, M4, M5 and M6 that constitute the current mirror circuit.

Accordingly, by an output signal of the two-stage (positive phase) amplifier constituted from the bipolar transistor Q5, resistor R9, load transistor M5, bipolar transistor Q6, resistor R10, and load transistor M6, currents that flow through the MOS transistors are controlled. A terminal voltage of the grounded resistor R8 will be controlled through a negative feedback loop so that the current that flows in common through the bipolar transistor Q5 and the resistor R9 becomes equal to the current that flows in common through the bipolar transistor Q6 and the resistor R10.

Accordingly, equal currents are supplied to the bipolar transistor Q2, resistor R3, and resistor R4 connected in parallel with the bipolar transistor Q2 and the resistor R3 through the MOS transistor M2 that constitutes the current mirror circuit with this MOS transistor M4.

The current that flows in common through the bipolar transistor Q3 and the resistor R6 is copied through the MOS transistor M3 to the MOS transistor M1 that constitutes the current mirror circuit with the MOS transistor M3.

Accordingly, a current which is equal to the current that flows in common through this bipolar transistor Q3 and the resistor R6 is supplied to the bipolar transistor Q11, resistors R0 and R1, and resistor R2 connected in parallel with the bipolar transistor Q1 and the resistors R0 and R1.

A current mirror circuit that includes the bipolar transistor Q1 and the bipolar transistor Q2 operates in the monotonously increasing region. The MOS transistors M2 and M9, bipolar transistor Q2, resistor R3, and resistor R4 connected in parallel therewith constitute the negative phase amplifier and constitute a negative feedback path, thereby operating to cause the current that flows in common through the bipolar transistor Q3 and the resistor R6 to become a predetermined value.

The current that flows in common through the bipolar transistor Q7 and the resistor R11 is copied through the MOS transistor M13 to the MOS transistors M2 and M4 that constitute the current mirror circuit with the MOS transistor M13.

Accordingly, a current which is equal to the current that flows in common through this bipolar transistor Q7 and the resistor R11 is supplied to the bipolar transistor Q2, resistor R3, and the resistor R4 connected in parallel with the bipolar transistor Q2 and the resistor R3.

The MOS transistor M4, bipolar transistor Q4, and resistor R7 constitute a negative phase amplifier and constitute a negative feedback path, thereby operating to cause the current that flows in common through the bipolar transistor Q7 and the resistor R11 to become a predetermined value.

As described above, by constituting the double negative feedback paths, the value of the current that flows through the current mirror circuit constituted from the MOS transistor M3 and the MOS transistor M1 and the value of the current that flows through the current mirror circuit constituted from the MOS transistors M13, M2, and M4 are set to the predetermined values.

On the other hand, the current that flows through the resistor R8 is copied through the MOS transistor M7 to the MOS transistors M8 and M9 that constitute the current mirror circuit with the MOS transistor M7. Accordingly, it can be seen that the drive current I1 that generates the terminal voltage VA is the sum of the current that passes in common through the bipolar transistor Q3 and the resistor R6 and the current that flows through the resistor R8, and that the drive current I2 that generates the terminal voltage VB is the sum of the current that flows in common through the bipolar transistor Q4 and the resistor R7 and the current that flows through the resistor R8.

A base of the bipolar transistor Q1 and the resistor R2 are connected in common, and their terminal voltage is the voltage VA, and a base of the bipolar transistor Q3 and a base of the bipolar transistor Q4 are connected in common, and their terminal voltage is the voltage VB.

Since the values of the resistors R2, R4, and R8 are all equal, and the currents that flow through the resistors R2, R4, and R8 are all equal now, the terminal voltage VA becomes equal to the terminal voltage VB. As described above, in the present invention, the three negative feedback paths are constituted. The drive currents I1 and I2 are thereby set to the predetermined values.

When the emitter area ratio K of the bipolar transistor Q3 (=Q2) and the values of the resistor R6 (=R3) and resistor R11 (=R7(=R1)) (in which the value of the resistor R6 is larger than the value of the resistor R7) are set, the voltage value VB (=VA) larger than zero is uniquely determined when the circuit is started up.

Now, assume that the resistor R6 (=R3), resistor R0, resistor R7(=R1), (in which the value of the resistor R0 is larger than the value of the resistor R1), are set in order to make the current I1 equal to the current I2. In this case, when the slight difference δ between the current $I_{C4}$ that flows through the bipolar transistor Q7(=Q4) and the current $I_{C3}$ that flows through the bipolar transistor Q3 is generated, (or when $I_{C3}=(1+\delta)I_{C7}$), the following expressions are given:

$$\begin{aligned}\Delta VBE &= VBE4 - VBE3 \\ &= V_T In\{K/(1+\delta)\} \\ &= R6 I_{C3} - R7 I_{C7} \\ &= \{R6(1+\delta) - R11\} I_{C7}\end{aligned} \tag{124}$$

Thus, a current ratio difference is canceled by setting the values of the resistor R6 and the resistor R11 (=R7) again.

In other words, by setting the values of the resistors R6 and R11 (=R7), the drive current I1 can be made to be equal to the drive current I2. At any rate, the voltage VA is set to be equal to the voltage VB. That is, an operating condition which is the same as that in the reference voltage circuit in FIG. 42 is implemented.

When the MOS transistors M10 and M11 are set to the unit MOS transistors, and the transistor size of the MOS transistor M12 is set to be twice as large as the transistor size of the unit transistor, the MOS transistors M13 and M11, the MOS transistors M3 and M11 and the MOS transistors M7 and M12 form current mirror circuits, respectively. Then, current copying is performed, so that the following equations hold:

$$IOUT = I1 + I2 = 2I2 \tag{125}$$

When the current-to-voltage conversion circuit in the output circuit is set to the resistor shown in FIG. 2C, the following expression is obtained:

$$VREF = R5 \times IOUT \tag{126}$$

The same result as that in the reference voltage circuit shown in FIG. 42 can be obtained.

In the above-mentioned reference voltage circuits shown in FIGS. 30 to 35, the current-to-voltage conversion circuit on the output side was simplified as the resistor for simplicity of the description and descriptions of operations thereof were given. Needless to say, as in the cases of the reference voltage circuits described heretofore, shown in FIG. 2 to 29, any of the first current-to-voltage conversion circuit in each of the circuits in FIGS. 30, 31, 34, and 35 may be employed as the current-to-voltage conversion circuit on the output side. However, in this case as well, the unit transistor is employed as the transistor and the area of the transistors on the chip of the output circuit can be reduced to a certain degree.

As an example of use of the present invention, various reference voltage circuits to be integrated on an LSI chip can be pointed out. Especially, with advancement of miniaturization of an integrated circuit process in recent years, a power supply voltage for the LSI has been reduced. A stable reference voltage circuit without being subject to temperature variations, which is operated even at the power supply voltage in the vicinity of 1 V thus becomes necessary. The present invention is able to meet such a demand.

It should be noted that other objects, features and aspects of the present invention will become apparent in the entire disclosure and that modifications may be done without departing the gist and scope of the present invention as disclosed herein and claimed as appended herewith.

Also it should be noted that any combination of the disclosed and/or claimed elements, matters and/or items may fall under the modifications aforementioned.

What is claimed is:

1. A reference voltage circuit comprising:

first and second current-to-voltage conversion circuits, each for receiving a current and converting the current to a voltage;

control means for performing control so that the voltage of said first current-to voltage conversion circuit becomes equal to the voltage of the second current-to-voltage conversion circuit;

a first current mirror circuit for outputting a current proportionate to a value of the current supplied to one of said first current-to-voltage conversion circuit and said second current-to-voltage conversion circuit; and a third current-to-voltage conversion circuit for receiving the output current from said first current mirror circuit, and converting the output current to a voltage, for output;

wherein each of said first and second current-to-voltage conversion circuits includes one of:

a circuit comprising a serial circuit comprising a first diode and a first resistor connected in series with each other, and a second resistor connected in parallel with the series circuit; and a circuit comprising a parallel circuit comprising a first diode and a first resistor connected in parallel with each other, and a second resistor, having only two terminal elements, connected in series with the parallel circuit.

2. The reference voltage circuit according to claim 1, wherein said third current-to-voltage conversion circuit comprises a resistor.

3. The reference voltage circuit according to claim 1, further comprising:

a third diode connected in parallel with said first current-to-voltage conversion circuit; and a fourth diode connected in parallel with said second current-to-voltage conversion circuit.

4. The reference voltage circuit according to claim 1, wherein said control means includes a differential amplifier.

5. The reference voltage circuit according to claim 4, wherein each of said first and second current-voltage conversion circuits includes the circuit comprising the series circuit including the first diode and the first resistor connected in series with each other, and the second resistor connected in parallel with the series circuit, intermediate potentials of said second resistors in said first and second current-to-voltage conversion circuits being supplied to input terminals of said differential amplifier, respectively.

6. The reference voltage circuit according to claim 1, wherein said control means includes a second current mirror circuit which is self-biased by a current mirror circuit including said first current mirror circuit.

7. The reference voltage circuit according to claim 1, wherein said control means comprises second and third current mirrors, said control means comparing the current supplied to said first current-to-voltage conversion circuit with the current supplied to said second current-to-voltage conversion circuit by said second current mirror circuit, and by biasing the third current mirror circuit by an output of said second current mirror circuit, said control means performing control so that the voltage of said first current-to-voltage conversion circuit becomes equal to the voltage of said second current-to-voltage conversion circuit.

8. The reference voltage circuit according to claim 1, wherein said control means includes a second mirror circuit self-biased by an inverse Widlar current mirror circuit including said first current mirror circuit.

9. A reference voltage circuit comprising:

first and second current-to-voltage conversion circuits, each for receiving a current and converting the current to a voltage;

control means for performing control so that the voltage of said first current-to-voltage conversion circuit becomes equal to the voltage of said second current-to-voltage conversion circuit;

a first current mirror circuit for outputting a current proportionate to a value of the current supplied to one of said first current-to-voltage conversion circuit and said second current-to-voltage conversion circuit; and a third current-to-voltage conversion circuit for receiving the output current from said first current mirror circuit, and converting the output current to a voltage, for output;

wherein each of said first and third current-to-voltage conversion circuits includes a diode-connected first bipolar transistor, said first bipolar transistor having an emitter grounded through a first emitter resistor and having a base directly grounded with a second resistor connected in parallel therewith, or grounded through the first emitter resistor; and wherein said second current-to-voltage conversion circuit includes second and third bipolar transistors, said second bipolar transistor having an emitter grounded through a second emitter resistor, having a base connected to an output terminal of said first current-to-voltage conversion circuit, and having a collector connected to a base of said third bipolar transistor and directly grounded with a fourth resistor connected in parallel therewith or grounded through said second emitter resistor, a collector of said third bipolar transistor driving said first current mirror circuit.

10. A reference voltage circuit comprising:

a first current-to-voltage conversion circuit including a diode-connected first bipolar transistor having an emitter grounded through a first emitter resistor, and having a base directly grounded with a second resistor connected in parallel therewith;

a second current-to-voltage conversion circuit including second and third bipolar transistors;

fourth and fifth bipolar transistors;

said second bipolar transistor having an emitter grounded through a second emitter resistor, having a base connected to an output terminal of said first current-to-voltage conversion circuit, and having a collector connected to bases of said third and fourth bipolar transistors and being directly grounded with a fourth resistor connected in parallel therewith;

transistor sizes of said third and fourth bipolar transistors being the same as transistor sizes of said first and second bipolar transistors, respectively;

said third and fourth bipolar transistors having emitters grounded through third and fourth emitter resistors, respectively, values of said third and fourth emitter resistors being equal to values of said first and second emitter resistors, respectively; and a seventh resistor, one terminal of said seventh resistor being grounded to bias said fifth bipolar transistor, a value of said seventh resistor being equal to that of each of said second and fourth resistors, said fifth bipolar transistor having an emitter grounded through a fifth emitter resistor, said fifth bipolar transistor having a transistor size being equal to that of said third or fourth bipolar transistor;

said reference voltage circuit further comprising:

means for causing a current flowing through said fifth bipolar transistor to be equal to a current flowing though said third or fourth bipolar transistor; and means for causing a sum of currents flowing through said third and fourth bipolar transistors and a current flowing through said seventh resistor to drive said first current-to-voltage conversion circuit, said second bipolar transistor, and said fourth emitter resistor, wherein said third current-to-voltage conversion circuit is driven by a current proportionate to a sum of a current flowing through said first or second bipolar transistor and a current flowing through said second or fourth resistor.

11. The reference voltage circuit according to claim 9, wherein said third current-to-voltage conversion circuit comprises a resistor element.

12. The reference voltage circuit according to claim 1, wherein the diode comprises a diode-connected bipolar transistor.

13. A reference voltage circuit comprising:

first and second current-to-voltage conversion circuits each for receiving a current and converting the current to a voltage;

a first current mirror circuit for outputting a current proportionate to a value of the current supplied to said first current-to-voltage conversion circuit or said second current-to-voltage conversion circuit;

a second current mirror circuit connected between outputs of said first and second current-to-voltage conversion circuits and said first current mirror circuit; and a third current-to-voltage conversion circuit for receiving the output current from said first current mirror circuit, and converting the output current to a voltage, for output;

wherein each of said first and second current-to-voltage conversion circuits includes one of:

a circuit comprising a series circuit including a first diode and a first resistor connected in series with each other and a second resistor connected in parallel with the series circuit; and a circuit comprising a parallel circuit including a first diode and a first resistor connected in parallel with each other and a second resistor, having only two terminal elements, connected in series with the parallel circuit;

wherein said third current-to-voltage conversion circuit comprises a resistor element; and wherein said second current mirror circuit is self-biased by said first current mirror circuit, a voltage of said first current-to-voltage conversion circuit and a voltage of said second current-to-voltage circuit being thereby controlled to be equal.

14. A reference voltage circuit comprising:

first and second current-to-voltage conversion circuits each for receiving a current and converting the current to a voltage;

a first current mirror circuit for outputting a current proportionate to a value of the current supplied to said first current-to-voltage conversion circuit and a second current mirror circuit for outputting a current proportionate to a value of the current supplied to said second current-to-voltage conversion circuit;

first and second transistors, said first transistor being corrected between an output of said first current-to-voltage conversion circuit and an input of said first current mirror circuit, said second transistor being connected between an output of said second current-to-voltage conversion circuit and an input of said second current mirror circuit;

a third current mirror circuit for receiving output currents from said first and second current mirror circuits, and performing current comparison thereof; and a third current-to-voltage conversion circuit for receiving the output current of said first current mirror circuit, and converting the output current to a voltage, for output, wherein each of said first and second current mirror circuits includes one of:

a circuit comprising a series circuit including a first diode and a first resistor connected in series, and a second resistor connected in parallel with the series circuit, and a circuit comprising a parallel circuit including a first diode and a first resistor connected in parallel, and the second resistor connected in series with the parallel circuit, wherein said third current-to-voltage circuit comprises a resistor element, and wherein an output of said third current mirror circuit is connected to a control terminal connected in common of said first and second transistors, said reference voltage circuit further comprising:

fourth and fifth current-to-voltage conversion circuits, each having a same configuration as said first current-to-voltage conversion circuit being connected to said third current mirror circuit.

15. A reference voltage circuit comprising:

first and second current-to-voltage conversion circuits each for receiving a current and converting the current to a voltage;

a first current mirror circuit comprising first and second outputs;

first and second transistors, said first transistor being connected between said first current-to-voltage conversion circuit and an input of said first current mirror circuit, said second transistor being connected between said second current-to-voltage conversion circuit and the first output of said second current mirror circuit;

a third current-to--voltage conversion circuit for receiving an output current from the second output of said first current mirror circuit, converting the output current to a voltage, for output;

a third transistor having a control terminal thereof connected in common to control terminals of said first and second transistors, said third transistor being diode-connected, said third transistor being connected to a fourth current-to-voltage conversion circuit having a same configuration as said first current-to-voltage circuit, said third transistor constituting a current mirror circuit with said first and second transistors; and a fourth transistor connected between an output of said third transistor and a power supply, a control terminal of said fourth transistor being connected to the first output of said first current mirror circuit;

wherein each of said first and second, current mirror circuits includes one of:

a circuit comprising a series circuit including a first diode and a first resistor connected in series with each other, and a second resistor connected in parallel with the series circuit; and a circuit comprising a parallel circuit including a first diode and a first resistor connected in parallel with each other, and a second resistor connected in series with the parallel circuit; and wherein said third current-to-voltage circuit comprises a resistor element.

16. The reference voltage circuit according to claim 13, further comprising:

diodes connected in parallel with said first and second current-to-voltage conversion circuits, respectively.

17. The reference voltage circuit according to claim 14, further comprising:

diodes connected in parallel with said first, second, fourth, and fifth current-to-voltage conversion circuits, respectively.

18. The reference voltage circuit according to claim 15, further comprising:

diodes connected in parallel with said first, second, and fourth current-to-voltage conversion circuits, respectively.

19. The reference voltage circuit according to claim 1, wherein each of said first and second current-to-voltage conversion circuits includes the circuit comprising the serial circuit including the first diode and the first resistor connected in series with each other, and the second resistor connected in parallel with the series circuit.

20. The reference voltage circuit according to claim 1, wherein the first current mirror circuit comprises three transistors, and wherein each transistor provides current to one of said first, second, and third current-to-voltage conversion circuits.

21. The reference voltage circuit according to claim 13, wherein each of said first and second current-to-voltage conversion circuits includes the circuit comprising the serial circuit including the first diode and the first resistor connected in series with each other, and the second resistor connected in parallel with the series circuit.

22. The reference voltage circuit according to claim 13, wherein the first current mirror circuit comprises three transistors, and wherein each transistor provides current to one of said first, second, and third current-to-voltage conversion circuits.

* * * * *